US010755618B2

(12) United States Patent
Lin et al.

(10) Patent No.: US 10,755,618 B2
(45) Date of Patent: Aug. 25, 2020

(54) NOISE MITIGATION FOR DISPLAY PANEL SENSING

(71) Applicant: Apple Inc., Cupertino, CA (US)

(72) Inventors: Hung Sheng Lin, San Jose, CA (US); Shengkui Gao, San Jose, CA (US); Hyunwoo Nho, Palo Alto, CA (US); Chin-Wei Lin, San Jose, CA (US); Mohammad B. Vahid Far, San Jose, CA (US); Jie Won Ryu, Santa Clara, CA (US); Kingsuk Brahma, Mountain View, CA (US); Junhua Tan, Satatoga, CA (US); Sun-Il Chang, San Jose, CA (US); Shinya Ono, Cupertino, CA (US); Jesse Aaron Richmond, San Francisco, CA (US); Yafei Bi, Los Altos Hills, CA (US); Derek K. Shaeffer, Redwood City, CA (US); Myungjoon Choi, Sunnyvale, CA (US); Shiping Shen, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/389,899

(22) Filed: Apr. 19, 2019

(65) Prior Publication Data

US 2019/0244555 A1 Aug. 8, 2019

Related U.S. Application Data

(63) Continuation-in-part of application No. 16/361,018, filed on Mar. 21, 2019, which is a (Continued)

(51) Int. Cl.
*G09G 3/00* (2006.01)

(52) U.S. Cl.
CPC ..... *G09G 3/006* (2013.01); *G09G 2310/0291* (2013.01); *G09G 2320/029* (2013.01); (Continued)

(58) Field of Classification Search
CPC ..... G09G 3/006; G09G 3/20; G09G 3/2092; G09G 3/3233; G09G 3/325; G09G 3/3225; G09G 3/3241
See application file for complete search history.

(56) References Cited

U.S. PATENT DOCUMENTS 6,166,766 A 12/2000 Moore et al.
8,921,855 B2 12/2014 Okita et al.
(Continued)

OTHER PUBLICATIONS

Kiyun Kwon et al.; "A Fully Differential Correlated Doubling Sampling Readout Circuit for Mutual-capacitance Touch Screens," Journal of Semiconductor Technology and Science, vol. 15, No. 3, Jun. 2015; pp. 340-355.
(Continued)

*Primary Examiner* — Sardis F Azongha
(74) *Attorney, Agent, or Firm* — Fletcher Yoder P.C.

(57) ABSTRACT

Systems and methods are provided for differential sensing (DS), difference-differential sensing (DDS), correlated double sampling (CDS), correlated-correlated double sampling (CDS-CDS) and/or programmable capacitor matching to reduce display panel sensing noise. An electronic device may include one or more processors that generate image data according to sensing operations. The one or more processors may reference a sensing pattern as part of sensing operations. Applying test sensing signals based on the sensing pattern may help reduce error associated with sensing operations.

20 Claims, 37 Drawing Sheets

Related U.S. Application Data continuation-in-part of application No. 15/698,262, filed on Sep. 7, 2017, now Pat. No. 10,559,238.

(60) Provisional application No. 62/397,845, filed on Sep. 21, 2016.

(52) U.S. Cl.
CPC . *G09G 2320/041* (2013.01); *G09G 2320/043* (2013.01); *G09G 2330/06* (2013.01); *G09G 2330/12* (2013.01)

(56) References Cited

U.S. PATENT DOCUMENTS

| | | | | |
|---|---|---|---|---|
| 2012/0162484 | A1 | 6/2012 | Mo et al. | |
| 2013/0300690 | A1 | 11/2013 | Yang et al. | |
| 2014/0300415 | A1* | 10/2014 | Casiraghi | G01P 15/0802 330/260 |
| 2015/0009204 | A1 | 1/2015 | Chaji | |
| 2015/0138177 | A1* | 5/2015 | Kwon | G09G 3/3233 345/211 |
| 2015/0212643 | A1 | 7/2015 | Lee et al. | |
| 2015/0373291 | A1 | 12/2015 | Oh et al. | |
| 2016/0163255 | A1 | 6/2016 | Kim et al. | |
| 2017/0227569 | A1* | 8/2017 | Alwardi | G01P 15/125 |

OTHER PUBLICATIONS

International Partial Search Report and Invitation for PCT Application No. PCT/US2017/050769 dated Dec. 14, 2017; 17 pgs.

* cited by examiner

KEY: 1 CORRESPONDS TO POSITIVE POLARITY OUTPUT FROM SENSE AMPLIFIER.
-1 CORRESPONDS TO NEGATIVE POLARITY OUTPUT FROM SENSE AMPLIFIER.
NOTE: EACH 1 OR -1 REPRESENTS TWO SENSING SIGNALS (E.G., TEST SIGNAL AND REFERENCE SIGNAL).

410A

| 322 | | 308 | |
|---|---|---|---|
| -1 | -1 | 1 | 1 |
| -1 | -1 | 1 | 1 |
| -1 | -1 | 1 | 1 |
| -1 | -1 | 1 | 1 |
| -1 | -1 | 1 | 1 |

*FIG. 40A*

410C

| 308 | | 322 | |
|---|---|---|---|
| 1 | -1 | 1 | -1 |
| 1 | -1 | 1 | -1 |
| 1 | -1 | 1 | -1 |
| 1 | -1 | 1 | -1 |
| 1 | -1 | 1 | -1 |

*FIG. 40C*

410E

| 308 | | 322 | |
|---|---|---|---|
| 1 | -1 | -1 | 1 |
| -1 | 1 | 1 | -1 |
| 1 | -1 | -1 | 1 |
| -1 | 1 | 1 | -1 |
| 1 | -1 | -1 | 1 |

*FIG. 40E*

410G

| 308 | | 322 | |
|---|---|---|---|
| 1 | -1 | 1 | -1 |
| -1 | 1 | -1 | 1 |
| 1 | -1 | 1 | -1 |
| -1 | 1 | -1 | 1 |
| 1 | -1 | 1 | -1 |

*FIG. 40G*

410B

| 308 | | 322 | |
|---|---|---|---|
| 1 | 1 | -1 | -1 |
| 1 | 1 | -1 | -1 |
| 1 | 1 | -1 | -1 |
| 1 | 1 | -1 | -1 |
| 1 | 1 | -1 | -1 |

*FIG. 40B*

410D

| 308 | | 322 | |
|---|---|---|---|
| -1 | 1 | -1 | 1 |
| -1 | 1 | -1 | 1 |
| -1 | 1 | -1 | 1 |
| -1 | 1 | -1 | 1 |
| -1 | 1 | -1 | 1 |

*FIG. 40D*

410F

| 308 | | 322 | |
|---|---|---|---|
| -1 | 1 | 1 | -1 |
| 1 | -1 | -1 | 1 |
| -1 | 1 | 1 | -1 |
| 1 | -1 | -1 | 1 |
| -1 | 1 | 1 | -1 |

*FIG. 40F*

410H

| 322 | | 308 | |
|---|---|---|---|
| -1 | 1 | -1 | 1 |
| 1 | -1 | 1 | -1 |
| -1 | 1 | -1 | 1 |
| 1 | -1 | 1 | -1 |
| -1 | 1 | -1 | 1 |

*FIG. 40H*

410I

| 308 | | 322 | |
|---|---|---|---|
| 1 | -1 | -1 | 1 |
| -1 | -1 | 1 | 1 |
| 1 | -1 | 1 | -1 |
| -1 | 1 | 1 | 1 |
| -1 | -1 | -1 | -1 |

*FIG. 40I*

410J

| 308 | | 322 | |
|---|---|---|---|
| 1 | -1 | 1 | -1 |
| -1 | 1 | -1 | 1 |
| 1 | -1 | 1 | -1 |
| 1 | -1 | -1 | 1 |
| 1 | -1 | -1 | 1 |

412

414

*FIG. 40J*

410K

| 322 | | 308 | |
|---|---|---|---|
| -1 | 1 | 1 | -1 |
| 1 | -1 | -1 | 1 |
| 1 | -1 | -1 | 1 |
| 1 | -1 | -1 | 1 |
| -1 | 1 | 1 | -1 |

*FIG. 40K*

410L

| 322 | | 308 | |
|---|---|---|---|
| -1 | -1 | 1 | 1 |
| 1 | -1 | -1 | 1 |
| -1 | 1 | 1 | -1 |
| -1 | -1 | 1 | 1 |
| -1 | -1 | 1 | 1 |

*FIG. 40L*

KEY: 1 CORRESPONDS TO POSITIVE POLARITY OUTPUT FROM SENSE AMPLIFIER.
-1 CORRESPONDS TO NEGATIVE POLARITY OUTPUT FROM SENSE AMPLIFIER.
NOTE: EACH 1 OR -1 REPRESENTS TWO SENSING SIGNALS (E.G., TEST SIGNAL AND REFERENCE SIGNAL).

NOISE MITIGATION FOR DISPLAY PANEL SENSING

CROSS REFERENCE TO RELATED APPLICATIONS

This application is a Continuation-in-Part application of U.S. Non-provisional patent application Ser. No. 16/361,018, entitled, "Noise Mitigation for Display Panel Sensing," filed Mar. 21, 2019, which is a Continuation-in-Part application of U.S. Non-Provisional patent application Ser. No. 15/698,262, entitled "Noise Mitigation for Display Panel Sensing," filed Sep. 7, 2017, which is a Non-Provisional patent application that claims priority to U.S. Provisional Patent Application No. 62/397,845, entitled "Noise Mitigation for Display Panel Sensing," filed Sep. 21, 2016, which are herein incorporated by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure relates to display panel sensing to compensate for operational variations in the display panel and, more particularly, to reducing or eliminating common-mode display panel noise that may interfere with display panel sensing. Electronic displays are found in numerous electronic devices. As electronic displays gain higher resolutions that provide finer, more detailed images at higher dynamic ranges and a broader range of colors, the fidelity of the images becomes more valuable. To ensure the fidelity of the images displayed on an electronic display, display panel sensing may be used to sense operational variations in the pixels of an electronic display. These operational variations may be due to factors such as temperature or aging. Since factors such as temperature and aging tend to be non-uniform across the electronic display, a single uniform compensation may be insufficient to correct for image artifacts that would appear due to the operational variations of the electronic display. Display panel sensing may identify the variations across the display to enable a more precise image compensation.

Some electronic displays use single-ended display panel sensing, where parameters of the electronic display are sensed in comparison to a fixed reference value. While single-ended display panel sensing may work for electronic displays that are very large and thus have a relatively low pixel density, using single-ended display panel sensing on electronic displays that are smaller with a greater pixel density may result in the detection of a substantial amount of noise. The amount of noise may be further increased by other electronic components that may be operating near the display, which may frequently occur in portable electronic devices, such as portable phones. Indeed, processors, cameras, wireless transmitters, and similar components could produce electromagnetic interference that interferes with display panel sensing.

A number of systems and methods may be used to mitigate the effects of noise in display panel sensing. These include: (1) differential sensing (DS); (2) difference-differential sensing (DDS); (3) correlated double sampling (CDS); (4) correlated-correlated double sampling (CDS-CDS); and (5) programmable capacitor matching. These various systems and methods may be used individually or in combination with one another.

Differential sensing (DS) involves performing display panel sensing not in comparison to a static reference, as is done in single-ended sensing, but instead in comparison to a dynamic reference. For example, to sense an operational parameter of a test pixel of an electronic display, the test pixel may be programmed with test data. The response by the test pixel to the test data may be sensed on a sense line (e.g., a data line) that is coupled to the test pixel. The sense line of the test pixel may be sensed in comparison to a sense line coupled to a reference pixel that was not programmed with the test data. The signal sensed from the reference pixel does not include any particular operational parameters relating to the reference pixel in particular, but rather contains common-noise that may be occurring on the sense lines of both the test pixel and the reference pixel. In other words, since the test pixel and the reference signal are both subject to the same system-level noise—such as electromagnetic interference from nearby components or external interference—differentially sensing the test pixel in comparison to the reference pixel results in at least some of the common-mode noise subtracted away from the signal of the test pixel.

Difference-differential sensing involves differentially sensing two differentially sensed signals to mitigate the effects of remaining differential common-mode noise. Thus, a differential test signal may be obtained by differentially sensing a test pixel that has been programmed with test data and a reference pixel that has not been programmed with test data, and a differential reference signal may be obtained by differentially sensing two other reference pixels that have not been programmed with the test data. The differential test signal may be differentially compared to the differential reference signal, which further removes differential common-mode noise.

Correlated double sampling (CDS) and correlated-correlated double sampling (CDS-CDS) involve performing display panel sensing at least two different times and digitally comparing the signals to remove temporal noise. At one time, a test sample may be obtained by performing display panel sensing on a test pixel that has been programmed with test data. At another time, a reference sample may be obtained by performing display panel sensing on the same test pixel but without programming the test pixel with test data. Any suitable display panel sensing technique may be performed, such as differential sensing or difference-differential sensing, or even single-ended sensing. There may be temporal noise that is common to both of the samples. As such, the reference sample may be subtracted out of the test sample to remove temporal noise.

Programmable integration capacitances may further reduce the impact of display panel noise. In particular, different sense lines that are connected to a particular sense amplifier may have different capacitances. These capacitances may be relatively large. To cause the sense amplifier to sensing signals on these sense lines as if the sense line capacitances were equal, the integration capacitors may be programmed to have the same ratio as the ratio of capacitances on the sense lines. This may account for noise due to sense line capacitance mismatch.

However, noise reduction benefits from using the methods described herein (e.g., differential sensing (DS), difference-differential sensing (DDS), correlated double sampling (CDS), correlated-correlated double sampling (CDS-CDS), programmable capacitor matching) may be offset or negated by sensing error (e.g., sensing errors that increase over time due to a same polarity) introduced during sensing operations. For example, the sensing error may increase during and/or after certain processing operations, such as filtering operations (e.g., low pass filtering, low pass filtering in a spatial domain or spatial low pass filtering). Over time, the sensing error that remains after the processing operations may degrade or reduce compensation accuracy or effectiveness, which may lead to visual artifacts appearing on the display.

When differentially sensing, a sensing signal pair (e.g., a test signal and a reference signal) may be used to determine a final sensing value without a common mode noise (e.g., noise common to both the test signal and the reference signal). In conventional sensing, little attention has been paid to the arrangement of sensing signal pair outputs within an active area of the display relative to the arrangement of other sensing signal pair outputs with the same active area. However, leveraging varied positioning of sensing signal pairs (and the associated sensing outputs) may reduce sensing error present after the processing operations, such as to a lower relative noise level and/or to zero.

These various systems and methods may be used separately or combination with one another. Moreover, various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which:

FIG. 40A is an illustration of a first example of a sensing pattern that leverages the varied positioning of sensing signal pairs, in accordance with an embodiment;

FIG. 40B is an illustration of a second example of a sensing pattern that leverages the varied positioning of sensing signal pairs, in accordance with an embodiment;

FIG. 40C is an illustration of a third example of a sensing pattern that leverages the varied positioning of sensing signal pairs, in accordance with an embodiment;

FIG. 40D is an illustration of a fourth example of a sensing pattern that leverages the varied positioning of sensing signal pairs, in accordance with an embodiment;

FIG. 40E is an illustration of a fifth example of a sensing pattern that leverages the varied positioning of sensing signal pairs, in accordance with an embodiment;

FIG. 40F is an illustration of a sixth example of a sensing pattern that leverages the varied positioning of sensing signal pairs, in accordance with an embodiment;

FIG. 40G is an illustration of a seventh example of a sensing pattern that leverages the varied positioning of sensing signal pairs, in accordance with an embodiment;

FIG. 40H is an illustration of an eighth example of a sensing pattern that leverages the varied positioning of sensing signal pairs, in accordance with an embodiment;

FIG. 40I is an illustration of a ninth example of a sensing pattern that leverages the varied positioning of sensing signal pairs, in accordance with an embodiment;

FIG. 40J is an illustration of a tenth example of a sensing pattern that leverages the varied positioning of sensing signal pairs, in accordance with an embodiment;

FIG. 40K is an illustration of an eleventh example of a sensing pattern that leverages the varied positioning of sensing signal pairs, in accordance with an embodiment;

FIG. 40L is an illustration of a twelfth example of a sensing pattern that leverages the varied positioning of sensing signal pairs, in accordance with an embodiment;

DETAILED DESCRIPTION

Figure 1:
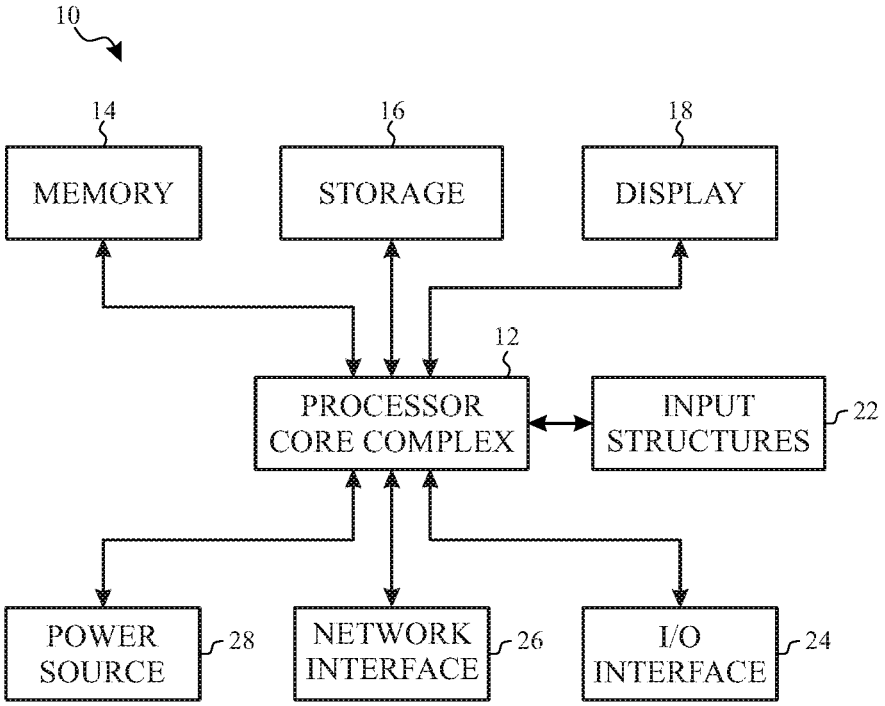
FIG. 1 is a schematic block diagram of an electronic device that performs display sensing and compensation, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic displays are ubiquitous in modern electronic devices. As electronic displays gain ever-higher resolutions and dynamic range capabilities, image quality has increasingly grown in value. In general, electronic displays contain numerous picture elements, or "pixels," that are programmed with image data. Each pixel emits a particular amount of light based on the image data. By programming different pixels with different image data, graphical content including images, videos, and text may be displayed.

As noted above, display panel sensing enables operational properties of pixels of an electronic display to be identified to improve the performance of the electronic display. For example, variations in temperature and pixel aging (among other things) across the electronic display cause pixels in different locations on the display to behave differently. Indeed, the same image data programmed on different pixels of the display could appear to be different due to the variations in temperature and pixel aging. Without appropriate compensation, these variations could produce undesirable visual artifacts. By sensing certain operational properties of the pixels, the image data may be adjusted to compensate for the operational variations across the display.

Display panel sensing involves programming certain pixels with test data and measuring a response by the pixels to the test data. The response by a pixel to test data may indicate how that pixel will perform when programmed with actual image data. In this disclosure, pixels that are currently being tested using the test data are referred to as "test pixels" and the response by the test pixels to the test data is referred to as a "test signal" or "test sensing signal." The test signal is sensed from a "sense line" of the electronic display and may be a voltage or a current, or both a voltage and a current. In some cases, the sense line may serve a dual purpose on the display panel. For example, data lines of the display that are used to program pixels of the display with image data may also serve as sense lines during display panel sensing.

To sense the test signal, it may be compared to some reference value. Although the reference value could be static—referred to as "single-ended" testing—using a static reference value may cause too much noise to remain in the test signal. Indeed, the test signal often contains both the signal of interest, which may be referred to as the "pixel operational parameter" or "electrical property" that is being sensed, as well as noise due to any number of electromagnetic interference sources near the sense line. This disclosure provides a number of systems and methods for mitigating the effects of noise on the sense line that contaminate the test signal. These include, for example, differential sensing (DS), difference-differential sensing (DDS), correlated double sampling (CDS), correlated-correlated double sampling (CDS-CDS), and programmable capacitor matching. These various display panel sensing systems and methods may be used individually or in combination with one another.

Differential sensing (DS) involves performing display panel sensing not in comparison to a static reference, as is done in single-ended sensing, but instead in comparison to a dynamic reference. For example, to sense an operational parameter of a test pixel of an electronic display, the test pixel may be programmed with test data. The response by the test pixel to the test data may be sensed on a sense line (e.g., a data line) that is coupled to the test pixel. The sense line of the test pixel may be sensed in comparison to a sense line coupled to a reference pixel that was not programmed with the test data. The signal sensed from the reference pixel does not include any particular operational parameters relating to the reference pixel in particular, but rather contains common-noise that may be occurring on the sense lines of both the test pixel and the reference pixel. In other words, since the test pixel and the reference signal are both subject to the same system-level noise—such as electromagnetic interference from nearby components or external interference—differentially sensing the test pixel in comparison to the reference pixel results in at least some of the common-mode noise subtracted away from the signal of the test pixel.

Difference-differential sensing (DDS) involves differentially sensing two differentially sensed signals to mitigate the effects of remaining differential common-mode noise. Thus, a differential test signal may be obtained by differentially sensing a test pixel that has been programmed with test data and a reference pixel that has not been programmed with test data, and a differential reference signal may be obtained by differentially sensing two other reference pixels that have not been programmed with the test data. The differential test signal may be differentially compared to the differential reference signal, which further removes differential common-mode noise.

Correlated double sampling (CDS) and correlated-correlated double sampling (CDS-CDS) involve performing display panel sensing at least two different times and digitally comparing the signals to remove temporal noise. At one time, a test sample may be obtained by performing display panel sensing on a test pixel that has been programmed with test data. At another time, a reference sample may be obtained by performing display panel sensing on the same test pixel but without programming the test pixel with test data. Any suitable display panel sensing technique may be performed, such as differential sensing or difference-differential sensing, or even single-ended sensing. There may be temporal noise that is common to both of the samples. As such, the reference sample may be subtracted out of the test sample to remove temporal noise.

Programmable integration capacitance may further reduce the impact of display panel noise. In particular, different sense lines that are connected to a particular sense amplifier may have different capacitances. These capacitances may be relatively large. To cause the sense amplifier to sense signals on these sense lines as if the sense line capacitances were equal, the integration capacitors may be programmed to have the same ratio as the ratio of capacitances on the sense lines. This may account for noise due to sense line capacitance mismatch.

However, using the above-described techniques may increase sensing error over time due to sensing error introduced during processing of sensed data. For example, a sensing error similar to a compounded sensing error may arise after processing of a sensed data set that includes respective sensing error of sensed data that have a same polarity. For example, error magnitudes with same polarity may interact during processing operations, such as filtering operations (e.g., low pass filtering), and cause an increase in sensing error of the sensed data set. Sensing error introduced into the sensed data set during the processing operations may offset some of the noise reduction effects that result from using the sensing techniques (e.g., differential sensing (DS), difference-differential sensing (DDS), correlated double sampling (CDS), correlated-correlated double sampling (CDS-CDS), programmable capacitor matching), and thus be less effective or efficient methods of sensing. Thus, the sensing error that remains after the processing operations may degrade or reduce compensation accuracy or effectiveness over time of differential sensing operations, which may lead to visual artifacts appearing on the display.

When differentially sensing, a sensing signal pair (e.g., a test signal and a reference signal) may be used to determine a final sensing value without a common mode noise (e.g., noise common to both the test signal and the reference signal). The sensing signals of respective sensing signal pairs couple to respective sensing regions that include one or more pixels. The effective positioning of the sensing regions sensed via the sensing signal pair relative to positions of other sensing regions and other sensing signal pairs may be leverage to reduce sensing error that may arise during processing operations, such as to a lower relative error amount and/or to zero.

Figure 2:
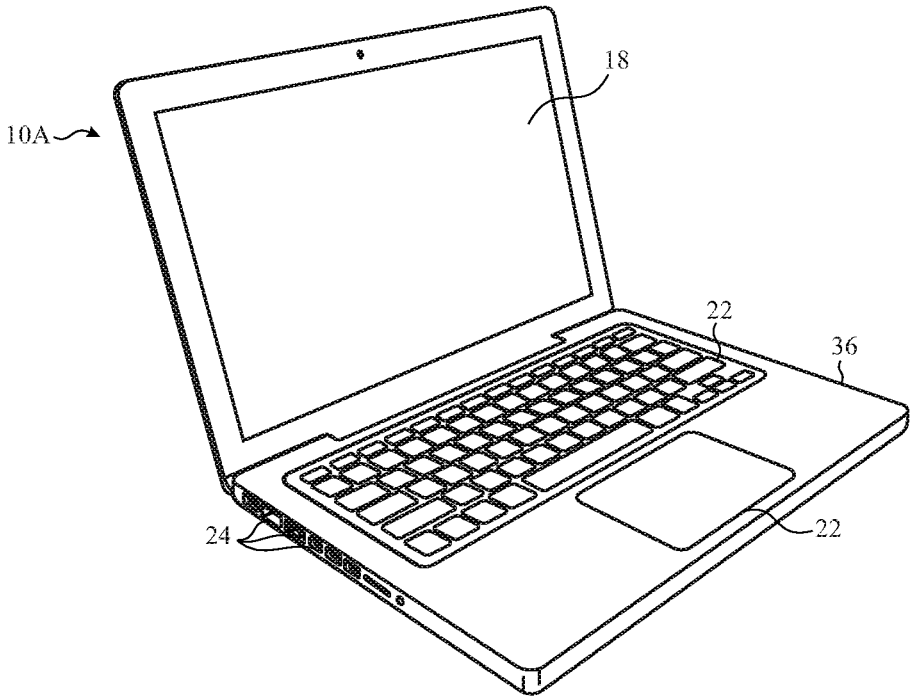
FIG. 2 is a perspective view of a notebook computer representing an embodiment of the electronic device of FIG. 1.
Figure 3:
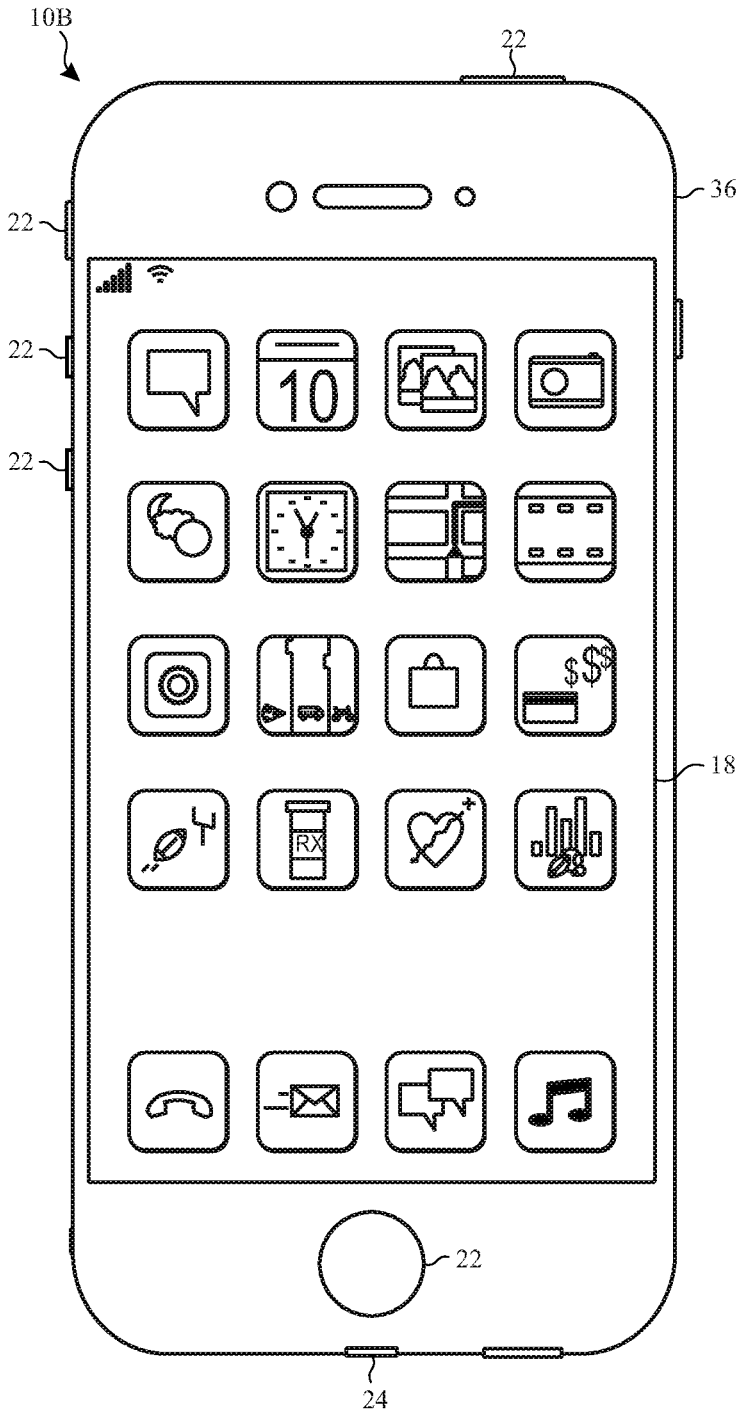
FIG. 3 is a front view of a hand-held device representing another embodiment of the electronic device of FIG. 1.
Figure 4:
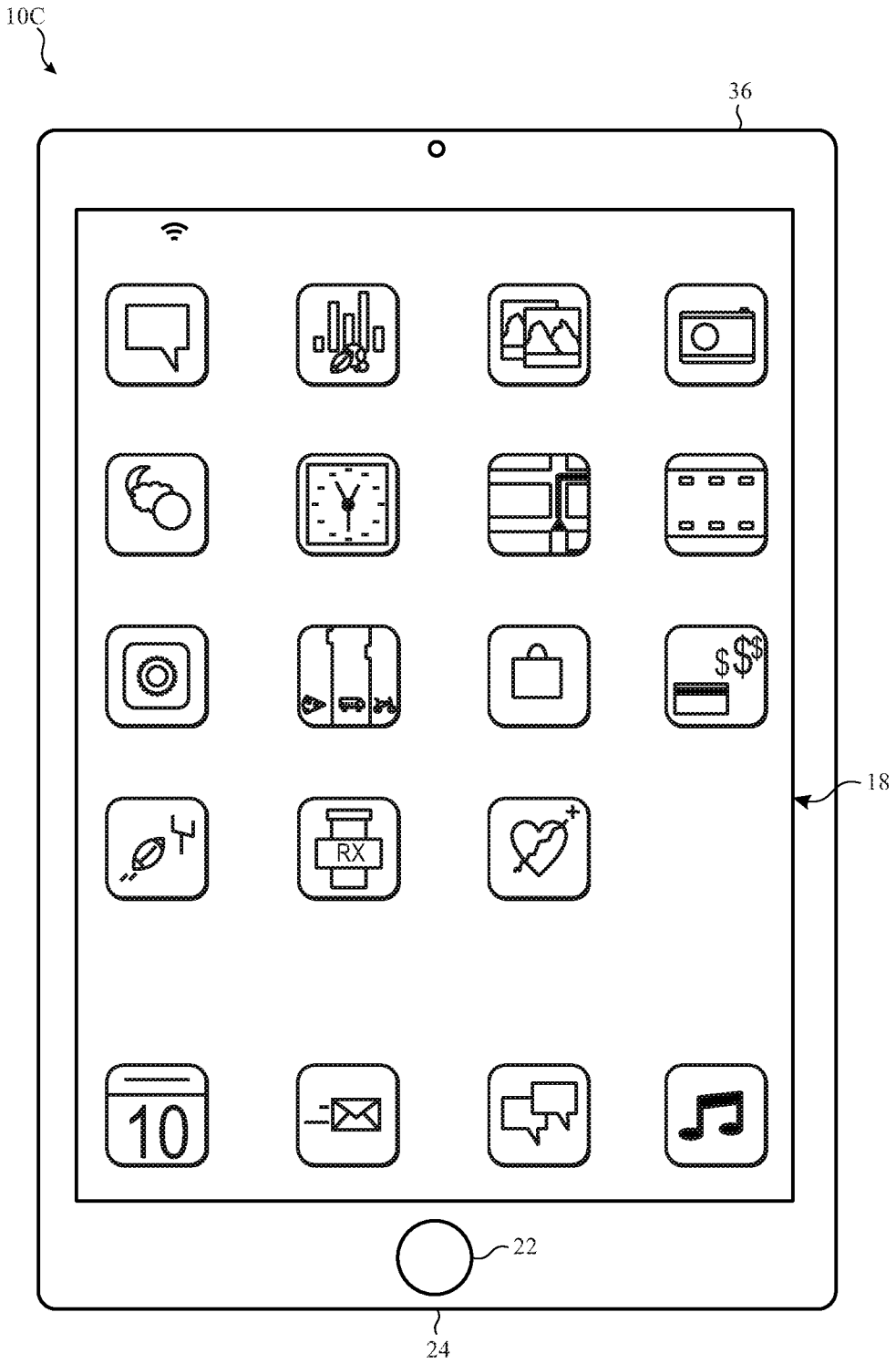
FIG. 4 is a front view of another hand-held device representing another embodiment of the electronic device of FIG. 1.
Figure 5:
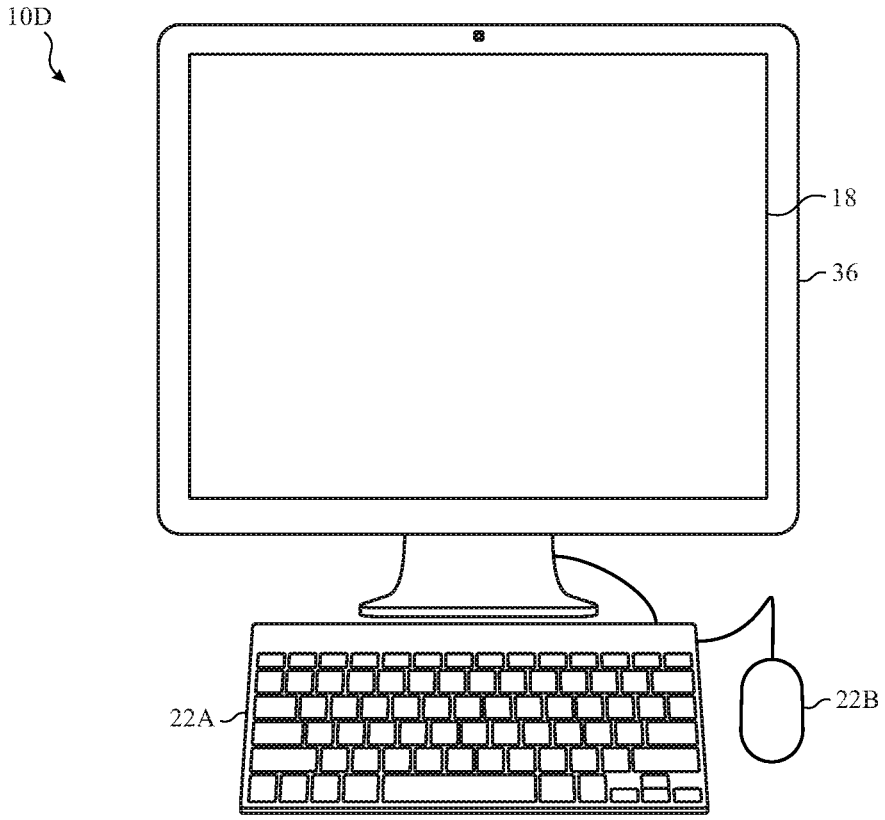
FIG. 5 is a front view of a desktop computer representing another embodiment of the electronic device of FIG. 1.
Figure 6:
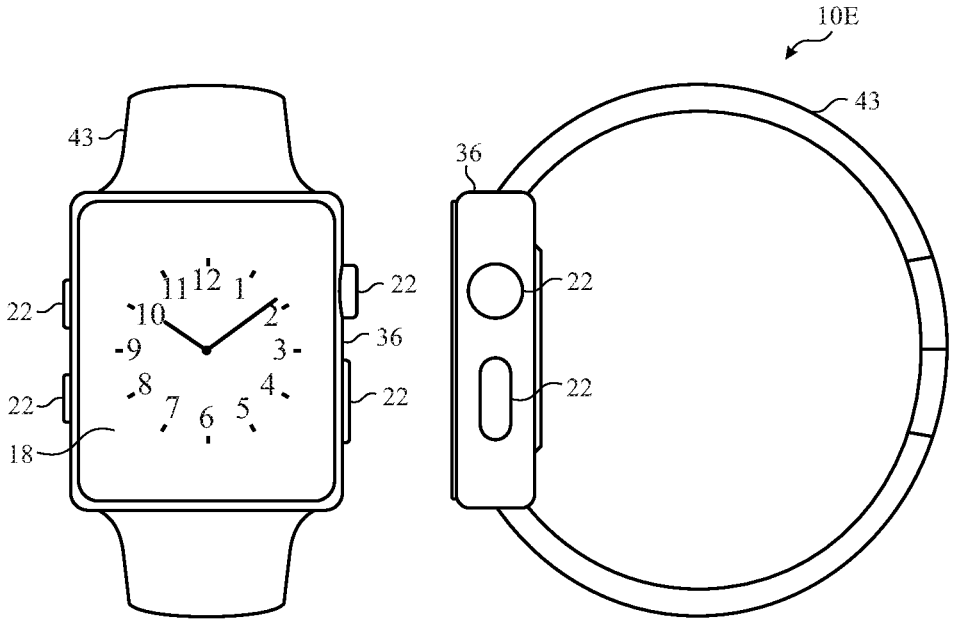
FIG. 6 is a front view and side view of a wearable electronic device representing another embodiment of the electronic device of FIG. 1.

With this in mind, a block diagram of an electronic device 10 is shown in FIG. 1 that may perform differential sensing (DS), difference-differential sensing (DDS), correlated double sampling (CDS), correlated-correlated double sampling (CDS-CDS), may employ programmable capacitor matching, and/or may drive sensing operations with consideration to relative effective or varied positioning to reduce display panel sensing noise. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or a similar device.

The electronic device 10 shown in FIG. 1 may include, for example, a processor core complex 12, a local memory 14, a main memory storage device 16, an electronic display 18, input structures 22, an input/output (I/O) interface 24, network interfaces 26, and a power source 28. The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as causing the electronic display 18 to perform display panel sensing and using the feedback to adjust image data for display on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diodes (OLED) display, or may be a liquid crystal display (LCD) illuminated by a backlight. In some embodiments, the electronic display 18 may include a touch screen, which may permit users to interact with a user interface of the electronic device 10. The electronic display 18 may employ display panel sensing to identify operational variations of the electronic display 18. This may permit the processor core complex 12 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. of Cupertino, Calif. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may permit a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hard wired connection for charging and/or content manipulation using a standard connector and protocol, such as the Lightning connector provided by Apple Inc. of Cupertino, Calif., a universal service bus (USB), or other similar connector and protocol.

User input structures 22, in combination with the electronic display 18, may permit a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. of Cupertino, Calif. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as the keyboard 22A or mouse 22B (e.g., input structures 22), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display (e.g., LCD, OLED display, active-matrix organic light emitting diode (AMOLED) display, and so forth), as well as input structures 22, which may permit users to interact with a user interface of the wearable electronic device 10E.

Figure 7:
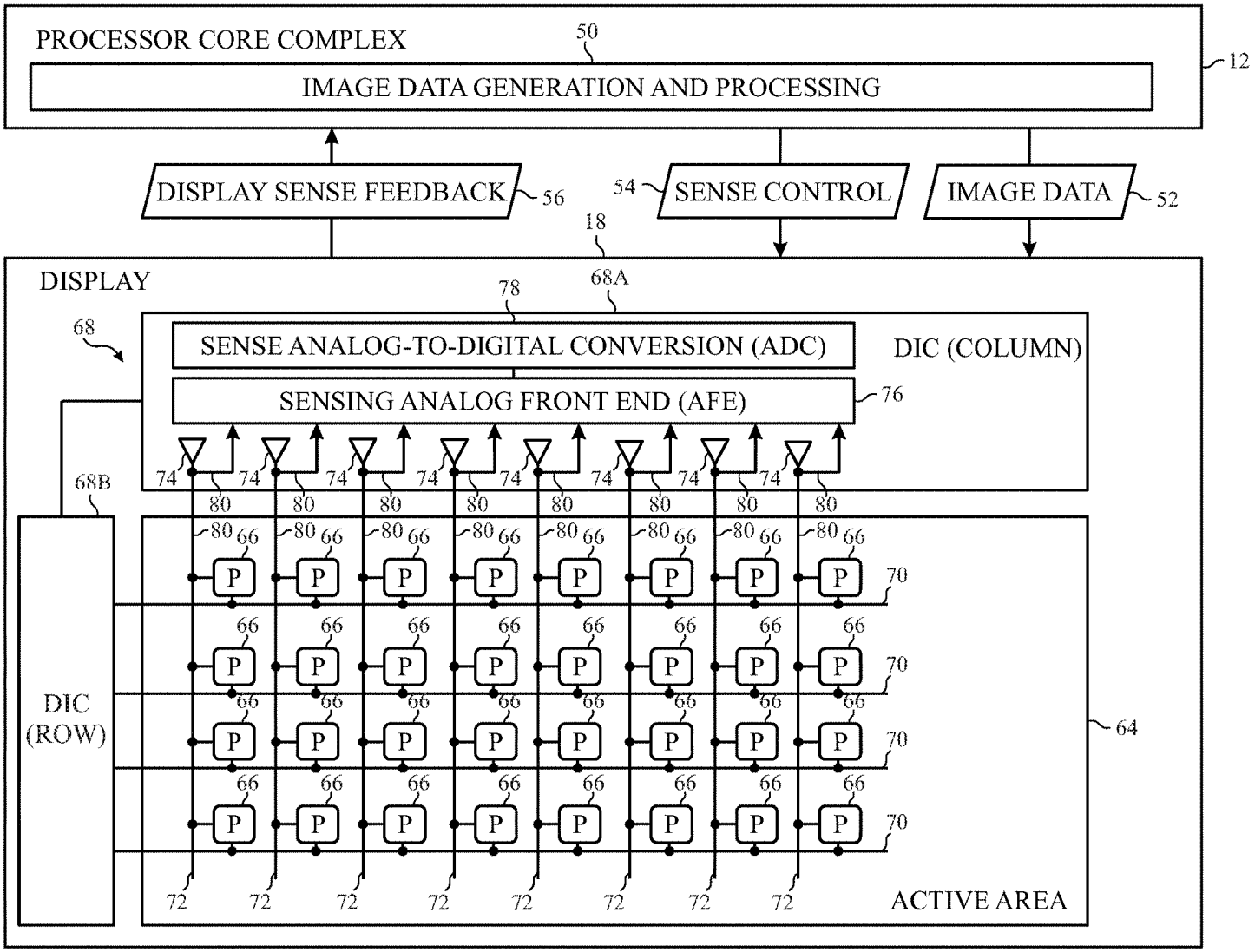
FIG. 7 is a block diagram of an electronic display that performs display panel sensing, in accordance with an embodiment.

As shown in FIG. 7, in the various embodiments of the electronic device 10, the processor core complex 12 may perform image data generation and processing 50 to generate image data 52 for display by the electronic display 18. The image data generation and processing 50 of the processor core complex 12 is meant to represent the various circuitry and processing that may be employed by the processor core complex 12 to generate the image data 52 and control the electronic display 18. Since this may include compensating the image data 52 based on operational variations of the electronic display 18, the processor core complex 12 may provide sense control signals 54 to cause the electronic display 18 to perform display panel sensing to generate display sense feedback 56. The display sense feedback 56 represents digital information relating to the operational variations of the electronic display 18. The display sense feedback 56 may take any suitable form, and may be converted by the image data generation and processing 50 into a compensation value that, when applied to the image data 52, appropriately compensates the image data 52 for the conditions of the electronic display 18. This results in greater fidelity of the image data 52, reducing or eliminating visual artifacts that would otherwise occur due to the operational variations of the electronic display 18.

The electronic display 18 includes an active area 64 with an array of pixels 66. The pixels 66 are schematically shown distributed substantially equally apart and of the same size, but in an actual implementation, pixels of different colors may have different spatial relationships to one another and may have different sizes. In one example, the pixels 66 may take a red-green-blue (RGB) format with red, green, and blue pixels, and in another example, the pixels 66 may take a red-green-blue-green (RGBG) format in a diamond pattern. The pixels 66 are controlled by a driver integrated circuit 68, which may be a single module or may be made up of separate modules, such as a column driver integrated circuit 68A and a row driver integrated circuit 68B. The driver integrated circuit 68 may send signals across gate lines 70 to cause a row of pixels 66 to become activated and programmable, at which point the driver integrated circuit 68 (e.g., 68A) may transmit image data signals across data lines 72 to program the pixels 66 to display a particular gray level. By supplying different pixels 66 of different colors with image data to display different gray levels or different brightness, full-color images may be programmed into the pixels 66. The image data may be driven to an active row of pixel 66 via source drivers 74, which are also sometimes referred to as column drivers. The driver integrated circuit 68 may be apart or incorporated into the display panel (e.g., Display On Silicon or dedicated driving silicon).

As mentioned above, the pixels 66 may be arranged in any suitable layout with the pixels 66 having various colors and/or shapes. For example, the pixels 66 may appear in alternating red, green, and blue in some embodiments, but also may take other arrangements. The other arrangements may include, for example, a red-green-blue-white (RGBW) layout or a diamond pattern layout in which one column of pixels alternates between red and blue and an adjacent column of pixels are green. Regardless of the particular arrangement and layout of the pixels 66, each pixel 66 may be sensitive to changes on the active area of 64 of the electronic display 18, such as variations and temperature of the active area 64, as well as the overall age of the pixel 66. Indeed, when each pixel 66 is a light emitting diode (LED), it may gradually emit less light over time. This effect is referred to as aging, and takes place over a slower time period than the effect of temperature on the pixel 66 of the electronic display 18.

Display panel sensing may be used to obtain the display sense feedback 56, which may enable the processor core complex 12 to generate compensated image data 52 to negate the effects of temperature, aging, and other variations of the active area 64. The driver integrated circuit 68 (e.g., 68A) may include a sensing analog front end (AFE) 76 to perform analog sensing of the response of pixels 66 to test data. The analog signal may be digitized by sensing analog-to-digital conversion (ADC) circuitry 78.

For example, to perform display panel sensing, the electronic display 18 may program one of the pixels 66 with test data. The sensing analog front end 76 then senses a sense line 80 of connected to the pixel 66 that is being tested. Here, the data lines 72 are shown to act as the sense lines 80 of the electronic display 18. In other embodiments, however, the active area 64 may include other dedicated sense lines 80 or other lines of the display may be used as sense lines 80 instead of the data lines 72. Other pixels 66 that have not been programmed with test data may be sensed at the same time a pixel that has been programmed with test data. Indeed, as will be discussed below, by sensing a reference signal on a sense line 80 when a pixel on that sense line 80 has not been programmed with test data, a common-mode noise reference value may be obtained. This reference signal may be removed from the signal from the test pixel that has been programmed with test data to reduce or eliminate common mode noise.

The analog signal may be digitized by the sensing analog-to-digital conversion circuitry 78. The sensing analog front end 76 and the sensing analog-to-digital conversion circuitry 78 may operate, in effect, as a single unit. The driver integrated circuit 68 (e.g., 68A) may also perform additional digital operations to generate the display sense feedback 56, such as digital filtering, adding, or subtracting, to generate the display sense feedback 56, or such processing may be performed by the processor core complex 12.

Figure 8:
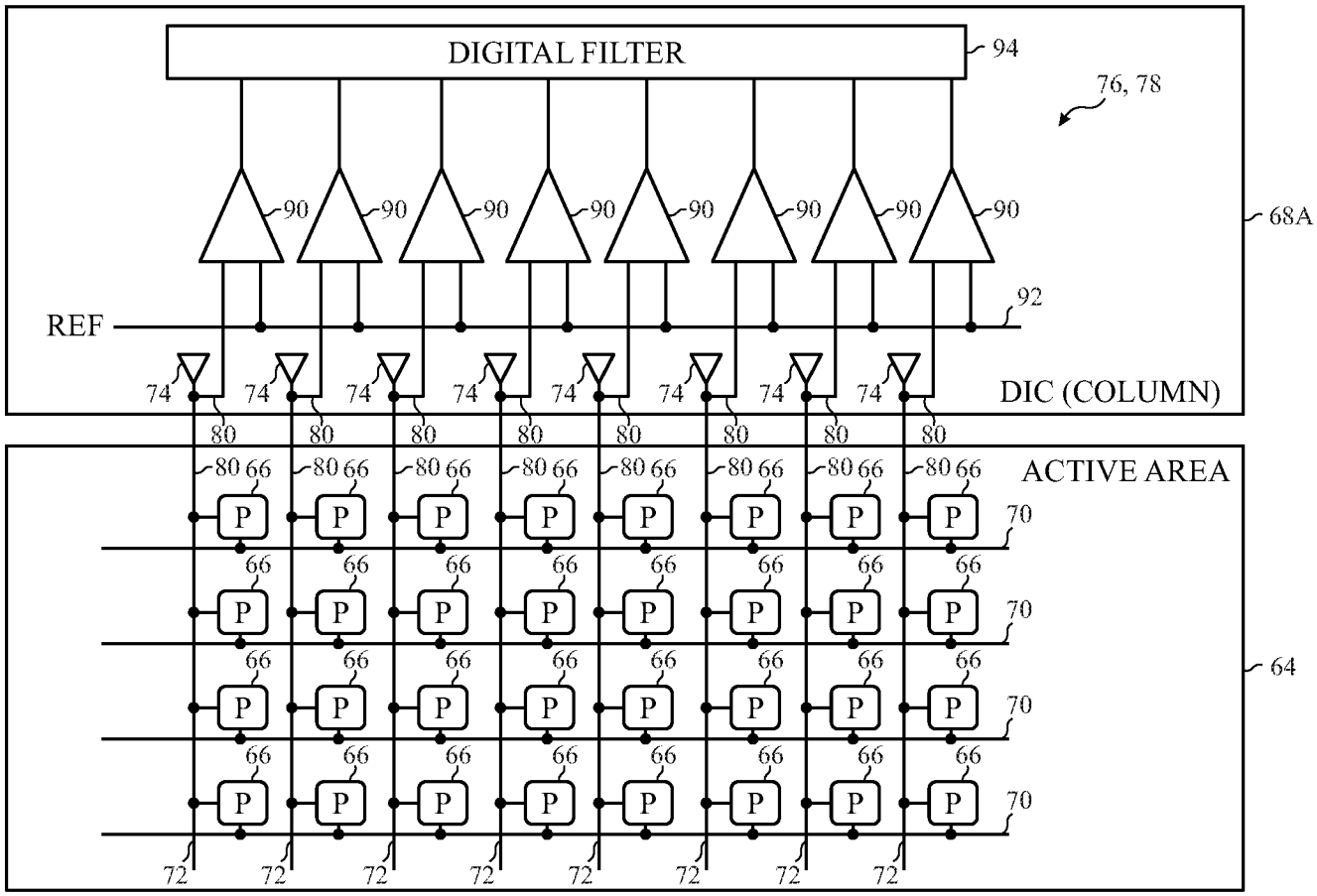
FIG. 8 is a block diagram of single-ended sensing used in combination with a digital filter, in accordance with an embodiment.

FIG. 8 illustrates a single-ended approach to display panel sensing. Namely, the sensing analog front end 76 and the sensing analog-to-digital conversion circuitry 78 may be represented schematically by sense amplifiers 90 that differentially sense a signal from the sense lines 80 (here, the data lines 72) in comparison to a static reference signal 92 and output a digital value. It should be appreciated that, in FIG. 8 as well as other figures of this disclosure, the sense amplifiers 90 are intended to represent both analog amplification circuitry and/or the sense analog-to-digital conversion (ADC) circuitry 78. Whether the sense amplifiers 90 represent analog or digital circuitry, or both, may be understood through the context of other circuitry in each figure. A digital filter 94 may be used to digitally process the resulting digital signals obtained by the sense amplifiers 90. Each sense amplifier 90 may output sensed data obtained to sense an electrical value (e.g., voltage, current) of a sensing region (e.g., a pixel, a group of pixels, a region of the active area 64).

Figure 9:
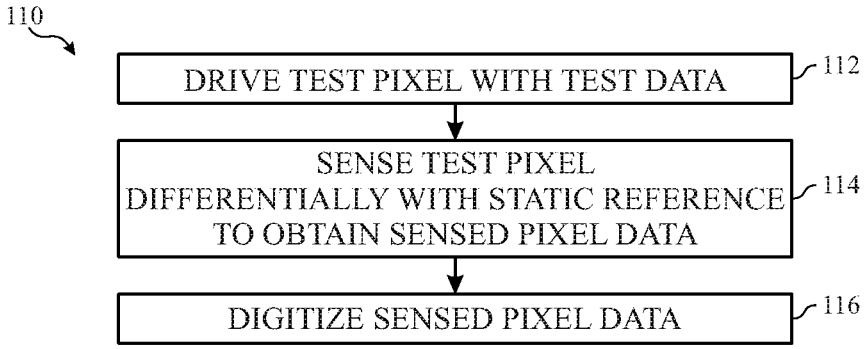
FIG. 9 is a flowchart of a method performing single-ended sensing, in accordance with an embodiment.

The single-ended display panel sensing shown in FIG. 8 may generally follow a process 110 shown in FIG. 9. Namely, a pixel 66 may be driven with test data (referred to as a "test pixel") (block 112). Any suitable pixel 66 may be selected to be driven with the test data. In one example, all of the pixels 66 of a particular row are activated and driven with test pixel data. After the test pixel has been driven with the test data, the sense amplifiers 90 (e.g., differential amplifiers) may sense the test pixels differentially in comparison to the static reference signal 92 to obtain sensed test signal data (block 114). The sensed test pixel data may be digitized (block 116) to be filtered by the digital filter 94 or for analysis by the processor core complex 12.

Figure 10:
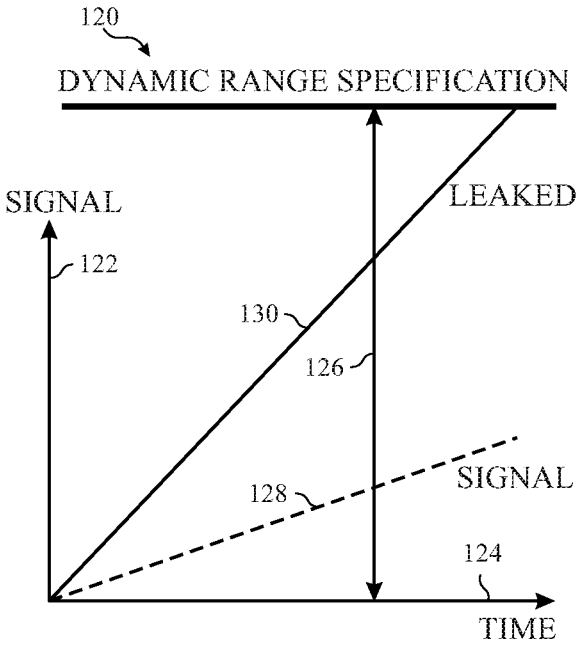
FIG. 10 is a plot illustrating a relationship between signal and noise over time using single-ended sensing, in accordance with an embodiment.

Although the single-ended approach of FIG. 8 may operate to efficiently obtain sensed test pixel data, the sense lines 80 of the active area 64 (e.g., the data lines 72) may be susceptible to noise from the other components of the electronic device 10 or other electrical signals in the vicinity of the electronic device 10, such as radio signals, electromagnetic interference from data processing, and so forth. This may increase an amount of noise in the sensed signal, which may make it difficult to amplify the sensed signal within a specified dynamic range. An example is shown by a plot 120 of FIG. 10. The plot 120 compares the detected signal of the sensed pixel data (ordinate 122) over the sensing time (abscissa 124). Here, a dynamic range specification 126 is dominated not by a desired test pixel signal 128, but rather by leakage noise 130. To cancel out some of the leakage noise 130, and therefore improve the signal-to-noise ratio, an approach other than, or in addition to, a single-ended sensing approach may be used.

Differential Sensing (DS)

Figure 11:
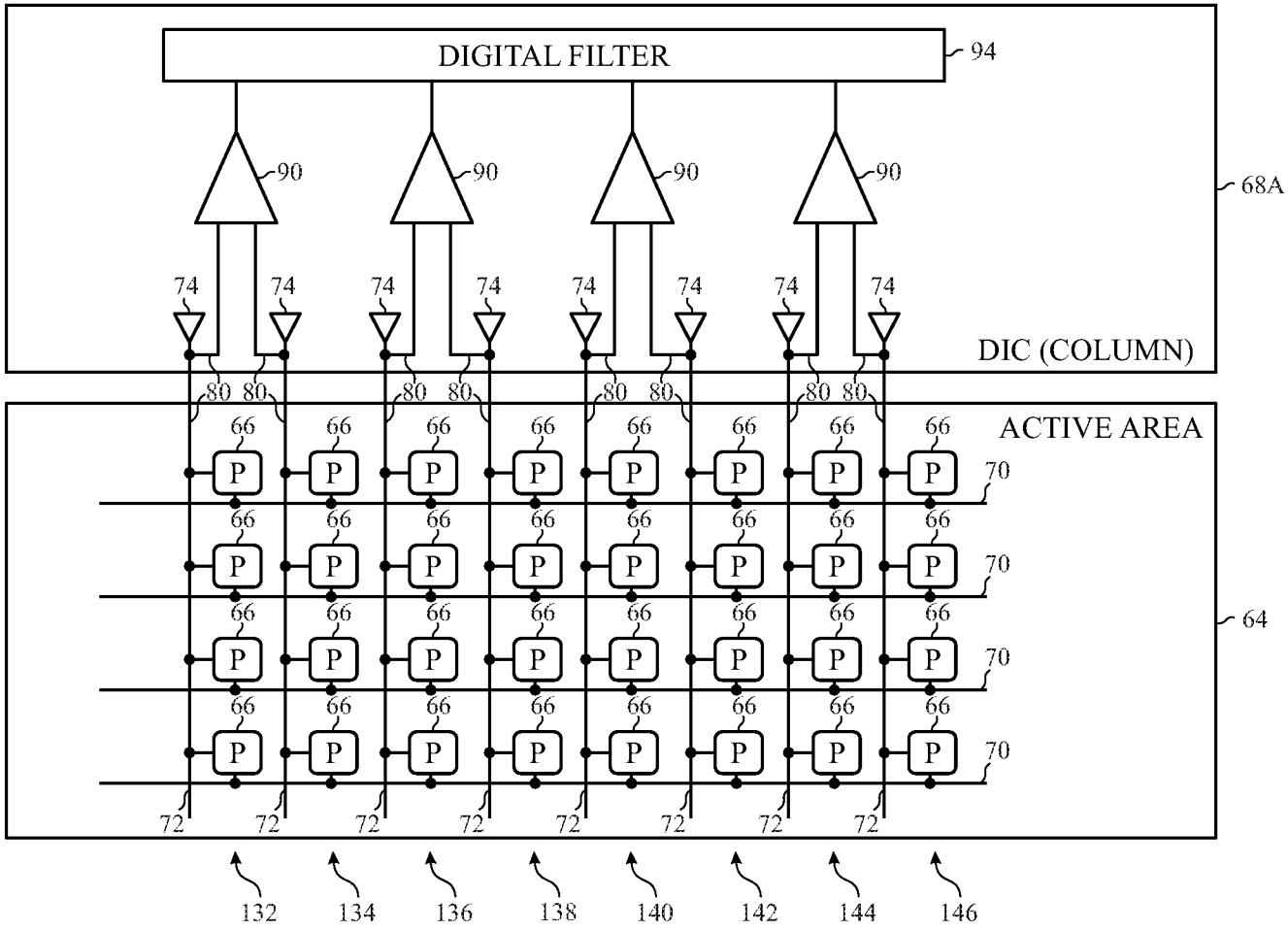
FIG. 11 is a block diagram of differential sensing, in accordance with an embodiment.

Differential sensing involves sensing a test pixel that has been driven with test data in comparison to a reference pixel that has not been applied with test data. By doing so, common-mode noise that is present on the sense lines 80 of both the test pixel and the reference pixel may be excluded. FIGS. 11-15 describe a few differential sensing approaches that may be used by the electronic display 18. In FIG. 11, the electronic display 18 includes sense amplifiers 90 that are connected to differentially sense two sense lines 80. In the example shown in FIG. 11, columns 132 and 134 may be differentially sensed in relation to one another, columns 136 and 138 may be differentially sensed in relation to one another, columns 140 and 142 may be differentially sensed in relation to one another, and columns 144 and 146 may be differentially sensed in relation to one another.

Figure 12:
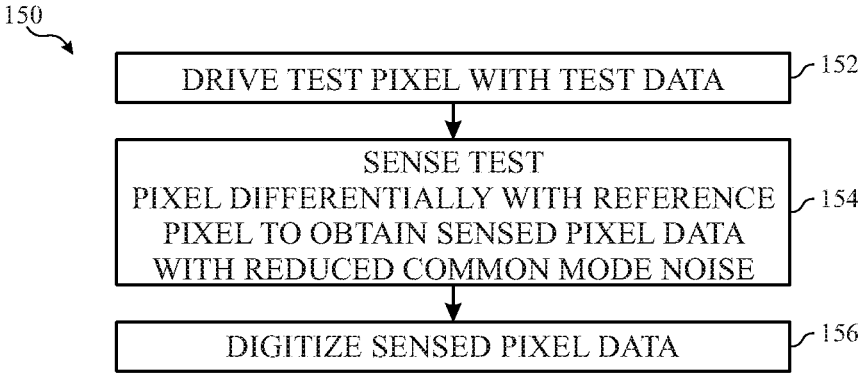
FIG. 12 is a flowchart of a method for performing differential sensing, in accordance with an embodiment.
Figure 13:
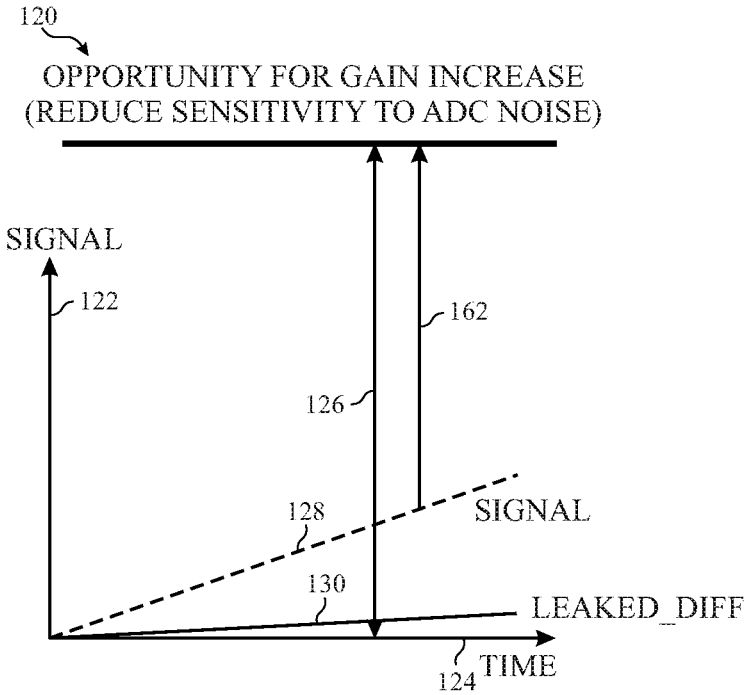
FIG. 13 is a plot of the relationship between signal and noise using differential sensing, in accordance with an embodiment.

As shown by a process 150 of FIG. 12, differential sensing may involve driving a test pixel 66 with test data (block 152). The test pixel 66 may be sensed differentially in relation to a reference pixel or reference sense line 80 that was not driven with test data (block 154). For example, a test pixel 66 may be the first pixel 66 in the first column 132, and the reference pixel 66 may be the first pixel 66 of the second column 134. By sensing the test pixel 66 in this way, the sense amplifier 90 may obtain test pixel 66 data with reduced common-mode noise. The sensed test pixel 66 data may be digitized (block 156) for further filtering or processing.

As a result, the signal-to-noise ratio of the sensed test pixel 66 data may be substantially better using the differential sensing approach than using a single-ended approach. Indeed, this is shown in a plot 160 of FIG. 13, which compares a test signal value (ordinate 122) in comparison to a sensing time (abscissa 124). In the plot 160, even with the same dynamic range specification 126 as shown in the plot 120 of FIG. 10, the desired test pixel signal 128 may be much higher than the leakage noise 130. This is because the common-mode noise that is common to the sense lines 80 of both the test pixel 66 and the reference pixel 66 may be subtracted when the sense amplifier 90 compares the test signal to the reference signal. This also provides an opportunity to increase the gain of the test pixel signal 128 by providing additional headroom 162 between the desired test pixel signal 128 and the dynamic range specification 126.

Figure 14:
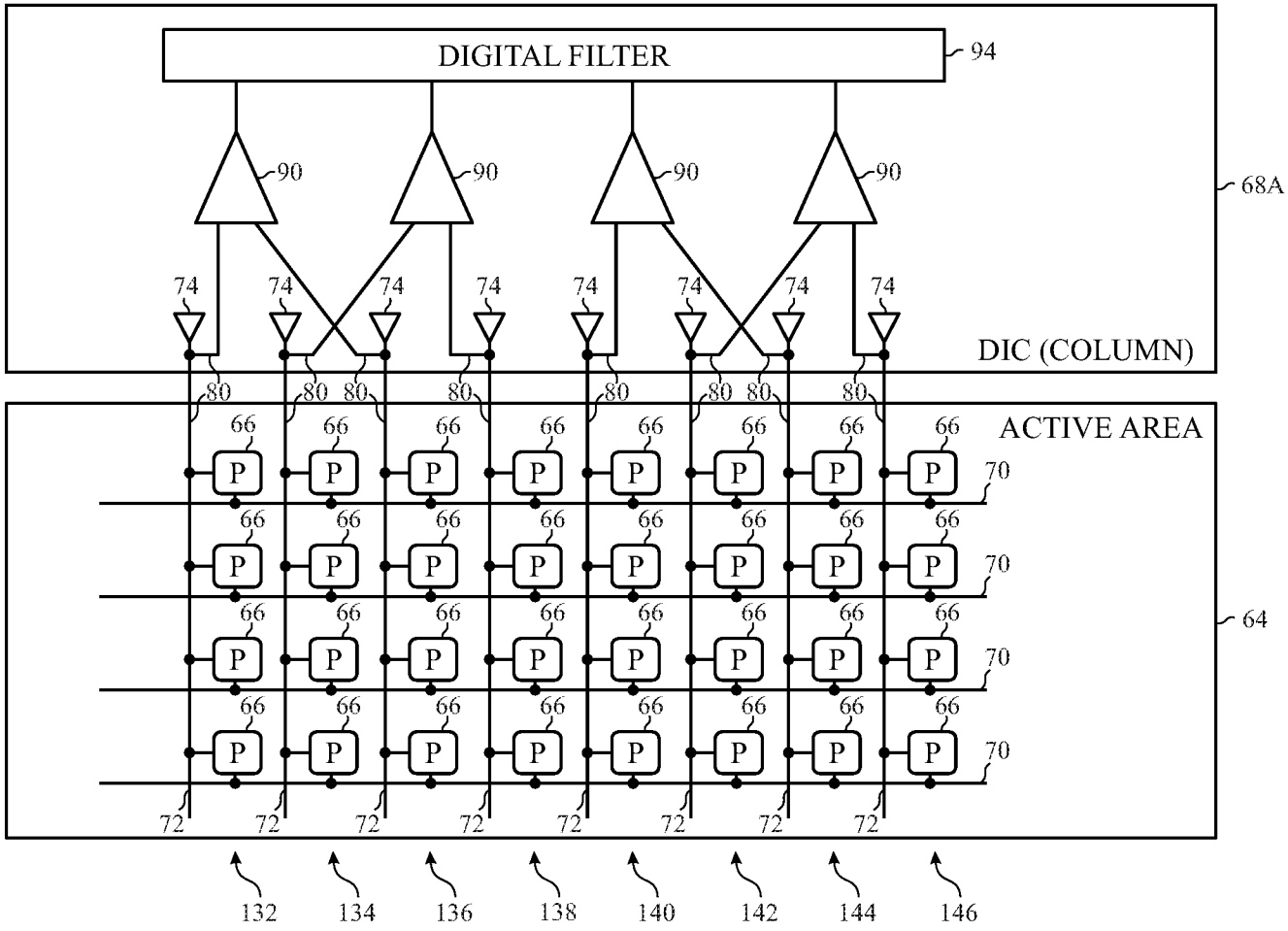
FIG. 14 is a block diagram of differential sensing of non-adjacent columns of pixels, in accordance with an embodiment.
Figure 15:
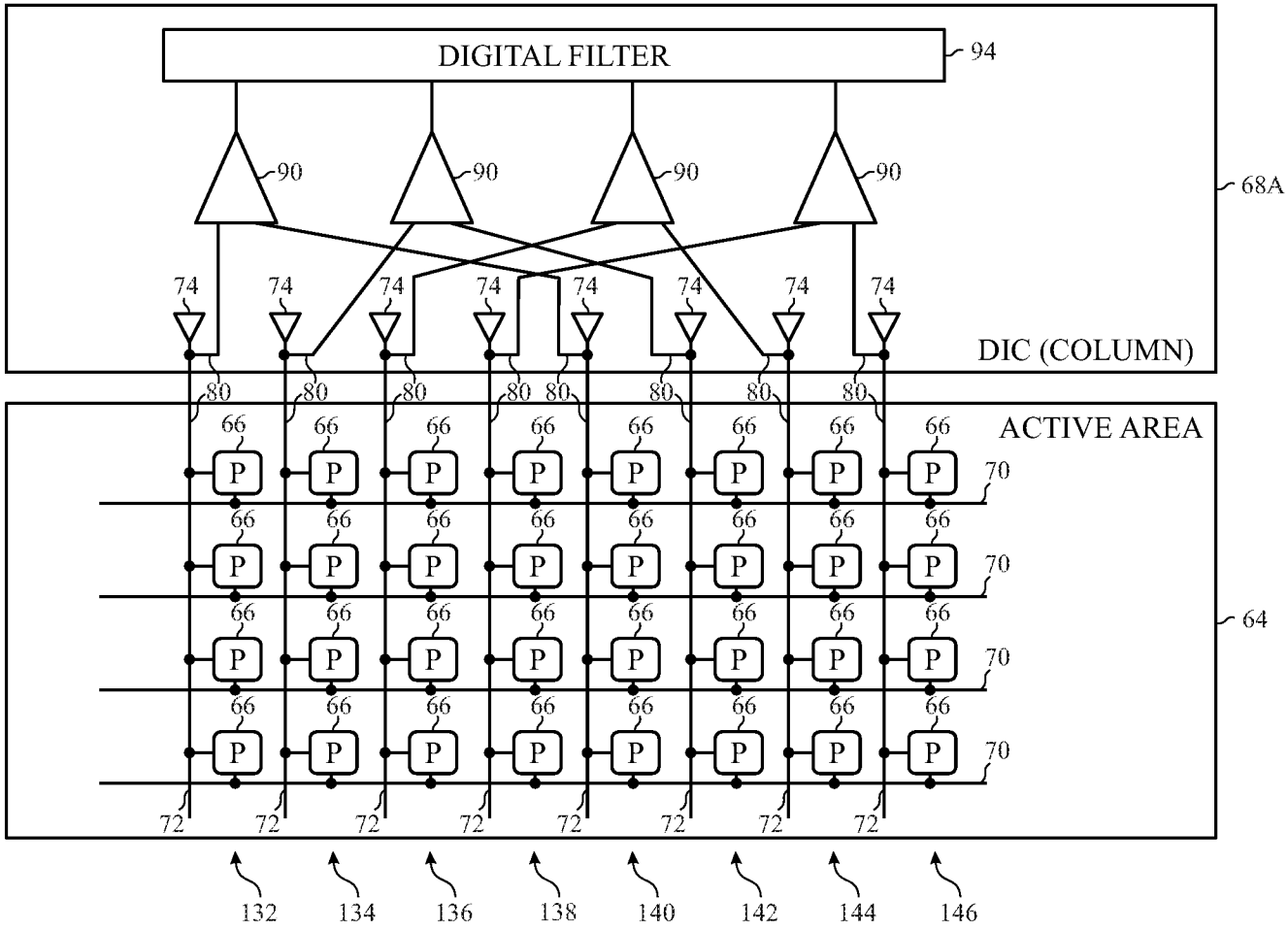
FIG. 15 is a block diagram of another example of differential sensing of other non-adjacent columns of pixels, in accordance with an embodiment.

Differential sensing may take place by comparing a test pixel 66 from one column with a reference pixel 66 from any other suitable column. For example, as shown in FIG. 14, the sense amplifiers 90 may differentially sense pixels 66 in relation to columns with similar electrical characteristics. In this example, even columns have electrical characteristics more similar to other even columns, and odd columns have electrical characteristics more similar to other odd columns. Here, for instance, the column 132 may be differentially sensed with column 136, the column 140 may be differentially sensed with column 144, the column 134 may be differentially sensed with column 138, and column 142 may be differentially sensed with column 146. This approach may improve the signal quality when the electrical characteristics of the sense lines 80 of even columns are more similar to those of sense lines 80 of other even columns, and the electrical characteristics of the sense lines 80 of odd columns are more similar to those of sense lines 80 of other odd columns. This may be the case for an RGBG configuration, in which even columns have red or blue pixels and odd columns have green pixels and, as a result, the electrical characteristics of the even columns may differ somewhat from the electrical characteristics of the odd columns. In other examples, the sense amplifiers 90 may differentially sense test pixels 66 in comparison to reference pixels 66 from every third column or, as shown in FIG. 15, every fourth column. It should be appreciated that the configuration of FIG. 15 may be particularly useful when every fourth column is more electrically similar to one another than to other columns.

Figure 16:
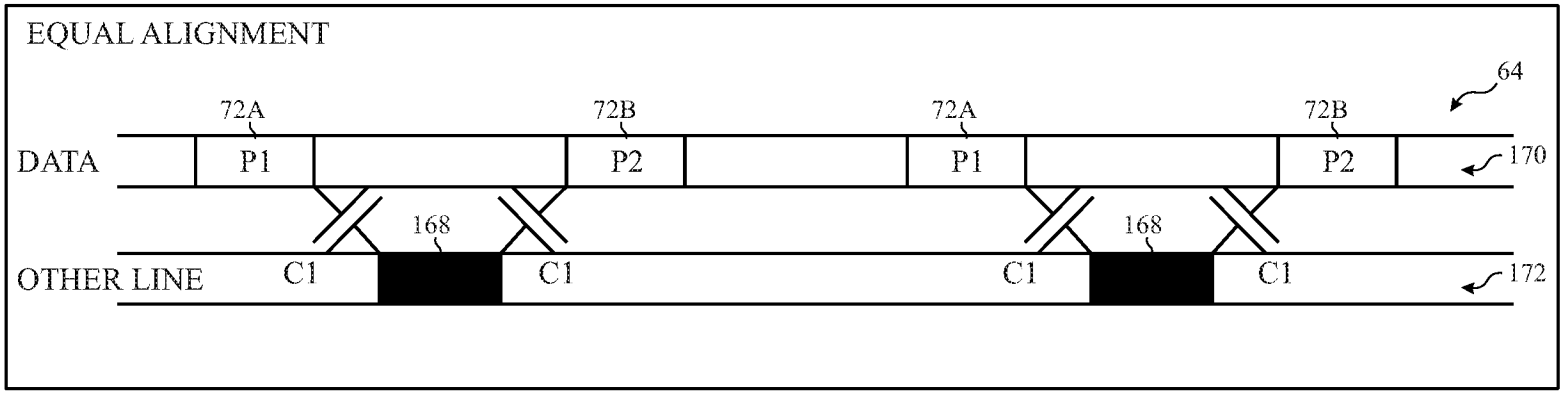
FIG. 16 is a diagram showing capacitances on data lines used as sense lines of the electronic display when the data lines are equally aligned with another conductive line of the electronic display, in accordance with an embodiment.
Figure 17:
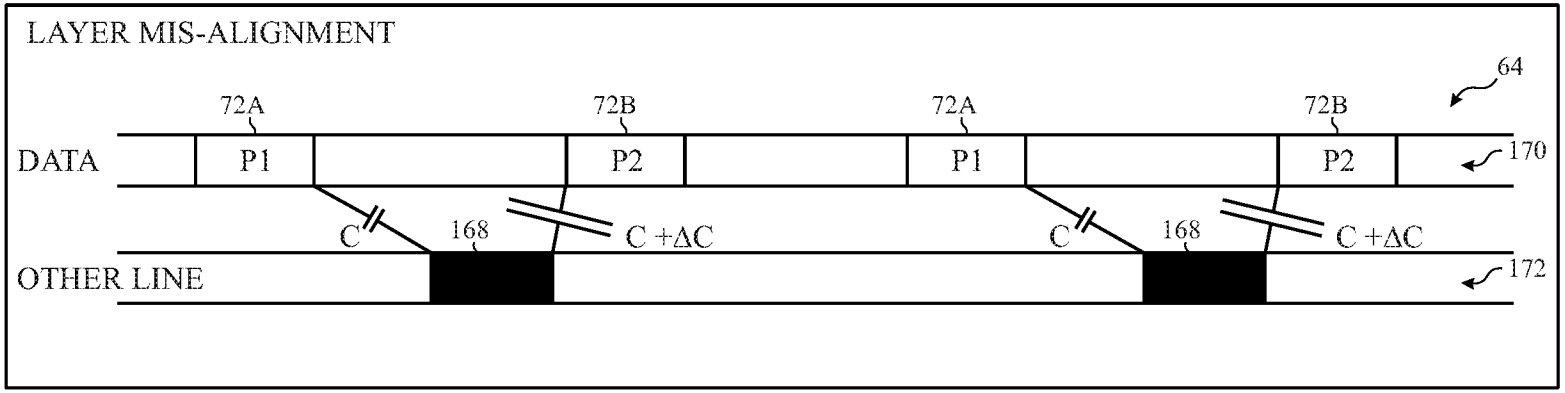
FIG. 17 shows differences in capacitance on the data lines used as sense lines when the other conductive line is misaligned between the data lines, in accordance with an embodiment.

One reason different electrical characteristics could occur on the sense lines 80 of different columns of pixels 66 is illustrated by FIGS. 16 and 17. As shown in FIG. 16, when the sense lines 80 are represented by the data lines 72, a first data line 72A and a second data line 72B (which may be associated with different colors of pixels or different pixel arrangements) may share the same capacitance $C_1$ with another conductive line 168 in the active area 64 of the electronic display 18 because the other line 168 is aligned equally between the data lines 72A and 72B. The other line 168 may be any other conductive line, such as a power supply line like a high or low voltage rail for electroluminance of the pixels 166 (e.g., VDDEL or VSSEL). Here, the data lines 72A and 72B appear in one layer 170, while the conductive line 168 appears in a different layer 172. Being in two separate layers 170 and 172, the data lines 72A and 72B may be fabricated at a different step in the manufacturing process from the conductive line 168. Thus, it is possible for the layers to be misaligned when the electronic display 18 is fabricated.

Such layer misalignment is shown in FIG. 17. In the example of FIG. 17, the conductive line 168 is shown to be farther from the first data line 72A and closer to the second data line 72B. This produces an unequal capacitance between the first data line 72A and the conductive line 168 compared to the second data line 72B and the conductive line 168. These are shown as a capacitance C on the data line 72A and a capacitance C+ΔC on the data line 72B.

Difference-Differential Sensing (DDS)

Figure 18:
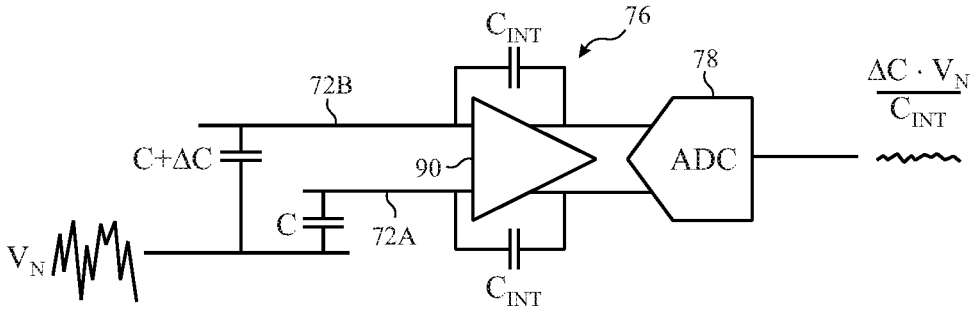
FIG. 18 is a circuit diagram illustrating the effect of different sense line capacitances on the detection of common-mode noise, in accordance with an embodiment.

The different capacitances on the data lines 72A and 72B may mean that even differential sensing may not fully remove all common-mode noise appearing on two different data lines 72 that are operating as sense lines 80, as shown in FIG. 18. Indeed, a voltage noise signal $V_n$ may appear on the conductive line 168, which may represent ground noise on the active area 64 of the electronic display 18. Although this noise would ideally be cancelled out by the sense amplifier 90 through differential sensing before the signal is digitized via the sensing analog-to-digital conversion circuitry 78, the unequal capacitance between the data lines 72A and 72B may result in differential common-mode noise. The differential common-mode noise may have a value equal to the following relationship, represented via Equation 1.

$$\frac{\Delta C \cdot Vn}{CINT} \quad [1]$$

Figure 19:
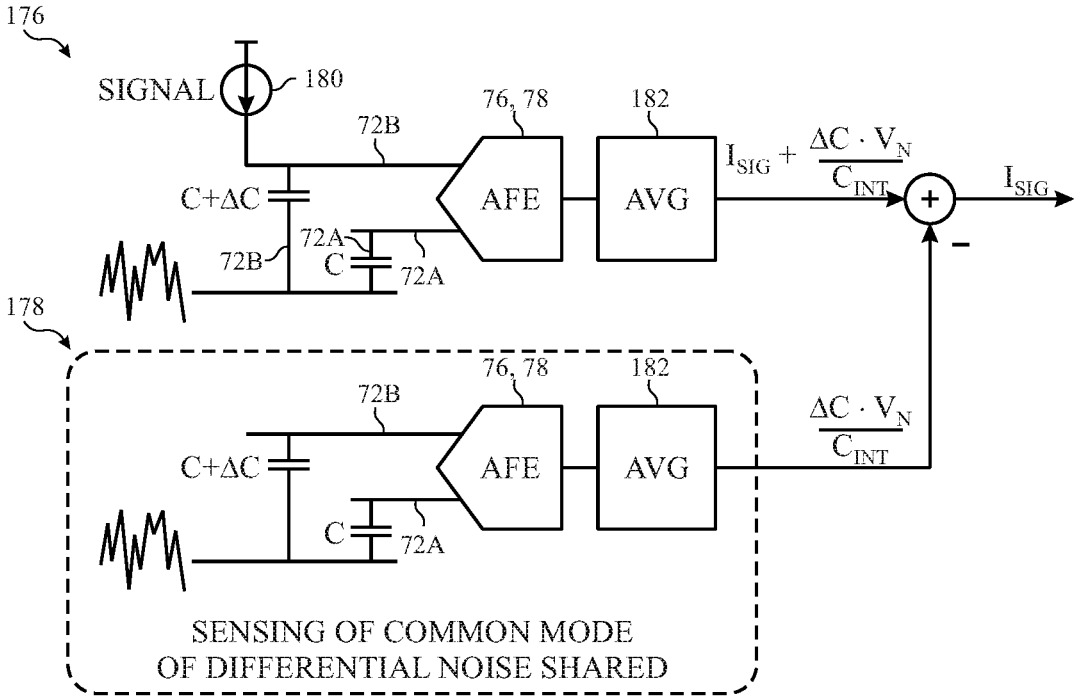
FIG. 19 is a circuit diagram employing difference-differential sensing to remove differential common-mode noise from a differential signal, in accordance with an embodiment.
Figure 20:
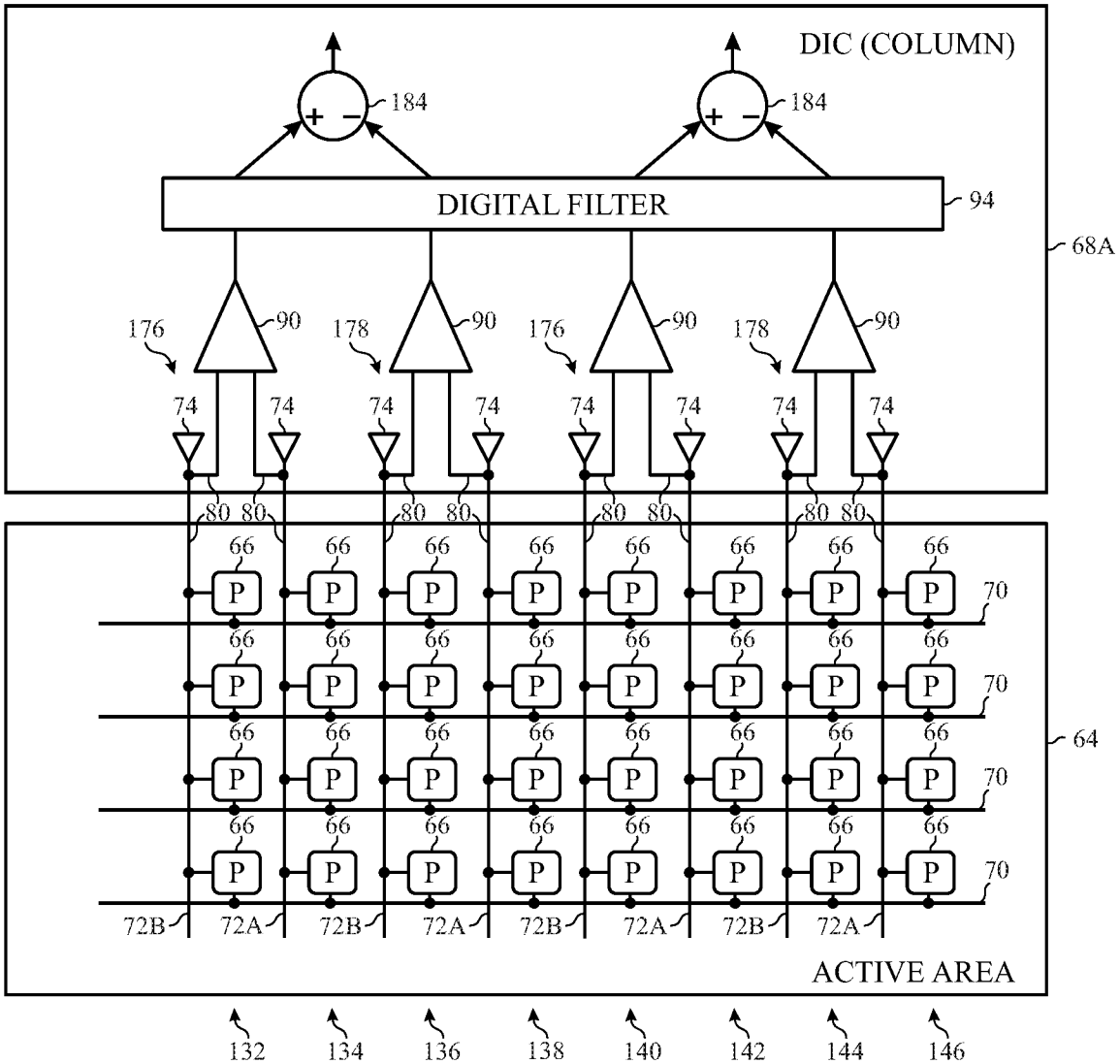
FIG. 20 is a block diagram of difference-differential sensing in the digital domain, in accordance with an embodiment.

Difference-differential sensing may mitigate the effect of differential common-mode noise that remains after differential sensing due to differences in capacitance on different data lines 72 when those data lines 72 are used as sense lines 80 for display panel sensing. FIG. 19 schematically represents a manner of performing difference-differential sensing in the digital domain by sampling a test differential pair 176 and a reference differential pair 178. As shown in FIG. 19, a test signal 180 representing a sensed signal from a test pixel 66 on the data line 72B may be sensed differentially with a reference pixel 66 on the data line 72A with the test differential pair 176. The test signal 180 may be sensed using the sensing analog front end 76 and sensing analog-to-digital conversion circuitry 78. Sensing the test differential pair 176 may filter out most of the common-mode noise, but differential common-mode noise may remain. Thus, the reference differential pair 178 may be sensed to obtain a reference signal without programming any test data on the reference differential pair 178. To remove certain high-frequency noise, the signals from the test differential pair 176 and the reference differential pair 178 may be averaged using temporal digital averaging 182 to low-pass filter the signals. The digital signal from the reference differential pair 178, acting as a reference signal, may be subtracted from the signal from the test differential pair 176 in subtraction logic 184. Doing so may remove the differential common-mode noise and improve the signal quality. An example block diagram of digital difference-differential sensing appears in FIG. 20, which represents an example of circuitry that may be used to carry out the difference-differential sensing shown in FIG. 19 in a digital manner.

Figure 21:
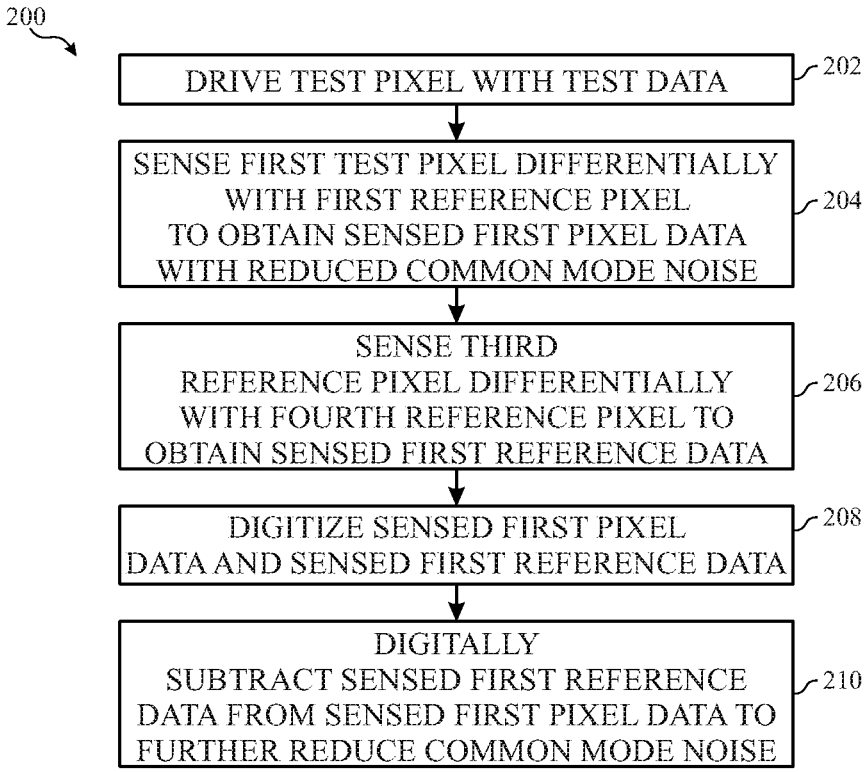
FIG. 21 is a flowchart of a method for performing difference-differential sensing, in accordance with an embodiment.

A process 200 shown in FIG. 21 describes a method for difference-differential sensing in the digital domain. Namely, a first test pixel 66 on a first data line 72 (e.g., 72A) may be programmed with test data (block 202). The first test pixel 66 may be sensed differentially with a first reference pixel on a different data line 72 (e.g., data line 72B) of a test differential pair 176 to obtain sensed first pixel data that includes reduced common-mode noise, but which still may include some differential common-mode noise (block 204). A signal representing substantially only the differential common-mode noise may be obtained by sensing a third reference pixel 66 on a third data line 72 (e.g., a second data line 72B) differentially with a fourth reference pixel 66 on a fourth data line (e.g., a second data line 72A) in a reference differential pair 178 to obtain sensed first reference data (block 206). The sensed first pixel data of block 204 and the sensed first reference data of block 206 may be digitized (block 208) and the first reference data of block 206 may be digitally subtracted from the sensed first pixel data of block 204. This may remove the differential common-mode noise from the sensed first pixel data (block 210), thereby improving the signal quality.

Figure 22:
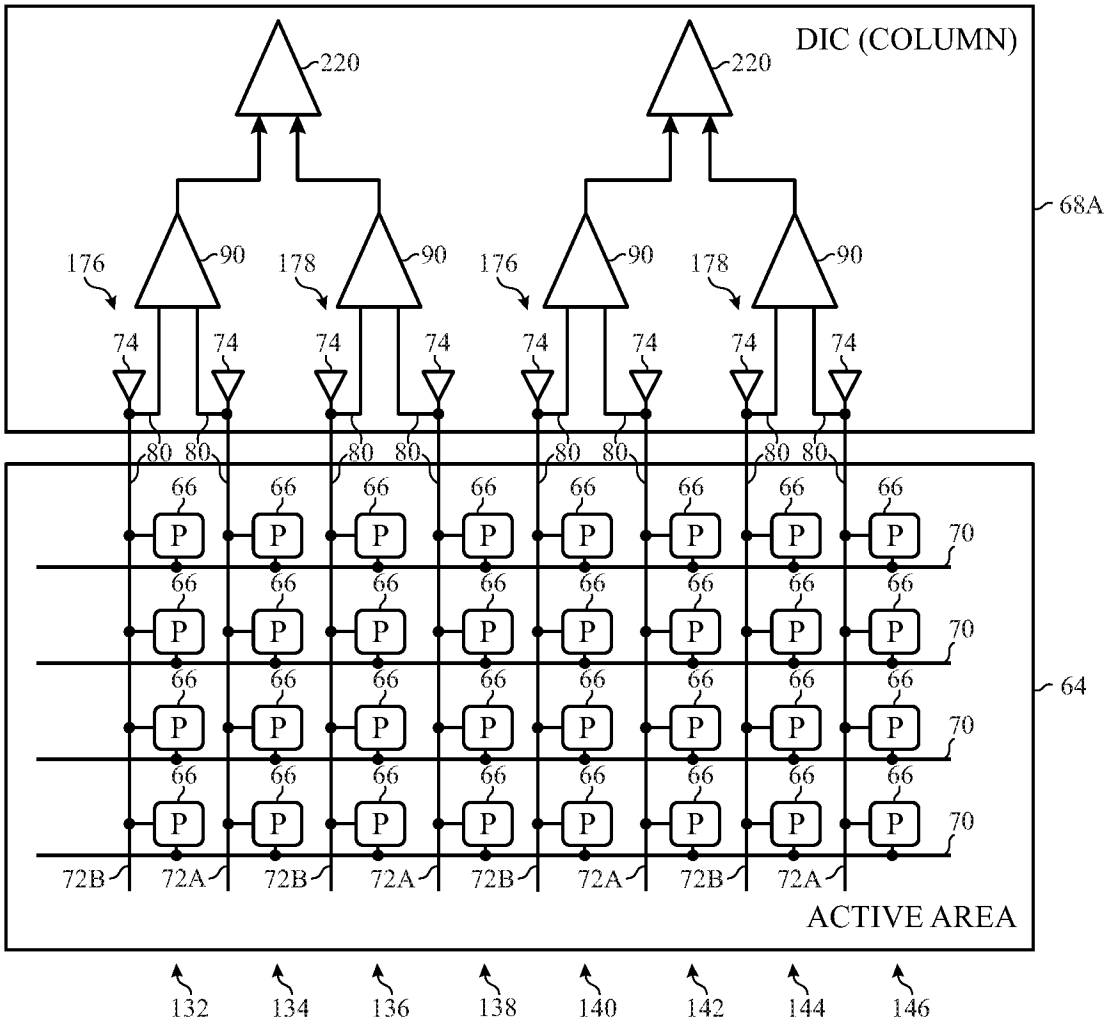
FIG. 22 is a block diagram of difference-differential sensing in the analog domain, in accordance with an embodiment.
Figure 23:
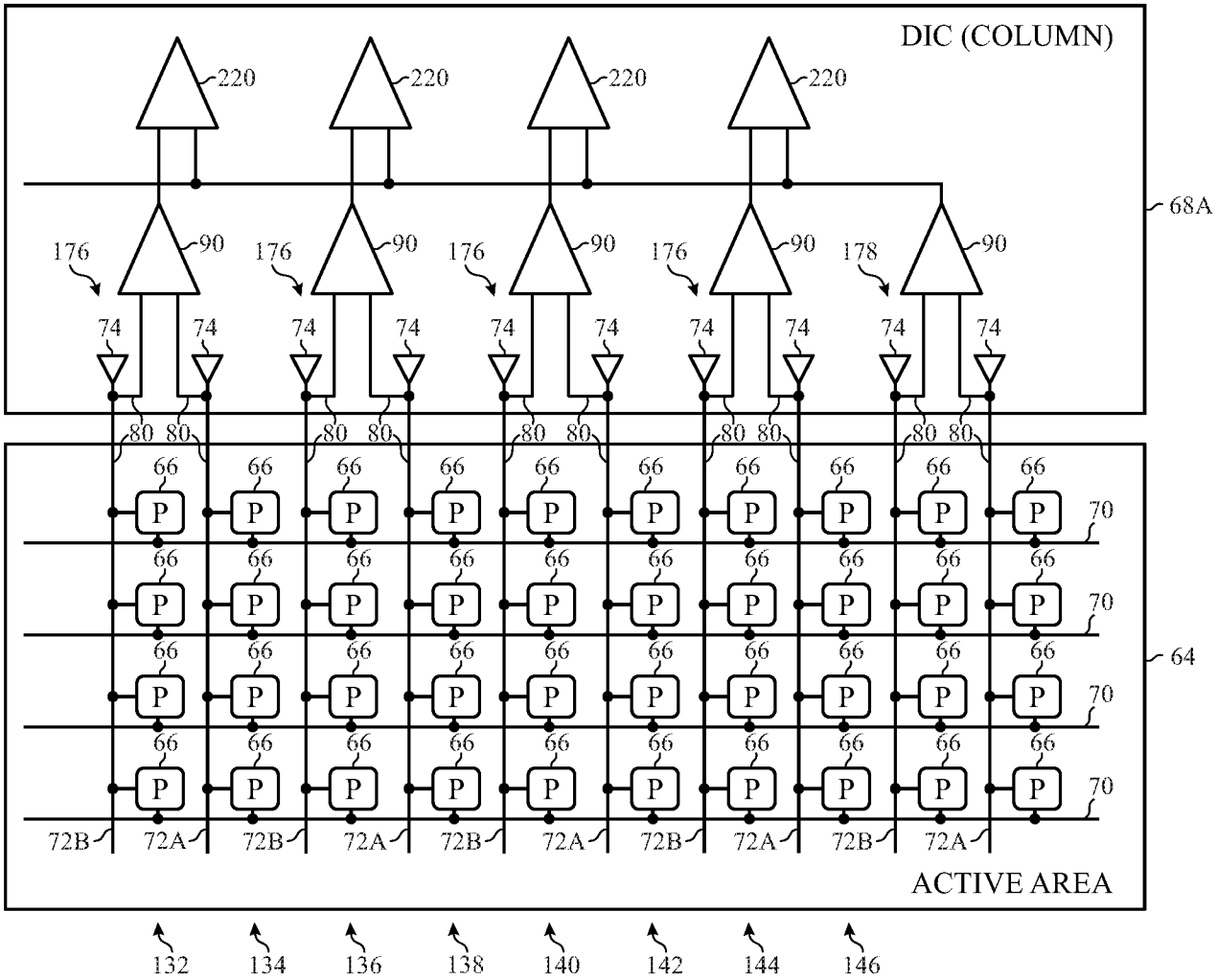
FIG. 23 is a block diagram of difference-differential sensing in the analog domain using multiple test differential sense amplifiers per reference differential sense amplifier, in accordance with an embodiment.
Figure 24:
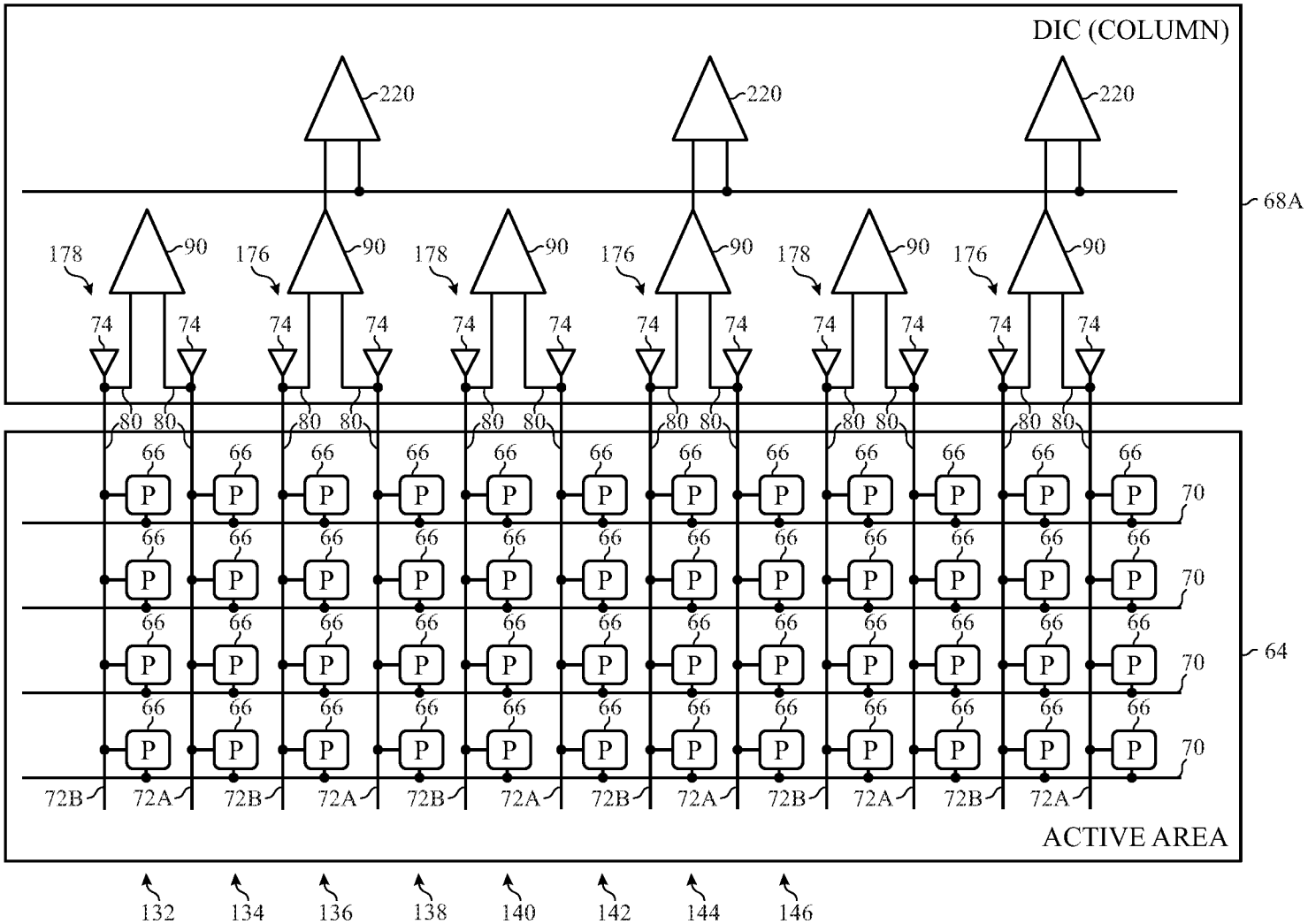
FIG. 24 is a block diagram of difference-differential sensing using multiple reference differential sense amplifiers to generate a differential common noise mode signal, in accordance with an embodiment.

Difference-differential sensing may also take place in the analog domain. For example, as shown in FIG. 22, analog versions of the differentially sensed test pixel signal and the differential reference signal may be differentially compared in a second-stage sense amplifier 220. A common reference differential pair 178 may be used for difference-differential sensing of several test differential pairs 176, as shown in FIG. 23. Any suitable number of test differential pairs 176 may be differentially sensed in comparison to the reference differential pair 178. Moreover, the reference differential pair 178 may vary at different times, meaning that the location of the reference differential pair 178 may vary from image frame to image frame. Moreover, as shown in FIG. 24, multiple reference differential pairs 178 may be connected together to provide an analog averaging of the differential reference signals from the reference differential pairs 178. This may also improve a signal quality of the difference-differential sensing on the test differential pairs 176.

Correlated Double Sampling (CDS)

Correlated double sampling involves sensing the same pixel 66 for different samples at different, at least one of the samples involving programming the pixel 66 with test data and sensing a test signal and at least another of the samples involving not programming the pixel 66 with test data and sensing a reference signal. The reference signal may be understood to contain temporal noise that may be removed from the test signal. Thus, by subtracting the reference signal from the test signal, temporal noise may be removed. Indeed, in some cases, there may be noise due to the sensing process itself. Thus, correlated double sampling may be used to cancel out such temporal sensing noise.

Figure 25:
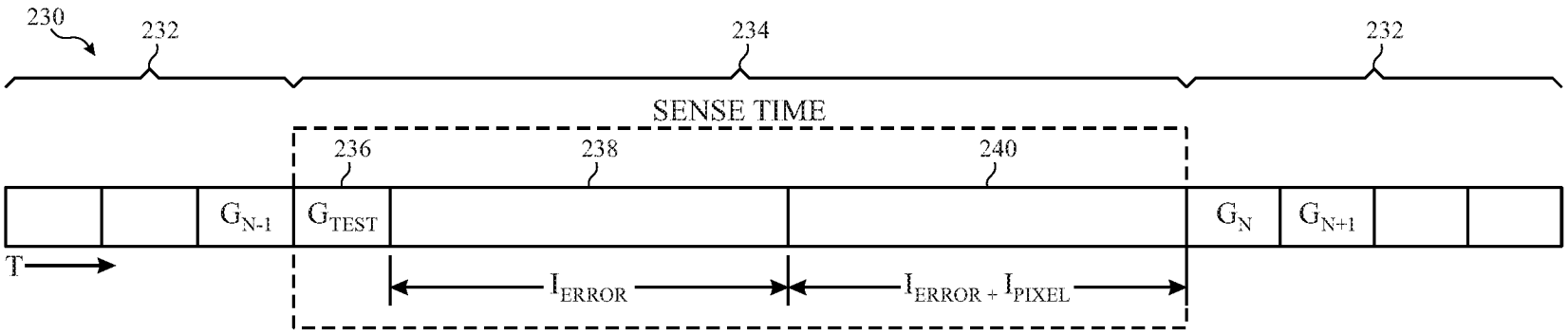
FIG. 25 is a timing diagram for correlated double sampling, in accordance with an embodiment.

FIG. 25 provides a timing diagram 230 representing a manner of performing correlated double sampling. The timing diagram 230 includes display operations 232 and sensing operations 234. The sensing operations 234 may fall between times where image data is being programmed into the pixels 66 of the electronic display 18. In the example of FIG. 25, the sensing operations 234 include an initial header 236, a reference sample 238, and a test sample 240. The initial header 236 provides an instruction to the electronic display 18 to perform display panel sensing. The reference sample 238 represents time during which a reference signal is obtained for a pixel (i.e., the test pixel 66 is not supplied test data) and includes substantially only sensing noise ($I_{ERROR}$). The test sample 240 represents time when the test signal is obtained that includes both a test signal of interest ($I_{PIXEL}$) and sensing noise ($I_{ERROR}$). The reference signal obtained during the reference sample 238 and the test signal obtained during the test sample 240 may be obtained using any suitable technique (e.g., single-ended sensing, differential sensing, or difference-differential sensing).

Figure 26:
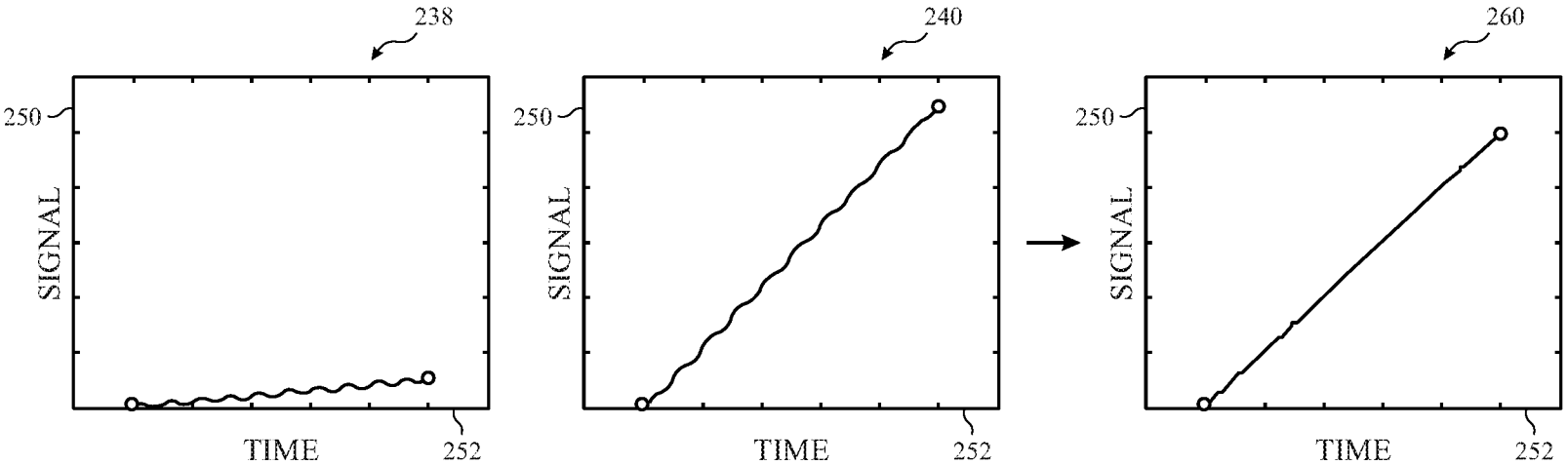
FIG. 26 is a comparison of plots of signals obtained during the correlated double sampling of FIG. 25, in accordance with an embodiment.

FIG. 26 illustrates three plots: a first plot showing a reference signal obtained during the reference sample 238, a second plot showing a test signal obtained during the test sample 240, and a third plot showing a resulting signal that is obtained when the reference signal is removed from the test signal. Each of the plots shown in FIG. 26 compares a sensed signal strength (ordinate 250) in relation to sensing time (abscissa 252). As may be seen, even when no test data is programmed into a test pixel 66, the reference signal obtained during the reference sample 238 is non-zero and represents temporal noise ($I_{ERROR}$), as shown in the first plot. This temporal noise component also appears in the test signal obtained during the test sample 240, as shown in the second plot ($I_{PIXEL}+I_{ERROR}$). The third plot, labeled numeral 260, represents a resulting signal obtained by subtracting the temporal noise of the reference signal ($I_{ERROR}$) obtained during the reference sample 238 from the test signal ($I_{PIXEL}+I_{ERROR}$) obtained during the test sample 240. By removing the reference signal ($I_{ERROR}$) from the test signal ($I_{PIXEL}+I_{ERROR}$), the resulting signal is substantially only the signal of interest ($I_{PIXEL}$).

Figure 27:
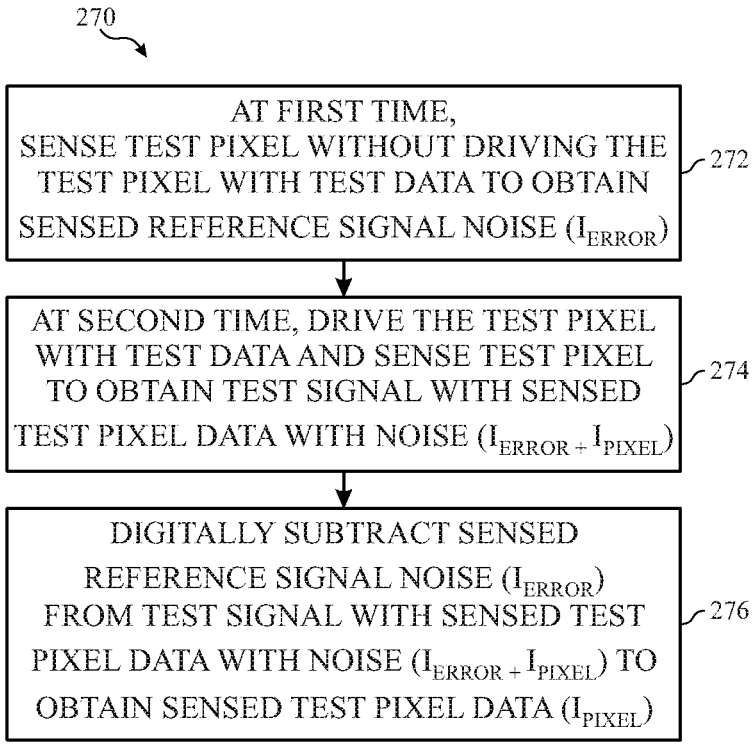
FIG. 27 is a flowchart of a method for performing correlated double sampling, in accordance with an embodiment.

One manner of performing correlated double sampling is described by a flowchart 270 of FIG. 27. At a first time, a test pixel 66 may be sensed without first programming the test pixel with test data, thereby causing the sensed signal to represent temporal noise ($I_{ERROR}$) (block 272). At a second time different from the first time, the test pixel 66 may be programmed with test data and the test pixel 66 may be sensed using any suitable display panel sensing techniques to obtain a test signal that includes sensed text pixel data as well as the noise ($I_{PIXEL}+I_{ERROR}$) (block 274). The reference signal ($I_{ERROR}$) may be subtracted from the test signal ($I_{PIXEL}+I_{ERROR}$) to obtain sensed text pixel data with reduced noise ($I_{PIXEL}$) (block 276).

Figure 28:
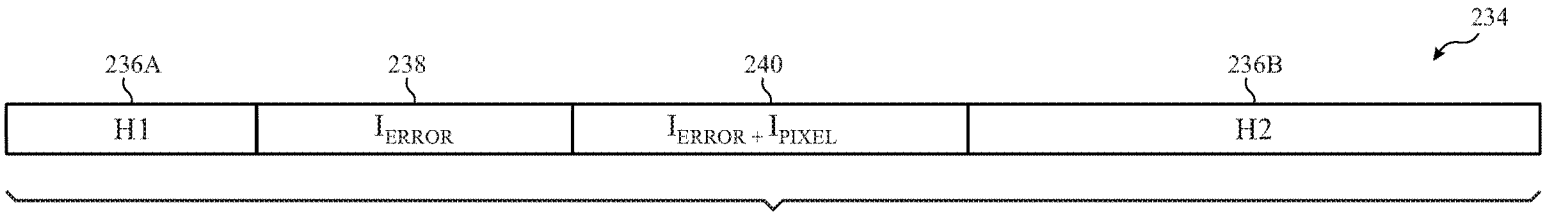
FIG. 28 is a timing diagram of a first example of correlated double sampling that obtains one test sample and one reference sample, in accordance with an embodiment.
Figure 29:
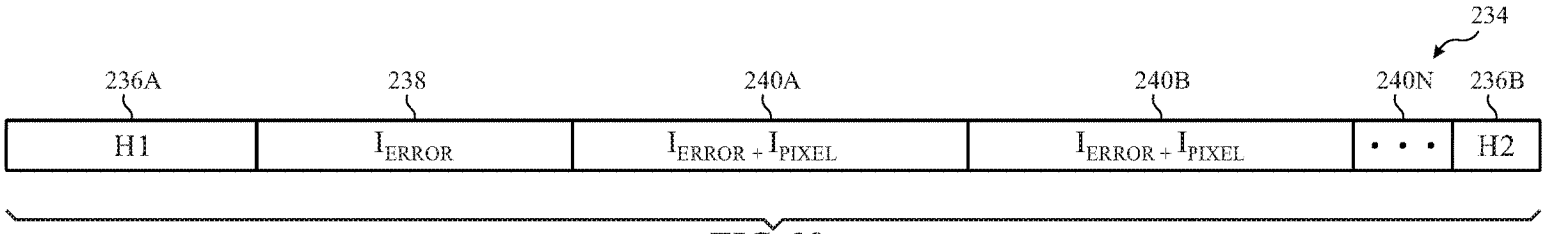
FIG. 29 is a timing diagram of a second example of correlated double sampling that obtains multiple test samples and one reference sample, in accordance with an embodiment.

It should be appreciated that correlated double sampling may be performed in a variety of manners, such as those shown by way of example in FIGS. 28, 29, 30, 31, and 32. For instance, as shown in FIG. 28, another timing diagram for correlated double sampling (e.g., sensing operations 234) may include headers 236A and 236B that indicate a start and end of a sensing period, in which a reference sample 238 and a test sample 240 occur. In the example correlated double sampling timing diagram of FIG. 29 (e.g., sensing operations 234), there is one reference sample 238, but multiple test samples 240A, 240B, . . . , 240N. In other examples, multiple reference samples 238 may take place to be averaged and a single test sample 240 or multiple test samples 240 may take place.

Figure 30:
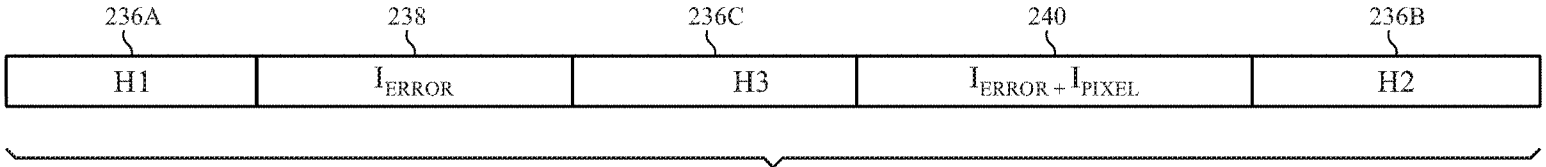
FIG. 30 is a timing diagram of a third example of correlated double sampling that obtains non-sequential samples, in accordance with an embodiment.
Figure 31:
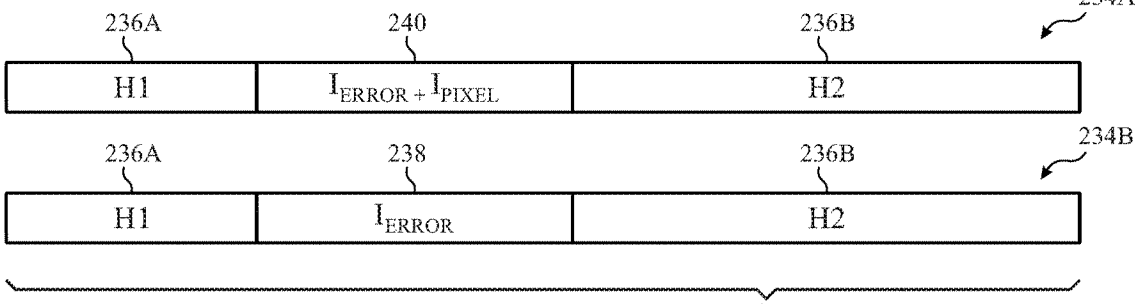
FIG. 31 is an example of correlated double sampling occurring over two different display frames, in accordance with an embodiment.

A reference sample 238 and a test sample 240 may not necessarily occur sequentially. Indeed, as shown in FIG. 30 (e.g., sensing operations 234), a reference sample 238 may occur between two headers 236A and 236C, while the test sample 240 may occur between two headers 236C and 236B. Additionally or alternatively, the reference sample 238 and the test sample 240 used in correlated double sampling (e.g., sensing operations 234) may be obtained in different frames, as shown by FIG. 31. In FIG. 31, a first sensing period 234A occurs during a first frame that includes a reference sample 238 between two headers 236A and 236B. A second sensing period 234B occurs during a second frame, which may or may not sequentially follow the first frame or may be separated by multiple other frames. The second sensing period 234B in FIG. 31 includes a test sample 240 between two headers 236A and 236B.

CDS Combined with CDS

Figure 31A:
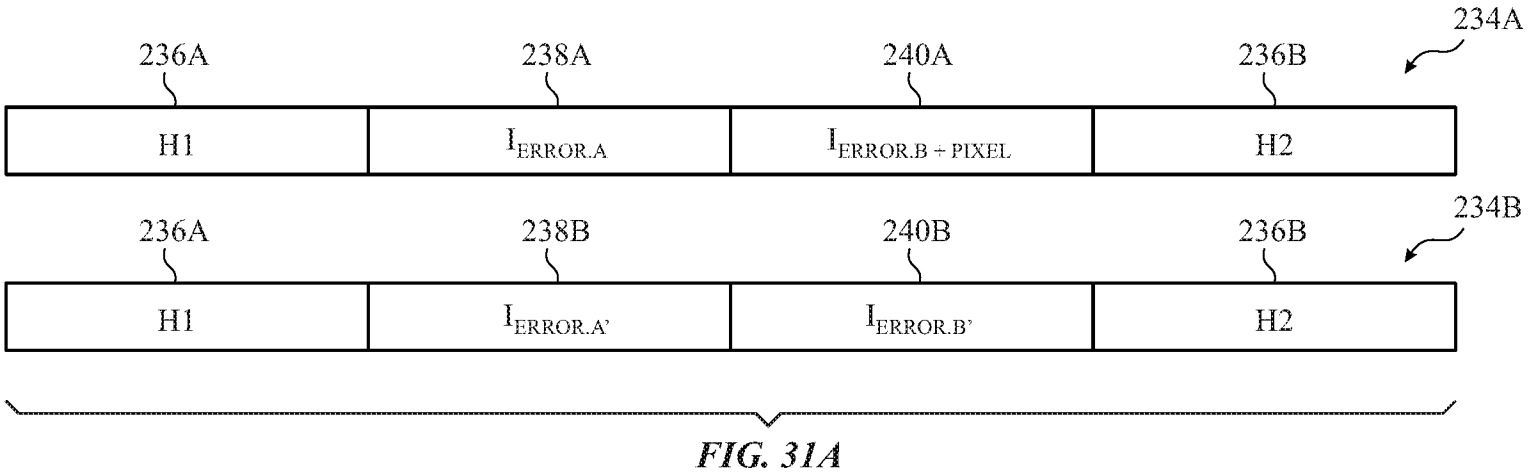
FIG. 31A is an example of correlated-correlated double sampling occurring over two different display frames, in accordance with an embodiment.

Correlated double sampling may lend itself well for use in combination with additional correlated double sampling (e.g., correlated-correlated double sampling (CDS-CDS)), as shown in FIG. 31A. Similar to FIG. 31, reference samples 238 (238A, 238B) and test samples 240 (240A, 240B) used in correlated double sampling (e.g., sensing operations 234) may be obtained in different frames. A first sensing period 234A occurs during a first frame that includes the reference sample 238A and the test sample 240A between two headers 236A and 236B. A second sensing period 234B occurs during a second frame, which may or may not sequentially follow the first frame and/or may be separated by multiple other frames. The second sensing period 234B in FIG. 31 includes the reference sample 238B and the test sample 240B between two headers 236A and 236B.

To perform correlated-correlated double sampling (CDS-CDS), a first difference between the reference sample 238A and the test sample 240A is determined. A second difference between the reference sample 238B and the test sample 240B is also determined. The reference samples 238 and the test samples 240 may be sampled at substantially similar relative times, where a relative time is determined relative to an overall duration of a frame rather than at a precise time (e.g., instead of sampling each 10 second interval, the sampling for reference sample may be taken 10% into a total duration of the sensing period), as indicated by the prime notation (e.g., $I_{ERROR_A}$ vs. $I_{ERROR_A}$).

The first difference may represent obtained sensed test pixel data with reduced noise (e.g., $I_{PIXEL}$). However, the electronic display 18 may have varying combinations of signals affecting a particular pixel at different points in a sensing duration causing higher-order noise to affect the sensed test pixel data over the sensing duration. Thus, the sensed test pixel data with reduced noise (e.g., $I_{PIXEL}$) may still include a non-negligible amount of noise in the result. This may be an example of temporal noise.

To reduce an amount of noise that may skew the obtained sensed text pixel data with reduced noise (e.g., $I_{PIXEL}$), a third difference may be determined between the first difference and the second difference. The second difference represents a difference in noise between substantially similar time periods of the sensing duration (e.g., relative time A corresponds to relative time A' in the sensing duration despite time A being different than time A') as the first difference is determined over. Thus, when the third difference is found between the first difference and the second difference, the non-consistent noise may also be compensated for in the final obtained sensed text pixel data value (e.g., $I_{PIXEL}$), providing an improved value having less noise or having the noise eliminated.

Figure 31B:
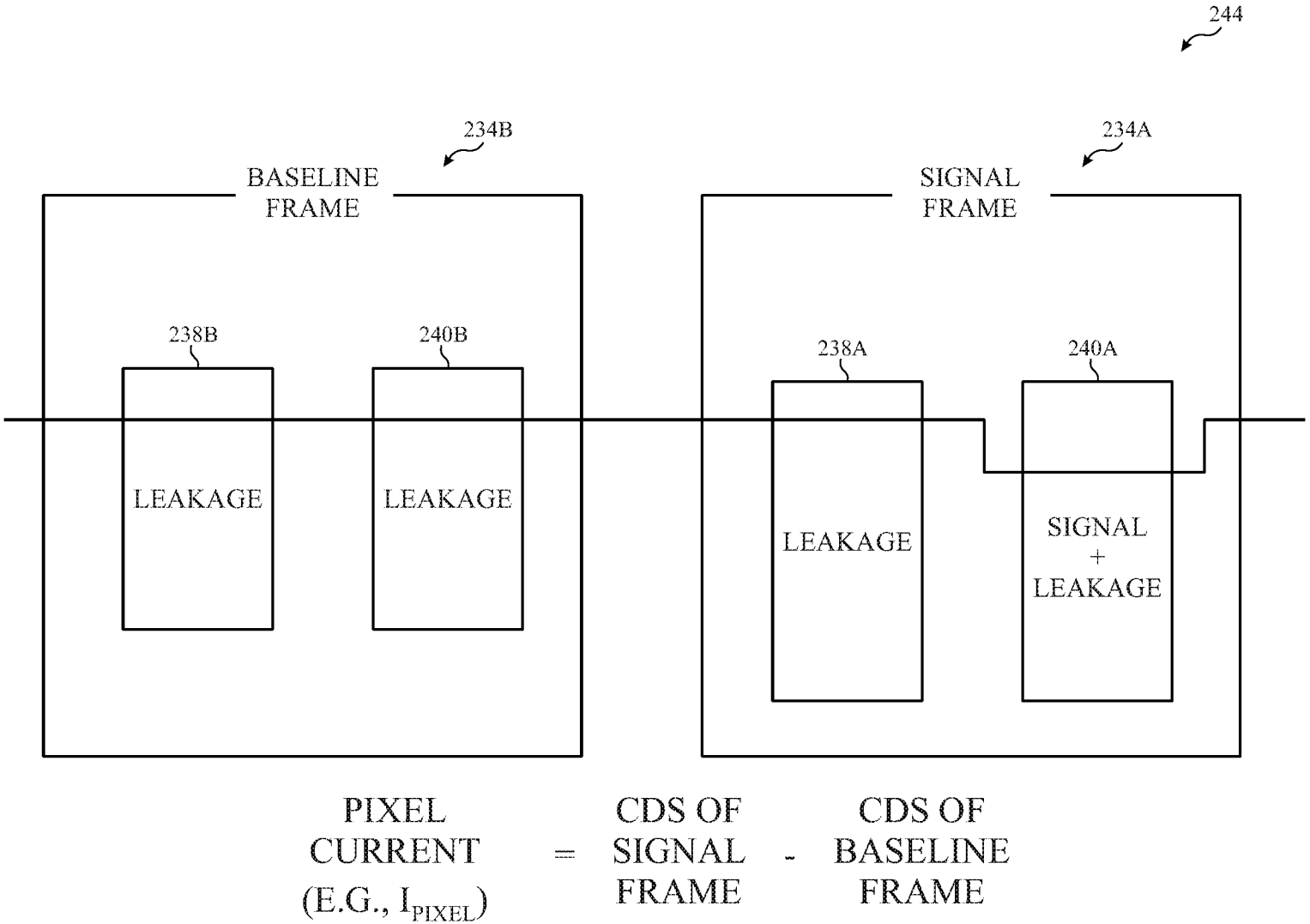
FIG. 31B is an illustration depicting the correlated-correlated double sampling operations occurring over a baseline frame and a signal frame, in accordance with an embodiment.

To help elaborate, FIG. 31B is an illustration 244 depicting the correlated-correlated double sampling (CDS-CDS) operations occurring over a baseline frame (corresponding to the second sensing period 234B) and a signal frame (corresponding to the first sensing period 234A). Sampling signals at different points in a single frame (e.g., the signal frame) may lead to error in the final sensing value (e.g., $I_{PIXEL}$) because of the various signals used in generating images or preparing the electronic display 18 to present an image frame. The various signals may cause different or inconsistent amounts of gate accumulation over a duration of a frame (e.g., type of temporal noise). Thus, correlating at least two correlated double sampling operations over at least two frame durations may reduce contributions to the final sensing value from gate accumulation and/or temporal noise.

Explaining FIG. 31B, the CDS of the signal frame may correspond to the difference between the reference sample 238A and the test sample 240A. The CDS of the baseline frame may correspond to the difference between the reference sample 238B and the test sample 240B. The final correlated-correlated double sensing sensed text pixel data with reduced noise (e.g., $I_{PIXEL}$) may correspond to a determined difference between the CDS of the signal frame and the CDS of the baseline frame. Since the reference samples 238 are taken at a same relative time of the sensing period, and since the test samples 240 are taken at a same relative time of the sensing period, any suitable start time of the sensing periods and/or any suitable frames may be used as the signal frame and/or the baseline frame.

Figure 31C:
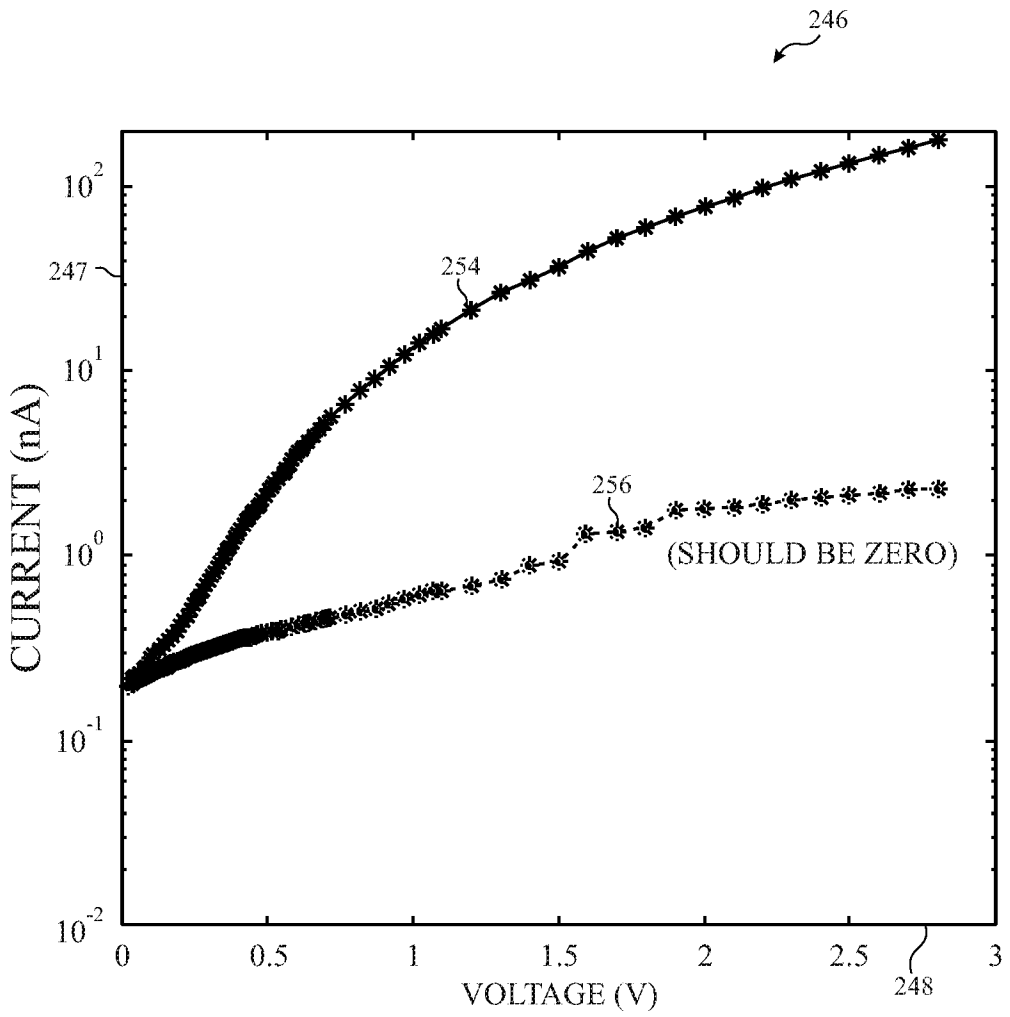
FIG. 31C is a plot of signals obtained during correlated double sampling of FIG. 25, in accordance with an embodiment.

An example of the effects from the varying gate accumulation is shown by a plot 246 of FIG. 31C. The plot 246 compares the detected signal of the sensed pixel data (ordinate 247) over an input gate voltage signal (abscissa 248). The plot 246 may have resulted from a simulation to test effects of the different or inconsistent amounts of gate accumulation described above with respect to FIG. 31B (e.g., such as a simulation of signals obtained during correlated double sampling described at least with FIG. 25). Line 253 illustrates a current-voltage (I-V) relationship for a simulated pixel. The predicted effect of the gate accumulation is captured with the line 256. The line 256 was expected to be simulated as a zero output. However, signal was measured, and thus indicated that the simulated I-V relationship for the example pixel was affected by the different or inconsistent amounts of gate accumulation described above similar. To cancel out some of the transient error associated with the gate accumulations, correlated-correlated double sampling (CDS-CDS) operations may be used.

Figure 31D:
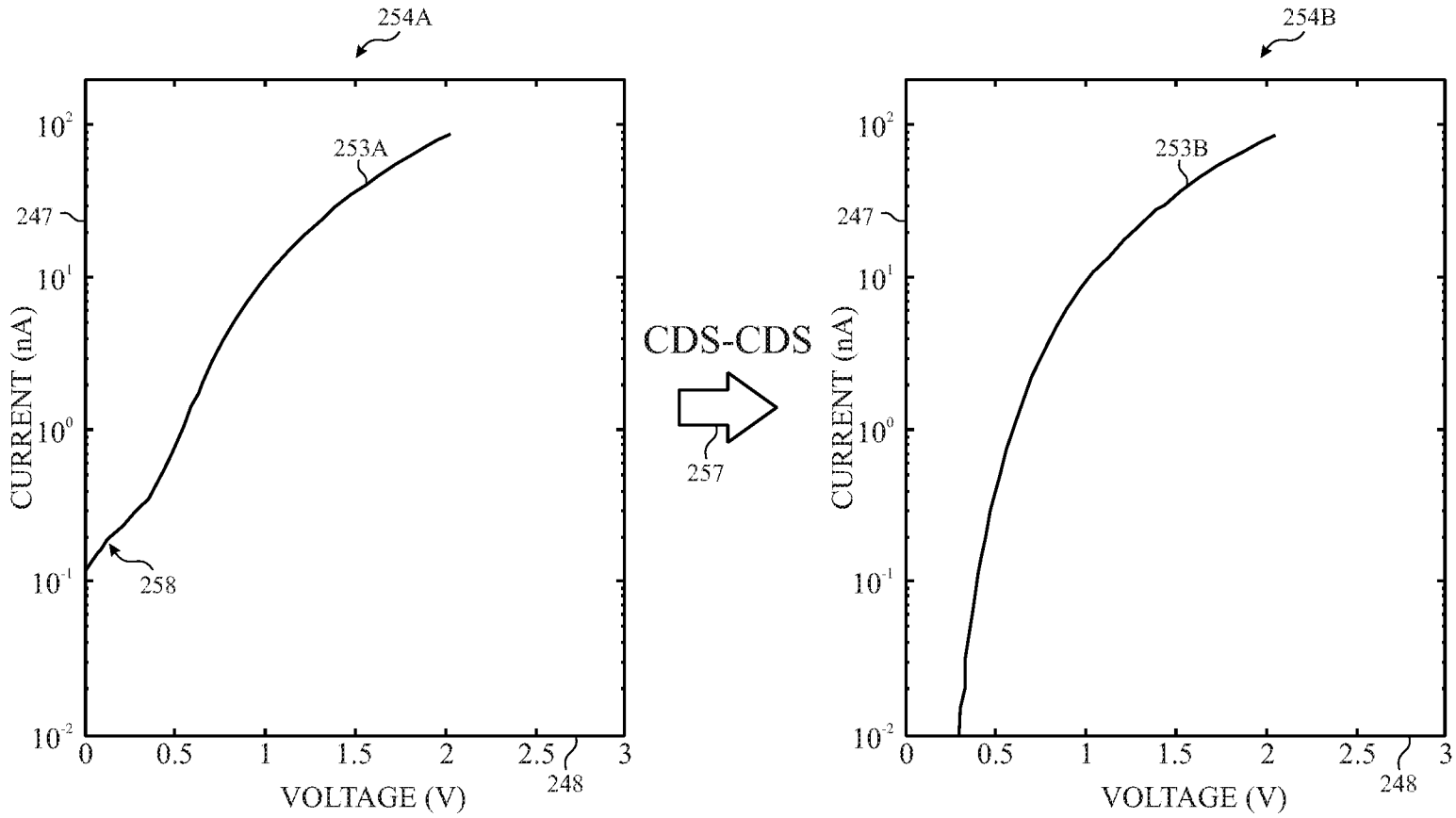
FIG. 31D is a comparison of plots of signals obtained during the correlated-correlated double sampling of FIG. 31B, in accordance with an embodiment.

An example to determine the text pixel data with reduced noise (e.g., $I_{PIXEL}$) may improve measurement quality. For example, FIG. 31D is a comparison of plots 254 (254A, 254B) depicting results from a simulation to test effects correlated-correlated double sampling (CDS-CDS) operations (e.g., application of which is represented via arrow 257) on an I-V relationship of a simulated pixel. The plots 254 each compare the detected signal of the sensed pixel data (ordinate 247) over an input gate voltage signal (abscissa 248). Comparing plot 254A to plot 254B, an improvement is apparent between the first pixel data (e.g., line 253A) and the second pixel data (e.g., line 253B). For example, effects of dielectric capacitive relaxation are reduced at the low current region (e.g., shown via a reduction in the flattening out apparent below 0.5 volts of line 253A (e.g., arrow 258 indicating the flatten region) and the plot 248A. The improvement may be attributed to performing the correlated-correlated double sampling (CDS-CDS) operations to reduce leakage residue (e.g., transient error) that may affect low current regions of I-V relationships resulting from sampling operations if left uncorrected. Furthermore, it is noted that CDS-CDS may increase a sensing detectable range (e.g., from $10^{-1}$ nanoamperes to $10^{-2}$ nanoamperes) while increasing a precision capability (e.g., more accurate sensing values based at least in part on more noise being removed from the sensed pixel data).

CDS Combined with DS and/or DDS

Figure 32:
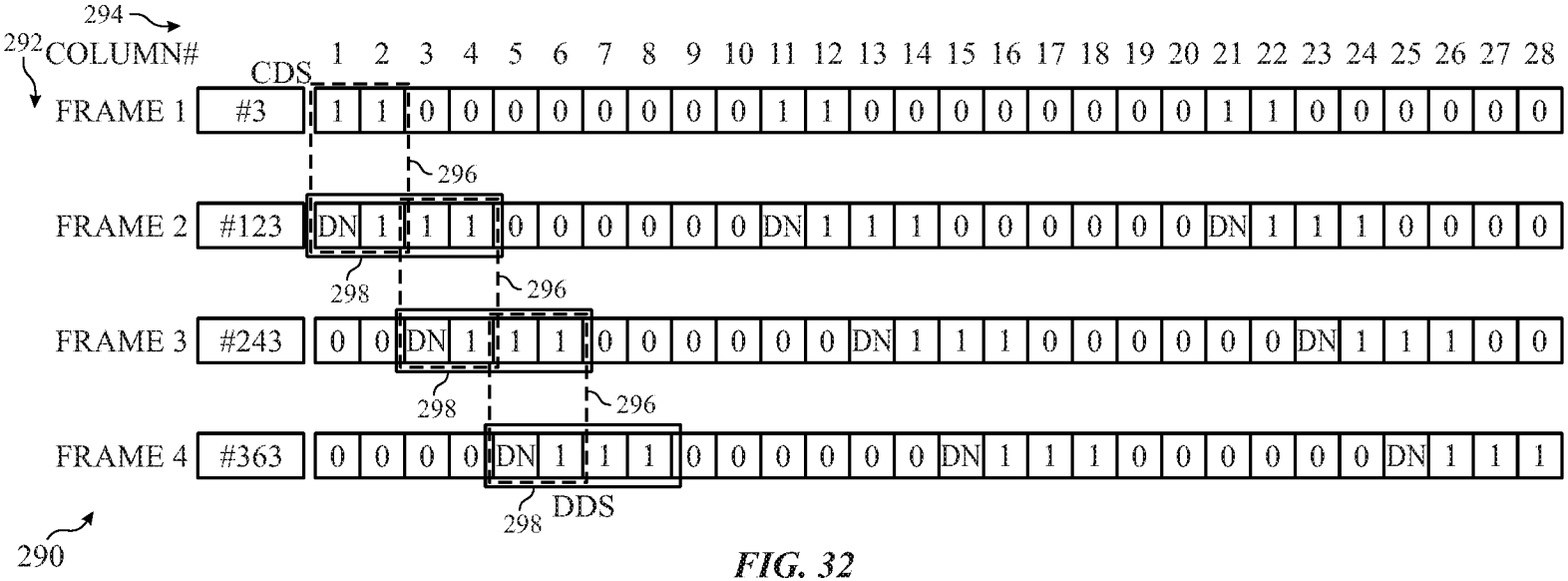
FIG. 32 is a timing diagram showing a combined performance of correlated double sampling at different frames and difference-differential sampling across the same frame, to further reduce or mitigate common-mode noise during display sensing, in accordance with an embodiment.

Correlated double sampling may also lend itself well for use in combination with differential sensing or difference-differential sensing, as shown in FIG. 32. A timing diagram 290 of FIG. 32 compares activities that occur in different image frames 292 at various columns 294 of the active area 64 of the electronic display 18. In the timing diagram 290, a "1" represents a column that is sensed without test data, "DN" represents a column with a pixel 66 that is supplied with test data, and "0" represents a column that is not sensed during that frame or is sensed but not used in the particular correlated double sampling or difference-differential sensing that is illustrated in FIG. 32. As shown in the timing diagram 290, reference signals obtained during one frame may be used in correlated double sampling (blocks 296) and may be used with difference-differential sensing (blocks 298). For example, during a first frame ("FRAME 1"), a reference signal may be obtained by differentially sensing two reference pixels 66 in columns 1 and 2 that have not been programmed with test data. During a second frame ("FRAME 2"), a test pixel 66 of column 1 may be programmed with test data and differentially sensed in comparison to a reference pixel 66 in column 2 to obtain a differential test signal and a second differential reference signal may be obtained by differentially sensing two reference pixels 66 in columns 3 and 4. The differential test signal may be used in correlated double sampling of block 296 with the reference signal obtained in frame 1, and may also be used in difference-differential sampling with the second differential reference signal from columns 3 and 4.

Capacitance Balancing

Figure 33:
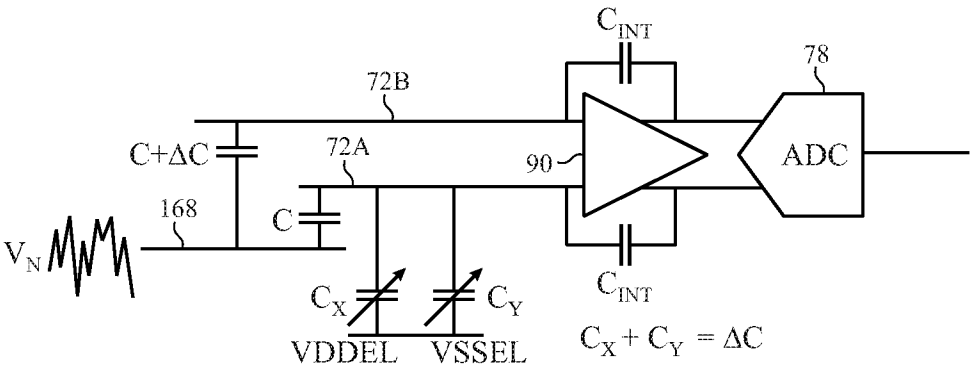
FIG. 33 is a circuit diagram in which a capacitance difference between two sense lines is mitigated by adding capacitance to one of the sense lines, in accordance with an embodiment.

Capacitance balancing represents another way of improving the signal quality used in differential sensing by equalizing the effect of a capacitance difference ($\Delta C$) between two sense lines 80 (e.g., data lines 72A and 72B). In an example shown in FIG. 33, there is a difference between a first capacitance between the data lines 72B and the conductive line 168 and a second capacitance between the data line 72A and the conductive line 168. Since this difference in capacitance could lead to the sense amplifier 90 detecting differential common-mode noise as a component of common-mode noise $V_N$ that is not canceled-out, additional capacitance equal to the difference in capacitance ($\Delta C$) may be added between the conductive lines 168 and some of the data lines 72 (e.g., the data lines 72A) via additional capacitor structures (e.g., $C_x$ and $C_y$).

Figure 34:
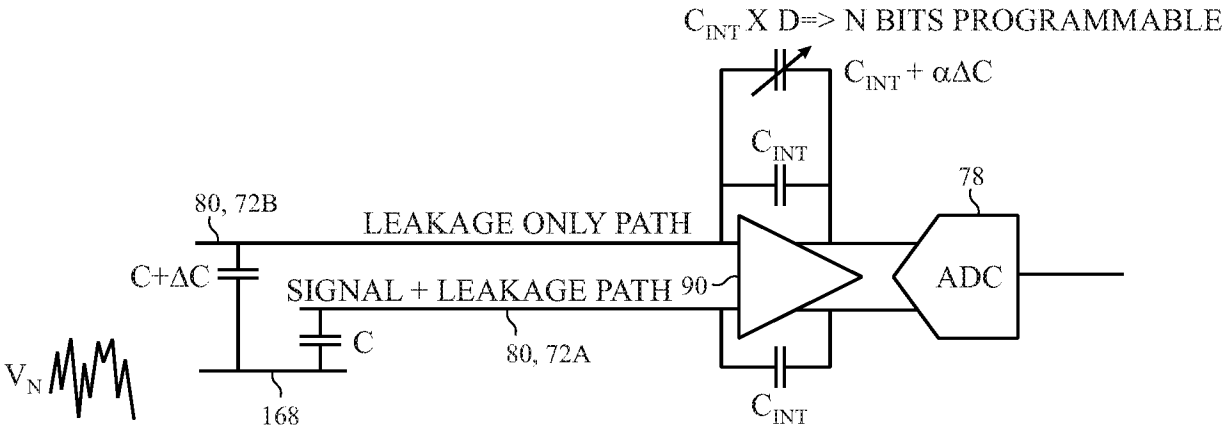
FIG. 34 is a circuit diagram in which the difference in capacitance on two sense lines is mitigated by adjusting a capacitance of an integration capacitor on a sense amplifier, in accordance with an embodiment.

Placing additional capacitor structures between the conductive lines 168 and some of the data lines 72 (e.g., the data lines 72A), however, may involve relatively large capacitors that take up a substantial amount of space. Thus, additionally or alternatively, a much smaller programmable capacitor may be programmed to a value that is proportional to the difference in capacitance ($\Delta C$) between the two data lines 72A and 72B (shown in FIG. 34 as $\alpha\Delta C$). This may be added to the integration capacitance $C_{INT}$ used by the sense amplifier 90. The capacitance $\alpha\Delta C$ may be selected such that the ratio of capacitances between the data lines 72A and 72B (C to (C+$\Delta$C)) may be substantially the same as the ratio of the capacitances around the sense amplifier 90 ($C_{INT}$ to ($C_{INT}$+$\alpha\Delta C$)). This may offset the effects of the capacitance mismatch on the two data lines 72A and 72B. The programmable capacitance may be provided instead of or in addition to another integration capacitor $C_{INT}$, and may be programmed based on testing of the electronic display 18 during manufacture of the electronic display 18 or of the electronic device 10. The programmable capacitance may have any suitable precision (e.g., 1, 2, 3, 4, 5 bits) that may reduce noise when programmed with an appropriate proportional capacitance.

Varied Positioning of Sensing Signal Pairs

Using the above-described techniques may increase sensing error over time due to a content-dependent sensing error. For example, some patterns or types of images cause differing amounts of errors. These errors may have a same polarity (e.g., a positive (+) polarity, a negative (−) polarity) and may, in a general sense, compound and/or add during filtering or processing operations associated with sensing. The post-filtering increase in sensing error may be mitigated if sensing is performed in such a way to alternate error polarities. For example, sensing signal pairs may be orientated and placed in such a way that a certain number of positive errors are generated adjacent to a certain number of negative errors. Sensing with consideration for relative positioning of sensing signal pairs and/or consideration for varied positioning of outputs from sensing signal pairs may reduce this inadvertent increase of sensing error by reducing sensing error over time. Error may reduce because the alternating of sensing errors acts to modulate at least sensing errors to up-convert content-dependent errors away from a passband of the filtering operations (e.g., a passband of a spatial filter used during the filtering operations). When frequencies of the sensing errors are outside the passband of the filtering operations, the sensing errors may be filtered from the sensing output, thereby improving the sensed data. When sensed data resulting from sensing operations improves, subsequent operations performed based on the sensed data may also improve.

Figure 35:
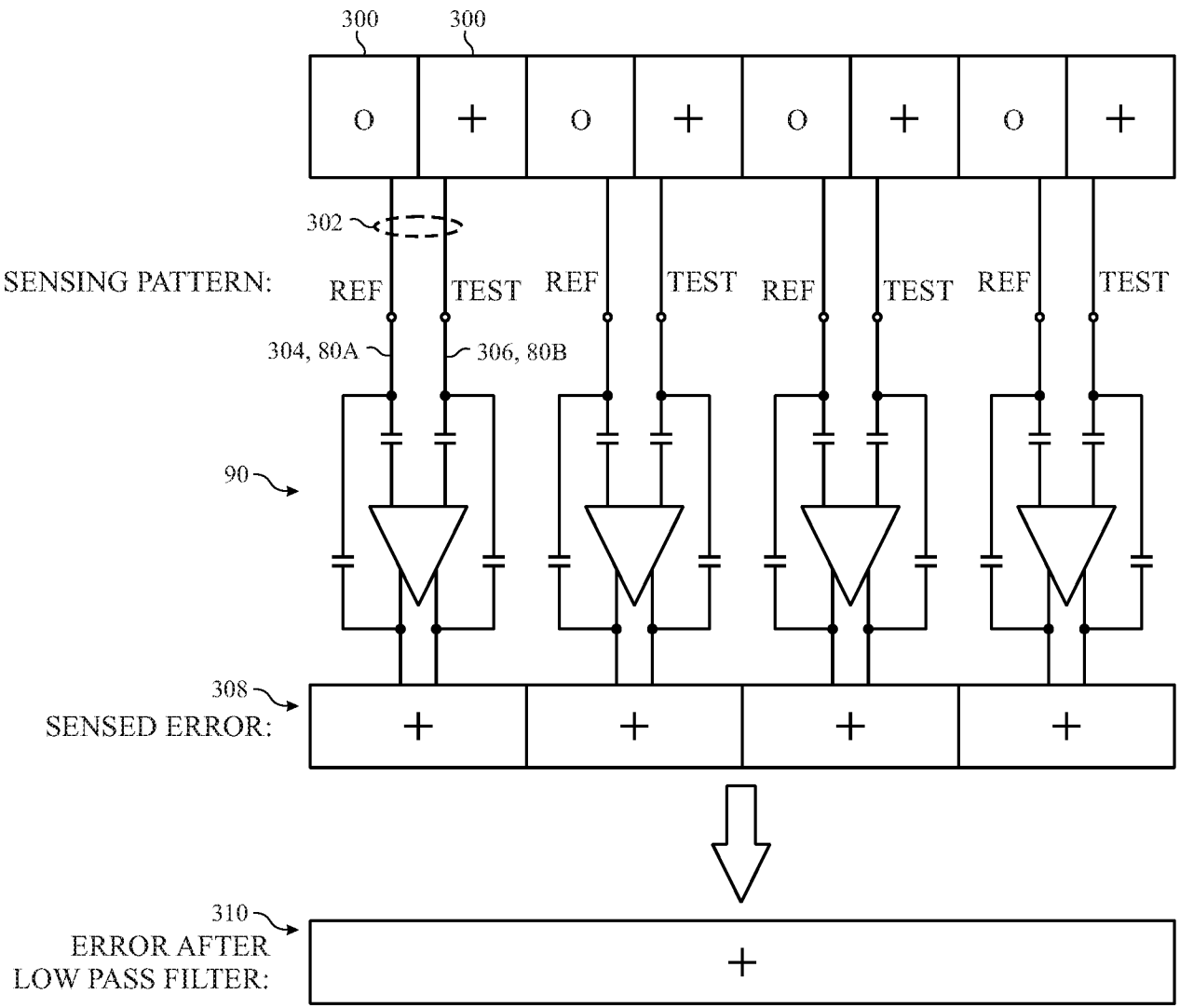
FIG. 35 is an illustration in which certain content-dependent sensing errors may arise during differential sensing.

To help explain, FIG. 35 is an illustration in which varied positioning of sensing signal pairs is not leveraged during sensing operations. Sensing regions 300 are coupled to sensing signal pairs 302 that include a reference sense line 80A and a test sense line 80B. The reference line transmits a reference sensing signal 304 during sensing operations, and the test sense line 80B transmits a test sensing signal 306 during sensing operations. Each of the reference sense lines 80A may transmit same or varying voltages between relative sensing signal pairs 302. Similar to how described above, the sensing signal pairs 302 may be respectively provided to sense amplifiers 90. Each sense amplifier 90 may transmit a signal having a sensing error with a particular polarity, where the particular polarity may be positive or negative based on the relative position of the reference sense line 80A and the test sense line 80B at input into the sense amplifier 90. In this example, each output from the sense amplifiers 90 has a respective positive error polarity 308, but (as shown in FIG. 36) had a respective reference sense line 80A and a respective test sense line 80B been coupled opposite, the respective output may have a negative error polarity.

Errors that have a same polarity may increase during processing of the sensed data and result in a final positive polarity error that is larger at the end of processing. For example, sensed data may be processed via filtering operations, and thus may have increased errors as a result of the filtering operations (e.g., low-pass filtering operations). This increased sensing error is represented by compounded sensing error 310 that has a relatively larger magnitude but same polarity as the respective positive error polarities 308. The compounded sensing error 310 that remains after the processing operations may degrade or reduce compensation accuracy (e.g., effectiveness) over time of differential sensing operations, which may lead to visual artifacts appearing on the display. Furthermore, this sensing error introduced into the final sensing results from the processing operations may offset some of the noise reduction effects that result from using the sensing techniques described above (e.g., differential sensing (DS), difference-differential sensing (DDS), correlated double sampling (CDS), correlated-correlated double sampling (CDS-CDS), programmable capacitor matching).

In FIG. 35, each sensing signal pair 302 has a non-alternating polarity sensing pattern of just positive error polarity 308 (e.g., ++++, 1 1 1 1) being output with the sensed data. However, leveraging the varied positioning of polarities of sensing errors and/or leveraging the varied positioning of the sensing signal pairs 302 may reduce the compounding of sensing errors associated with sensing operations, as discussed herein.

Figure 36:
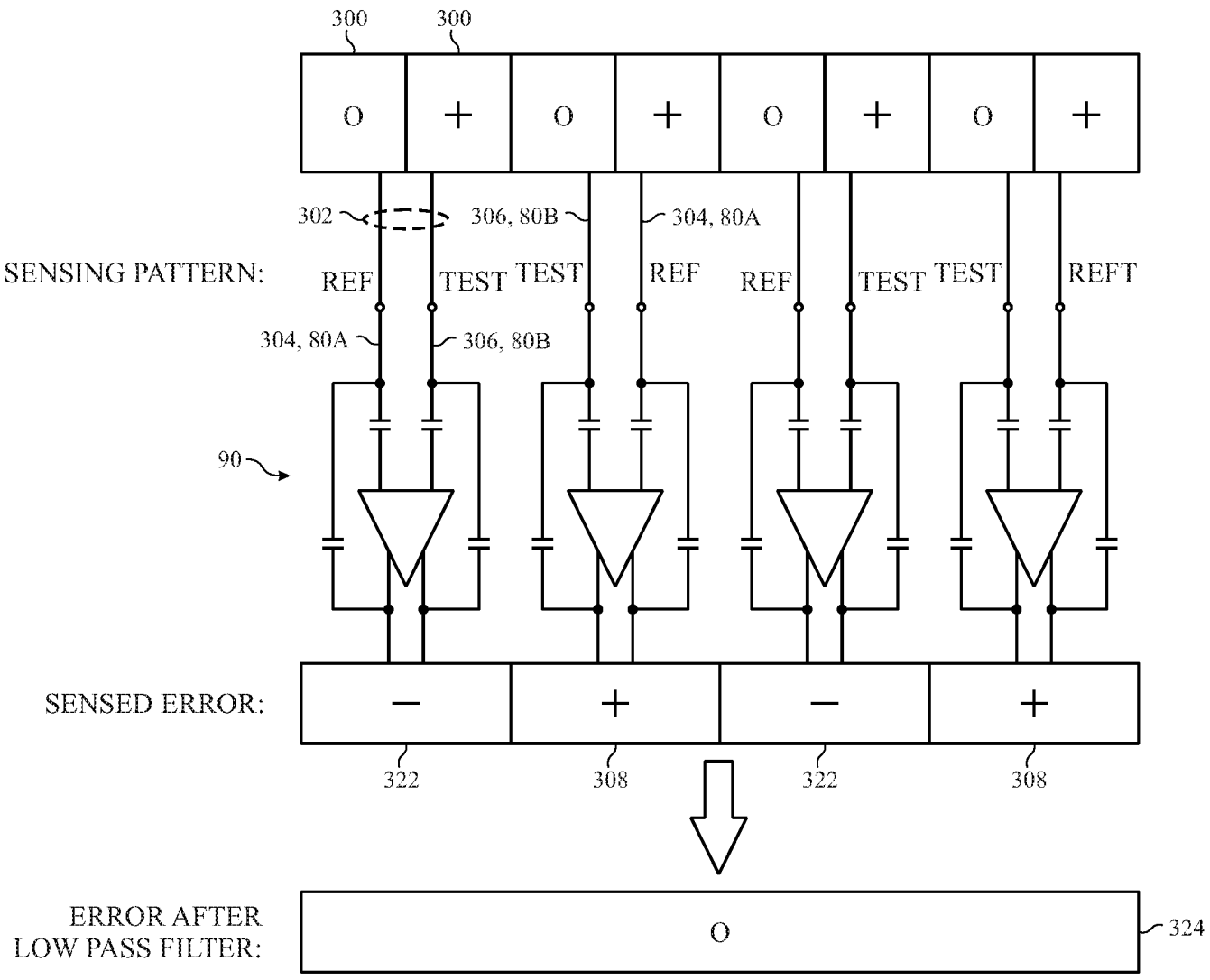
FIG. 36 is an illustration in which varied positioning of sensing signal pairs may mitigate the sensing errors of FIG. 35, in accordance with an embodiment.

In contrast with FIG. 35, FIG. 36 is an illustration in which varied positioning of sensing signal pairs 302 is leveraged during sensing operations to reduce the compounding of sensing errors associated with sensing operations. The sensing signal pairs 302 of FIG. 36 make a different sensing pattern from the sensing signal pairs 302 of FIG. 35. For example, in FIG. 36, the sensing signal pairs 302 operate as part of an alternating polarity sensing pattern that outputs alternating positive error polarities 308 and negative error polarities 322 (e.g., – +– +, –1 1 –1 1) that are effectively positioned adjacent. The term, "effectively positioned adjacent" is used to generally describe how, although an error is not going to be positioned anywhere (since it is carried within a signal), a prediction of an expected error or expected error polarity may be mapped, and thus represented as positioned adjacent to another error. In this example, a positive error polarity 308 is shown as effectively positioned adjacent to a negative error polarity 322, and thus alternate polarities. It is noted that, in some cases, the test sense lines 80B of a first sensing signal pair 302 may transmit a same (e.g., substantially similar) or different test signal 306 than other sensing signal pairs 302, and the reference sense lines 80A of the first sensing signal pair 302 may transmit a same or different reference sensing signal 304 than other sensing signal pairs 302.

Since the outputs from the sense amplifiers 90 include errors that alternate in polarity, the frequency spectrum of the sensing error is up-converted to be at least partially outside a passband of filtering operations. In particular, this alternating sensing signal pair 302 configuration causes a spatial frequency spectrum of the sensing error to be moved, such as beyond a passband of a filter so that the sensing error may be filtered out from the sensing output. Thus, sensing errors may not increase due to the interactions between similar polarity sensing errors during processing operations, such as filtering operations. This is represented by a zero compounded sensing error 324 outputted after filtering operations and/or other suitable processing operations. Reducing an increase in sensing error due at least in part to interactions during processing operations may reduce a final error level in a final sensed data set, such as to a lower relative error amount and/or to zero.

Figures 37A, 37B, 37C, 37D, 37E:
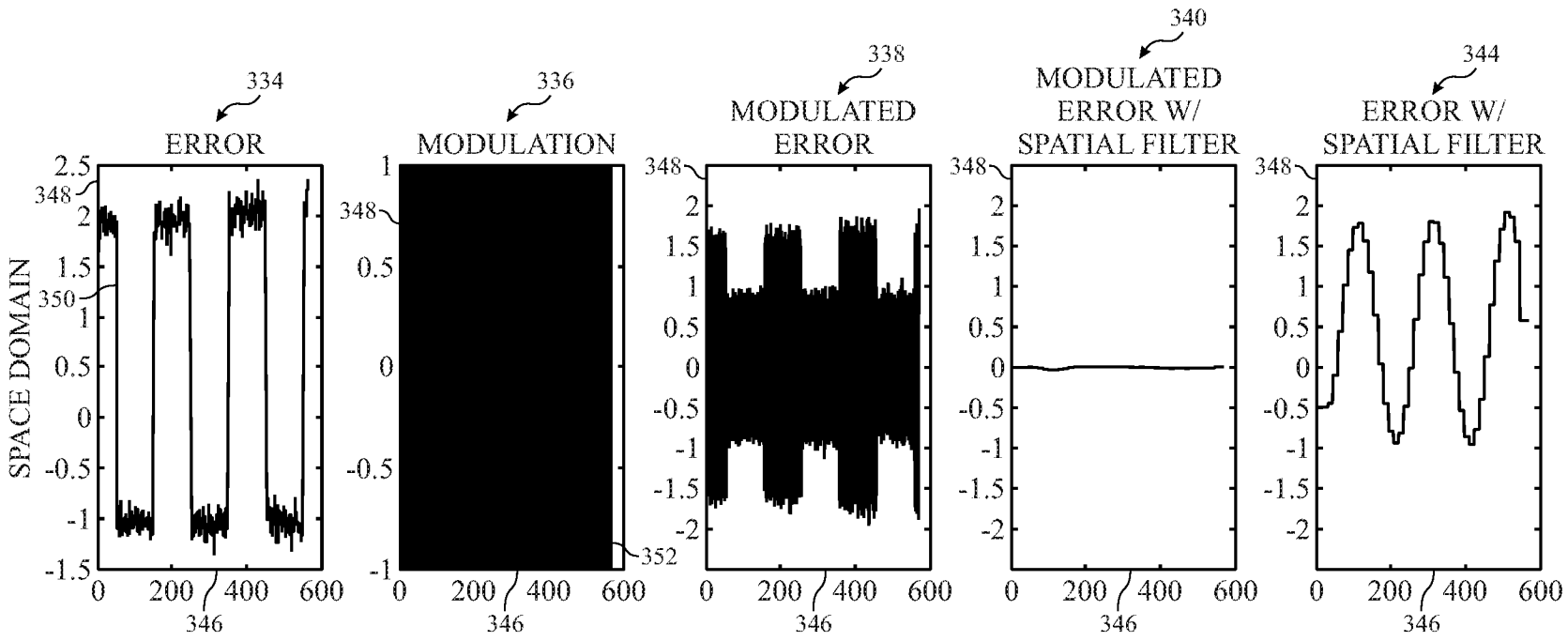
FIG. 37A is a plot of signals simulating a sensing error resulting from the sensing operations of FIG. 35, in accordance with an embodiment.
FIG. 37B is a plot of signals simulating a modulation of signals applied as sensing signal pairs during sensing operations of FIG. 36, in accordance with an embodiment.
FIG. 37C is a plot of signals simulating a sensing error resulting from the sensing operations of FIG. 36, in accordance with an embodiment.
FIG. 37D is a plot of signals simulating a sensing error remaining from the sensing error of FIG. 37C after processing operations of circuitry represented in FIG. 36, in accordance with an embodiment.
FIG. 37E is a plot of signals simulating a sensing error remaining from the sensing error of FIG. 37A after processing operations of circuitry represented in FIG. 35, in accordance with an embodiment.

To help illustrate why leveraging the varied positioning of error polarities via sensing signal pairs may improve sensing operations, FIGS. 37A-37E are plots of signals simulating sensing errors and subsequent processing of sensing errors with and without consideration for error polarities. FIG. 37A is a plot 334 of signals simulating a sensing error resulting from the sensing operations of FIG. 35 (e.g., sensing operations that do not consider varied positioning of error polarity via positioning of sensing signal pairs). FIG. 37B is a plot 336 of signals simulating a modulation of signals applied as sensing signal pairs during sensing operations of FIG. 36 (e.g., sensing operations that do consider varied positioning of error polarity via positioning of sensing signal pairs). FIG. 37C is a plot 338 of signals simulating a sensing error resulting from the sensing operations of FIG. 36. FIG. 37D is a plot 340 of signals simulating a sensing error remaining from the sensing error of FIG. 37C after processing operations of circuitry represented in FIG. 36. FIG. 37E is a plot 344 of signals simulating a sensing error remaining from the sensing error of FIG. 37A after processing operations of circuitry represented in FIG. 35. For ease of explanation, FIGS. 37A-37E are generally explained together below.

Each of the plots 334, 336, 338, 340, 344 compare a detected error signal (ordinate 346) over relative sensing location (abscissa 348). In this example, the relative sensing location (abscissa 348) corresponds to a column of pixels of the active area 64. The plot 334 shows generated errors (e.g., line 350) across columns of pixels of an example active area 64 sensed without using an alternating polarity sensing pattern. Alternating polarity sensing patterns over time may modulate frequency spectrums of sensing errors of the sensing outputs. The modulation of the error polarities over time may adjust the sensing output such that any error introduced from polarities interacting between sensing errors may be filtered out during the filtering operations of the post-sensing processing operations. The plot 336 illustrates a simulated modulation of the various sensing signal pairs 302 applied to each column represented by each of the relative sensing location (abscissa 348) via line 352. The line 352, although appears like a solid square plot, is a high frequency signal that modulates from –1 to 1 as the error outputs change polarities. The plot 338 illustrates a simulated output associated with the modulation of the various sensing signal pairs 302 represented in the plot 336. When sensing signals are alternatively applied, the outputs of the sensing signal pairs 302 applied to the sense amplifiers 90 are effectively modulated, thereby up-converting content-dependent errors away from a passband of a filter (e.g., a spatial filter) enabling the content-dependent errors to be eliminated during the filtering.

The plot 344 shows increased content-dependent errors that remain after the simulated filtering when not alternatively modulating the sensing signal pairs 302. In contrast, the plot 340 shows errors that remain after the simulated filtering when alternatively modulating the sensing signal pairs 302. Indeed, when comparing the plot 344 and the plot 340, error decreases in response to alternating polarity sensing patterns simulated by alternatively modulating the outputs of the sensing signal pairs 302 being inputted into spatial filtering operations.

Figure 38A:
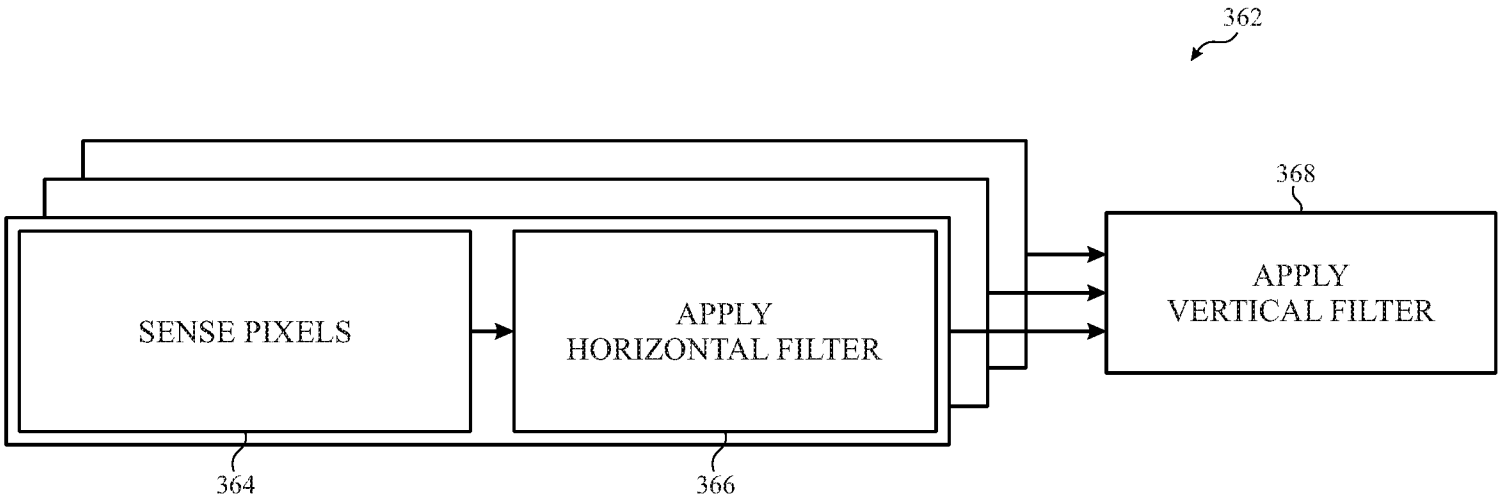
FIG. 38A is an illustration in which an example of processing operations of the circuitry represented in FIG. 36 that may be leveraged with varied positioning of sensing signal pairs, in accordance with an embodiment.
Figure 38B:
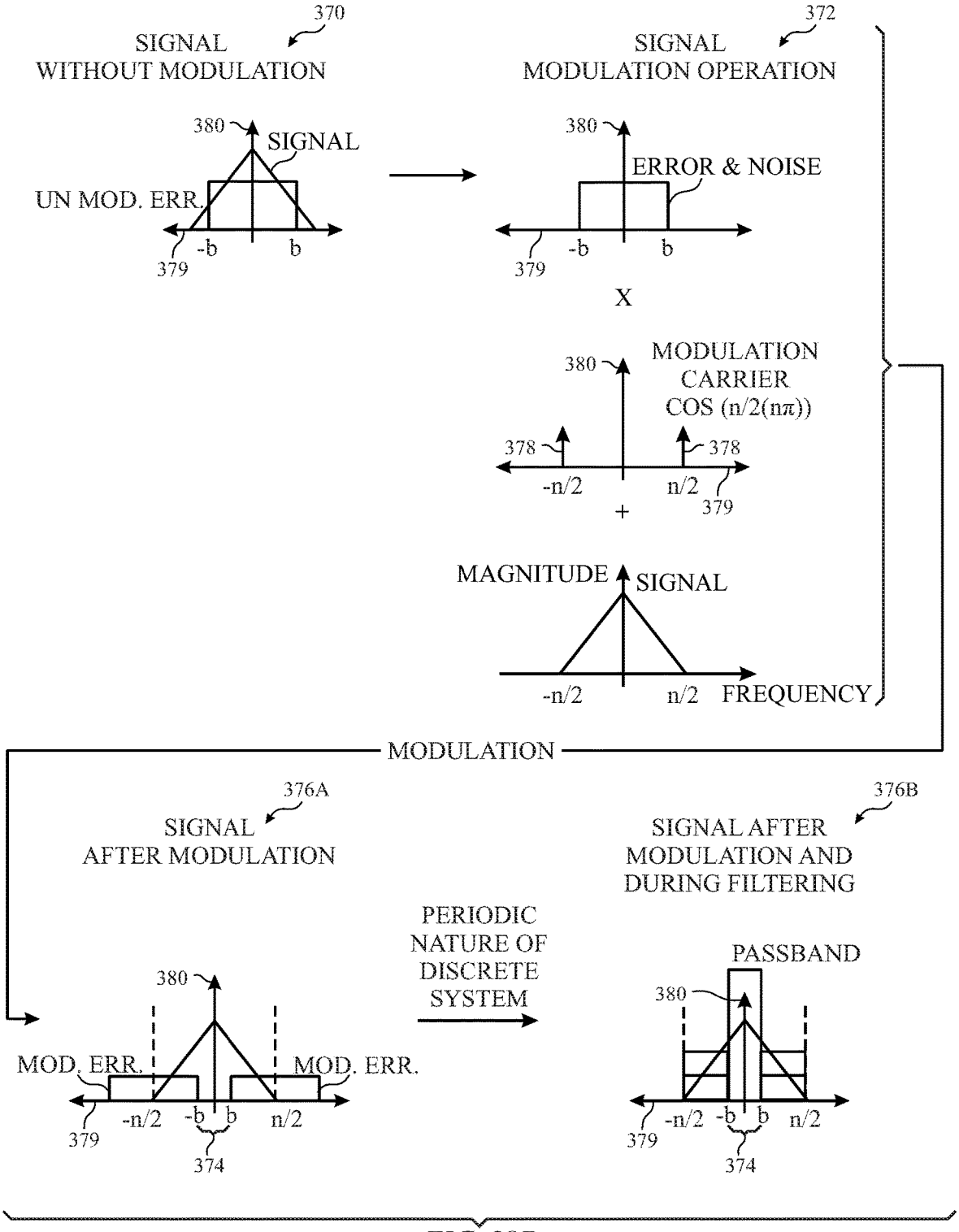
FIG. 38B is a collection of plots illustrating an example of the processing operation of FIG. 38A, in accordance with an embodiment.

As described above, filtering operations may be an example of a processing operation performed on sensed data output from sense amplifiers 90. FIG. 38A is an illustration of an example external compensation algorithm 362 that includes sensing operations (e.g., block 364) and filtering operations (e.g., block 366, 368). To help explain FIG. 38A, FIG. 38B is a collection of general plots illustrating a particular example of the example external compensation algorithm 362. It is noted that different operations may be included or excluded from the example external compensation algorithm 362 in an actual implementation. For ease of description, FIGS. 38A and 38B are described together below. It is noted that in some devices, the display 18 may perform each of the sensing and filtering operations. However, in certain embodiments, the display 18 may perform the sensing operations and the processor core complex 12 may perform the filtering operations. The display 18 may sense in response to one or more control signals transmitted by the processor core complex 12 to instruct and/or otherwise adjust sensing operations. Furthermore, a wide variety of timeframes may be used to perform these sensing and filtering operations. For example, the sensing operation may be performed by the display 18 at a first time, such as while the processor core complex 12 is asleep, power-gated, and/or powered-off, and the filtering operations may be performed at a second and later time than the first time by the processor core complex 12, such as when the processor core complex 12 is on or has returned to a full-power operation. The sensing and filtering operations may also be performed at least partially at the same time (e.g., such as a final row of pixels 66 being sensed while filtering operations are ongoing). It is noted that in FIG. 38B, n represents a sensing region 300 width of the electronic display 18, where a width of a sensing region 300 represents a number of sub-sensing regions or pixels 66 sensed of a row before the sensing operations are repeated for a next or subsequent row.

The example external compensation algorithm 362 may include the display 18 via the driver integrated circuit 68 sensing, at block 364, pixels 66. The amount of pixels 66 sensed may be based on a channel capacity of the sensing analog front end (AFE) 76. The channel capacity may correspond to a number of columns or rows that may be sensed as part of a same sensing operation. In some examples, the number of rows and columns sensed may also be based on a particular sensing pattern. During the sensing, the sensing signal pairs 302 are modulated in the relative positioning of the test signals and the reference signals to cause a particular amount of positive polarity errors and another amount of negative polarity errors.

Mathematically, FIG. 38B shows what the modulation of relative positioning may do to the frequency spectrum of the sensing error. In particular, plot 370 depicts a sensed data signal that has not undergone modulation operations associated with alternatively modulating the sensing signal pairs 302. When sensing operations are performed without alternating the sense lines 80 within the sensing signal pairs 302, modulation may not be performed, and thus unmodulated sensing error frequencies may be relatively uniform in magnitude across a frequency range and span an error bandwidth, b. Plots 372 depict how alternatively modulating the sensing signal pairs 302 may cause a shift in the frequency spectrum of the sensing error. The shift of the frequency component of the sensing error may shift enough to move the error outside the passband 374 of the filter depicted in plots 376 (e.g., plot 376A and plot 376B). The offset of the modulation carrier (e.g., n/2, −n/2, represented via magnitudes 378) may be determined based at least in part on a speed of the alternating modulation of the sensing signal pairs 302. As shown in the plot 376, when the error is moved to be outside the passband 374 of the filter, no error (e.g., zero error or nonconsequential amounts of error) remain in the signal after the filtering. It is noted that each of the plots of FIG. 38A (e.g., plots 370, 372, 376) compare frequency of a signal (abscissa 379) to magnitude or power of the signal (ordinate 380) at each frequency.

Returning to FIG. 38A, at block 366, the processor core complex 12 and/or the display 18 may apply a horizontal low pass filter to sensed data generated by operations of block 364. The processor core complex 12 and/or the display 18 may apply the horizontal low pass filter while processing the sensed data in the frequency domain. The operations of blocks 364 and 366 may be repeated until a threshold amount of sensed data is gathered (as represented in FIG. 38A by the one or more stacked horizontal filtering and sensing operations of blocks 364, 366). After the amount of sensed data is equal to or greater than the threshold amount, the processor core complex 12 and/or the display 18 may, at block 368, apply a low pass filter to the resulting sensed data after horizontal filtering operations of each sensing operation. For example, after each row of pixels 66 is sensed, an overall vertical filer may be applied at block 368 after each row of pixels 66 is sensed. When the example external compensation algorithm 362 is used at least partially in combination with varied positioning of sensing signal pairs 302 during sensing operations, at least sensing error caused by compounding sensing error and/or the polarity of the sensing error may be efficiently filtered out via the spatial filter used in post-sensing processing operations.

Figure 39A:
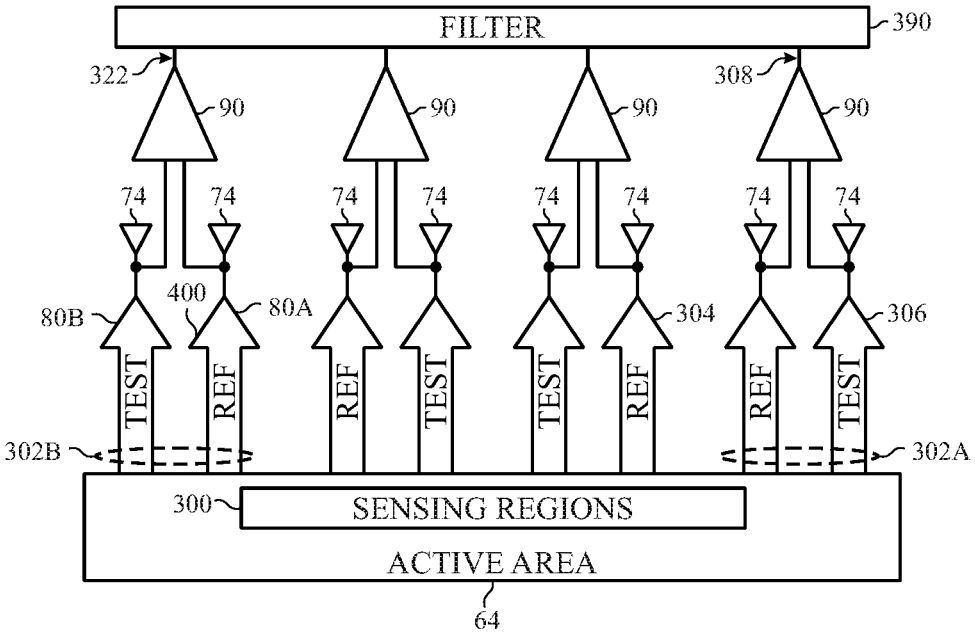
FIG. 39A is a block diagram of differential sensing that leverages the varied positioning of sensing signal pairs, in accordance with an embodiment.

Applying these techniques described herein to the general display structure described above, FIG. 39A is a block diagram of differential sensing operations that leverage the varied positioning of sensing signal pairs 302. Sensed data from the sensing regions 300 of the active area 64 transmits as a portion of the test sensing signal 306 during sensing operations. As explained above, the sensed data is isolated from sensing signal pair 302 common mode noise of the test sensing signal 306 via comparison with the reference sensing signal 304. This comparison may be performed at the sense amplifier 90, where the sensed data may transmit from the sense amplifier 90 to the filter 390. The sensed data may include error of a particular polarity based on the relative effect positioning of the sensing signals 304, 306 of the sensing signal pair 302. For example, when the sensing signal pair 302 is ordered reference-test, as shown in sensing signal pair 302A, the output from the sense amplifier includes a positive error polarity 308. However, when the sensing signal pair 302 is ordered test-reference, as shown in sensing signal pair 302B, the output from the sense amplifier includes a negative error polarity 322. Although a subset of sensing signal pairs 302 of a particular example is depicted, it should be understood that over time and/or over an entire width of a display, compounding errors may be mitigated since the alternating of the error polarities 308, 322 enable at least some of the sensing error to be filtered out via a spatial filter of the filter 390. Furthermore it should be understood that the filter 390 may be or include an analog and/or a digital filter, or a combination of the two, based on the sensing circuitry and other circuitry used to implement the electronic display 18.

Figure 39B:
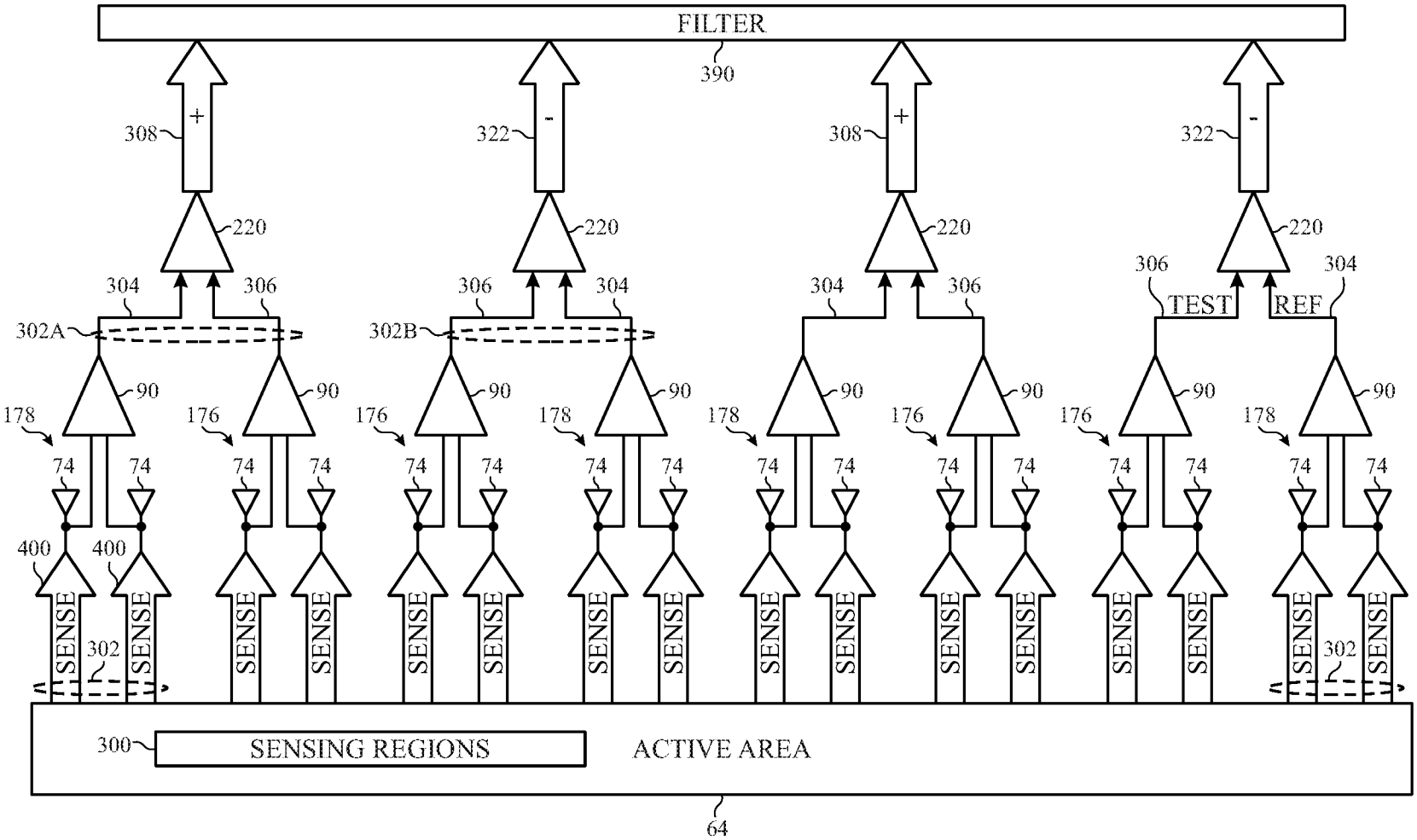
FIG. 39B is a block diagram of difference-differential sensing that leverages the varied positioning of sensing signal pairs, in accordance with an embodiment.

As a second example, FIG. 39B is a block diagram of difference-differential sensing operations that leverage the varied positioning of sensing signal pairs. Sensed data from the sensing regions 300 of the active area 64 transmits to sense amplifiers 90 during sensing operations. As explained above, the sensed data is isolated from sensing signal pair 302 common mode noise based on comparison between a test sense signal 400 and a reference sense signal 400 transmitted via sense lines 80. In this example, the test signal and the reference signal of the sensing signal pair 302 are left undesignated, however in an actual implementation one of the sense signals 400 is to be designated a test signal and the other sense signal 400 is to be designated a reference signal. This comparison may be performed at the sense amplifier 90, where the first difference may transmit from the sense amplifier 90 to another sense amplifier 90 to repeat determination of the sensed data to remove additional noise. The second difference from the second sense amplifier 90 transmits to the filter 390 as sensed data. The sensed data may include error of a particular polarity based on the relative effect positioning of the sensing signals 304, 306 of the sensing signal pair 302. For example, when the sensing signal pair 302 is ordered reference-test, as shown in sensing signal pair 302A, the output from the sense amplifier includes a positive error polarity 308. However, when the sensing signal pair 302 is ordered test-reference, as shown in sensing signal pair 302B, the output from the sense amplifier includes a negative error polarity 322. Although a subset of sensing signal pairs 302 of a particular example is depicted, it should be understood that over time and/or over an entire width of a display, compounding errors may be mitigated since the alternating of the error polarities 308, 322 enable at least some of the sensing error to be filtered out via a spatial filter of the filter 390. Furthermore it should be understood that the filter 390 may be or include an analog and/or a digital filter, or a combination of the two, based on the sensing circuitry and other circuitry used to implement the electronic display 18.

The benefits from alternating error polarity of outputs from sense amplifiers 90 may apply to variety of sensing patterns. For example, FIGS. 40A-N depict a variety of example sensing patterns 410. In general, the more modulated (e.g., higher frequency of alternation within the sense amplifier output error polarities) the error signal polarities are, the more error may be filtered out by the filter 390. One or more sensing patterns 410 may be stored in a memory 14 or storage 16, and accessed by the display 18, such as via the driver integrated circuit 68. A sensing pattern 410 may indicate directly to the display 18 which sensing regions 300 to send test sensing signals 306 and which sensing regions 300 to send reference sensing signals 304. In some embodiments, a sensing pattern 410 indicates to the display 18 a desired or expected error polarity output (e.g., positive or negative) of a particular sensing signal pair 302, and the display 18 determines based on a current sensing operation what signals (e.g., test sensing signals 306 or reference sensing signals 304) to apply to a particular sensing region 300.

As indicated by the key, the error polarities 308, 322 in each of FIG. 40A-N represent an expected polarity of a sensing error. That is, the error polarities 308, 322 may be correlated to an orientation and/or relative placement of test lines and reference lines of respective sensing signal pairs 302. An error polarity may be associated with at least two sensing regions 300, such that a respective arrangement of the sensing signal pair 302 for the sensing regions 300 based on whether the error polarity is a positive error polarity 308 or a negative error polarity 322. Each sensing region 300 may include one pixel, a group of pixels, or another suitable region of the electronic display 18 that benefits from processing error and sensing signals in the manner described. It is noted that multiple rows and columns are depicted in the same frame in FIGS. 40A-N. In some sensing operations, data is measured on a row-by-row basis. As such, the sensing patterns may represent a sensing pattern to be used over a whole sensing operation associated with multiple sensing operation sub-cycle.

FIG. 40A is an illustration of a first example sensing pattern 410 that leverages varied positioning of sensing signal pairs 302. The sensing pattern 410 depicts a column alternating sensing pattern 410A that starts with a negative error polarity output (e.g., negative error polarity 322). The negative error polarity output may be generated by sensed data via a reference-test signal placement (e.g., same placement as sensing signal pair 302A of FIG. 39A) and the positive error polarity output (e.g., positive error polarity 308) may be generated by sensed data via a test-reference signal placement (e.g., same placement as sensing signal pair 302B of FIG. 39A). Sometimes the sensing pattern 410 may begin with a positive error polarity output, as shown in FIG. 40B. FIG. 40B is an illustration of a second example sensing pattern 410 of a column alternating sensing pattern 410B. It is noted that, in some examples, the negative error polarity output may be generated via a test-reference signal placement and the positive error polarity output may be generated via a reference-test signal placement. In some examples, the relationship between sense line 80 placement and polarity may be defined based on specific circuitry used in the electronic device 10 (e.g., in some systems a positive error polarity output may be generated via a test-reference signal placement if compatible with circuitry of the electronic device 10).

As another example, FIG. 40C is an illustration of a third example of a column alternating sensing pattern 410C that leverages the varied positioning of sensing signal pairs as part of an intervening pattern. In the pattern of column sensing pattern 410C, each column alternates its output of error polarities 308, 322. Just as with FIG. 40B, the column alternating sensing pattern 410C may begin with an opposite polarity error output (e.g., negative error polarity 322). This is shown in FIG. 40D, where FIG. 40D is an illustration of an example sensing pattern 410 of a column alternating sensing pattern 410D that begins with a negative error polarity output 322.

FIG. 40E is an illustration of a fifth example sensing pattern 410, sensing pattern 410E. The sensing pattern 410E leverages the varied positioning of sensing signal pairs 302 by positioning error polarity outputs into a semi-alternating sensing pattern beginning with a positive error polarity 308. FIG. 40F is also an illustration of a semi-alternating sensing pattern 410F that instead begins with a negative error polarity 322.

FIG. 40G is an illustration of a seventh example of a sensing pattern 410, sensing pattern 410G, that leverages the varied positioning of sensing signal pairs 302. The sensing pattern 410G is an alternating sensing pattern. The alternating sensing pattern may enable filtering out of the most sensing error from the sensed data. This may be due to the alternating sensing pattern shifting the frequency spectrum of the sensing error a relatively higher amount away from the passband of the filtering operations when compared to the other sensing patterns. Similar to sensing pattern 410G, FIG. 40H is also an illustration of an alternating sensing pattern 410H, but one that begins with a negative error polarity 322.

In some examples, desired compensation may be facilitated via a randomly alternating sensing pattern as shown in FIGS. 40I and 40J. FIGS. 40I and 40J are illustrations of randomly alternating sensing patterns 4101 and 410J. Randomly alternating sensing patterns may be generated by the processor core complex 12 and/or the display 18 leveraging a Gaussian distribution to generate a random placement of the various expected or desired error polarity outputs from sensing signal pairs 302. In some embodiments, there may be an improvement when using an equal amount of negative error polarities 322 and positive error polarities 308 (e.g., 10 negative error polarities and 10 positive error polarities). However, in some embodiments, different amounts of the negative error polarities 322 and the positive error polarities 308 may be used (e.g., X-number of negative error polarities and Y-number of positive error polarities).

Furthermore, in some embodiments, the processor core complex 12 and/or the display 18 may take historic, expected, and/or current image frame information and/or image data into consideration when designing a sensing pattern 410 of the negative error polarities 322 and/or positive error polarities 308. In some embodiments, this analysis of image frame information and/or image data may happen while the electronic device 10 operates to present images. An example of a sensing pattern that may result from the processor core complex 12 and/or the display 18 considering the image data is shown in FIG. 40J. FIG. 40J is an illustration of a tenth example of a sensing pattern 410J generated based on portion of the image frame to be presented. The sensing pattern 410J, for example, has a portion 412 that uses an alternating sensing pattern and a portion 414 that uses a regionally alternating sensing pattern to help reduce sensing errors of the sensed data. Another example of this is FIG. 40K. FIG. 40K is an illustration of an example sensing pattern 410K and FIG. 40L is an illustration of an example sensing pattern 410L, where both sensing patterns 410K and 410L use a combination of negative error polarities 322 and positive error polarities 308 deemed to be suitable for that particular electronic display 18.

Up to this point, examples of sensing patterns that spatially vary have been discussed. However, it is noted that sensing patterns may vary temporally as well. In this way, a sensing pattern may include temporally alternating sensing patterns. An example of this is shown in FIGS. 40M and 40N.

Figure 40M:
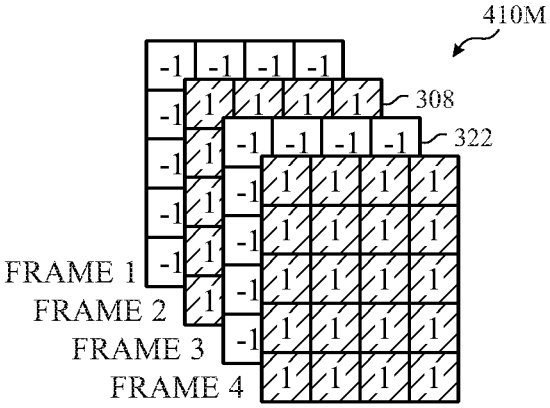
FIG. 40M is an illustration of a thirteenth example of a sensing pattern that leverages the varied positioning of sensing signal pairs, in accordance with an embodiment.
Figure 40N:
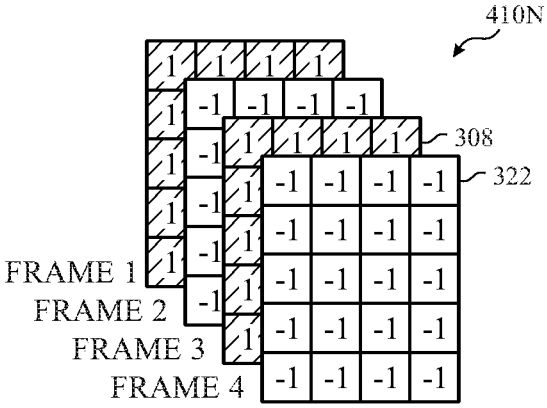
FIG. 40N is an illustration of a fourteenth example of a sensing pattern that leverages the varied positioning of sensing signal pairs, in accordance with an embodiment.

FIG. 40M is an illustration of an example sensing pattern 410M that leverages the varied positioning of sensing signal pairs 302 over time. As shown, the sensing pattern 410M for a first frame uses a uniform sensing pattern of negative error polarities 322 subsequently followed by second frame of a uniform sensing pattern of positive error polarities 308. Since the first frame of a first error polarity (e.g., negative polarity) is followed by an opposite error polarity (e.g., positive polarity), the sensing pattern 410M is temporally alternating. As shown in FIG. 40N, which is an illustration of another temporally alternating sensing pattern 410N, temporally alternating sensing patterns may begin with a first frame of positive error polarities 308 and/or with a first frame of negative error polarities 322, as long as the subsequent frames are alternating over time. However, it should be understood that temporally alternating sensing patterns 410 are not limited to uniform sensing patterns 410M and 410N. Any suitable combination of temporally and spatially alternating sensing patterns 410 may be used to improve sensing operations.

Figure 40O:
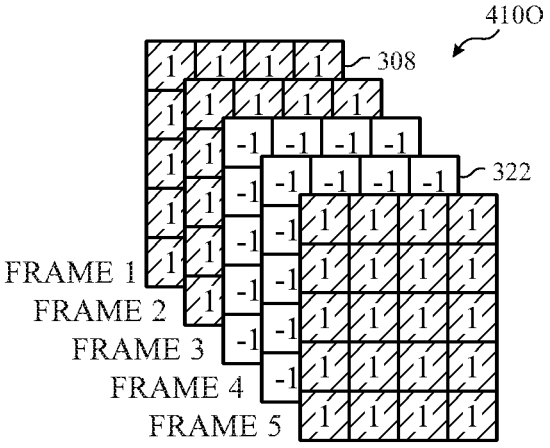
FIG. 40O is an illustration of a fifteenth example of a sensing pattern that leverages the varied positioning of sensing signal pairs, in accordance with an embodiment.
Figure 40P:
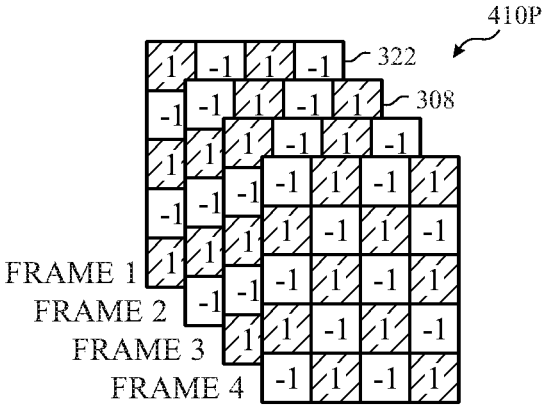
FIG. 40P is an illustration of a sixteenth example of a sensing pattern that leverages the varied positioning of sensing signal pairs, in accordance with an embodiment.

For example, FIG. 40O is an illustration of another example sensing pattern 410O. The sensing pattern 410O is a temporally alternating sensing pattern that has certain consecutively repeating sensing pattern frames. As another example, FIG. 40P is an illustration of another example of a sensing pattern 410P. The sensing pattern 410P is a temporally and spatially alternating sensing pattern.

Figure 41:
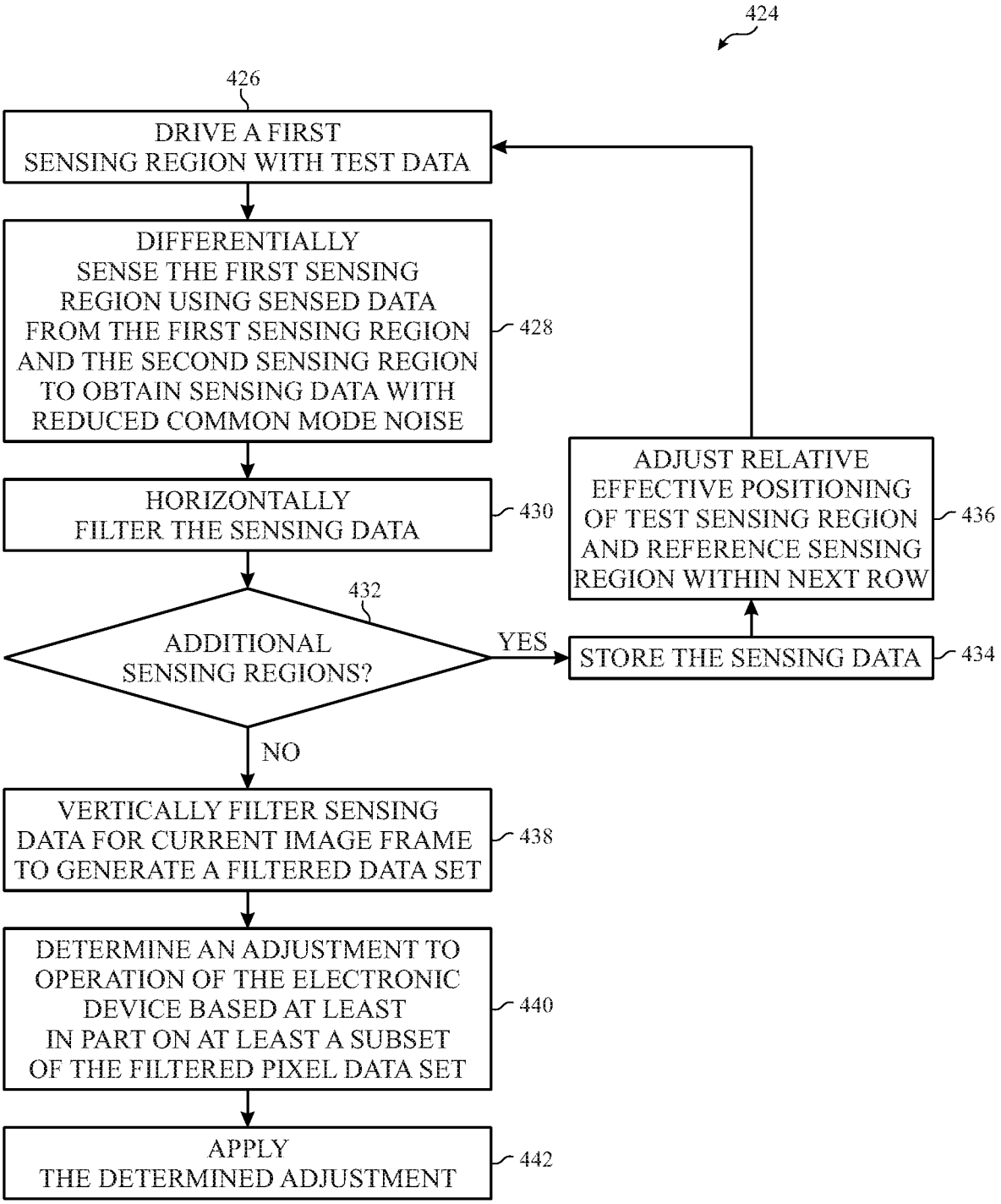
FIG. 41 is a flowchart of a method for performing differential sampling with consideration to varied positioning of sensing signal pairs, in accordance with an embodiment.

To illustrate how the display 18 may reduce sensing errors via alternating sensing patterns, FIG. 41 is a flowchart of a method 424 for performing differential sampling based on varying sensing patterns 410. Although the method is described below as being performed by the display 18 (e.g., display 18 via the driver integrated circuit 68), it should be understood that any suitable processing and/or computing circuitry may perform some or all of the described operations either alone or in coordination with the processor core complex 12. Furthermore, although the following operations are described in a particular order, it should be understood that any suitable order and/or any suitable number of operations may be performed in addition to or instead of the described operations when performing the following operations of the method 424.

At block 426, the display 18 may drive a first sensing region with a test sensing signal 306 (e.g., test data) and a second sensing region with a reference sensing signal 304 (e.g., no data, not applied with test data, zero data). The first sensing region and/or the second sensing region may be a subset of the sensing regions 300 depicted in FIGS. 39A and 39B. In some sensing operations, the display 18 may operate one or more display drivers of the electronic display 18 (e.g., driver integrated circuit 68) to drive various sensing regions 300 with test sensing signal 306 and/or reference sensing signal 304 during sensing operations. Furthermore, in some sensing operations, driving the first sensing region and/or the second sensing region includes driving a subset of individual pixels 66 with test sensing signal 306 of a first row of pixels 66.

When the display 18 drives the first sensing region and the second sensing region, the display 18 may reference a saved indication of the sensing pattern 410 corresponding to the current image frame. One or more sensing patterns 410, or saved indications of sensing patterns 410, may be stored in a memory 14 or storage 16, and be accessible by the driver integrated circuit 68 (or other suitable processing circuitry, such as processor core complex 12). A sensing pattern 410 may indicate directly to the driver integrated circuit 68 which sensing regions 300 to send test sensing signals 306 and which sensing regions 300 to send reference sensing signals 304.

In some embodiments, a sensing pattern 410 may indicate to the driver integrated circuit 68 a desired or expected error polarity output (e.g., positive or negative) of a particular sensing signal pair 302. The driver integrated circuit 68 may determine based on a current sensing operation which subset sensing regions to apply test sensing signals 306 (e.g., the first sensing region or the second sensing region) of the sensing region 300. In some cases, the sensing pattern 410 may not explicitly indicate the sensing regions 300 to be driven with reference sensing signals 304. In these cases, the display 18 may determine which sensing regions 300 are to not be driven with the test sensing signals 306 to determine which sensing regions 300 are to be driven with the reference sensing signal 304 (e.g., the zero data). For example, the display 18 may use the sensing pattern 410 to generate a signal map that translates locations for polarities into a signal transmission plan, and thus may use an inverse of the signal map to determine which subset sensing regions to not drive with test sensing signals 306. After referencing the sensing pattern 410 using one of the above-described or any suitable techniques, the display 18 may determine which sensing signal pair 302 to drive to output a positive error polarity 308 and which to drive to output a negative error polarity 322.

At block 428, the display 18 may differentially sense the first sensing region using data (e.g., common mode noise and test data) returned from driving the first sensing region with the test sensing signals 306 and using any data (e.g., common mode noise and zero data) returned from driving the second sensing region with the reference sensing signals 304. Differentially sensing the first sensing region and the second sensing region may remove or reduce at least the common mode noise shared between the first sensing region and the second sensing region. It is noted that reducing sensing errors via leveraging of varied positioning of the sensing signal pairs 302 may be used in conjunction with a variety of differential sensing techniques including differential sensing (DS), difference-differential sensing (DDS), correlated double sampling (CDS), correlated-correlated double sampling (CDS-CDS), programmable capacitor matching, or any combination of those techniques, or the like. The display 18 may repeat operations of block 426 and block 428 for subset sensing region to be sensed of the current row or horizontally-related sensing region. It is noted that these repeated operations may be perform at least partially simultaneous to other sensing regions of the current row or horizontally-related sensing region.

At block 430, the display 18 may horizontally filter the sensed data from each respective row or horizontally-related sensing region. The display 18 may use techniques described at block 366 of FIG. 38A when horizontally filtering the sensed data for each respective row or horizontally-related sensing region. Since the display 18 obtained sensed data based on driving of sensing regions according to the sensing pattern, and thus drove sensing error frequency spectrums out of filtering operation passbands, horizontally filtering the sensed data may remove at least a portion of the sensing error. It is noted that, as described earlier, the processor core complex 12 may perform the filtering operations of block 430.

At block 432, the display 18 may determine whether additional sensing regions are to be sensed during the sensing operations. When the display 18 determines that additional sensing regions are to be sensed, the display 18 may proceed to store the sensed data after horizontal filtering at block 434 and continue on to adjust, at block 436, the varied positioning of the test sensing regions and the reference sensing regions according to the sensing pattern (e.g., sensing pattern referenced at block 426) and repeat, at block 426, driving of the sensing regions. It is noted that a next row or next sensing region 300 to be sensed may be an immediately next row or sensing region 300, and/or any suitable subsequent row or sensing region 300, which is selected for sensing.

Eventually, at block 432, the display 18 may determine that no additional sensing regions 300 are to be sensed for the current frame of the sensing operations. When this determination is made, the display 18 may proceed onto block 438. At block 438, the display 18 may vertically filter sensed data for the current frame to generate a filtered data set. Since the filtered data set was generated using techniques that leverage varied positioning of sensing signal pairs 302, sensing error of the filtered data set may be reduced relative to final sensing errors of a different data set generated using techniques that do not leverage varied positioning of sensing signal pairs 302. It is noted that, as described earlier, the processor core complex 12 may perform the filtering operations of block 432.

At block 440, the display 18 may use the filtered data set to determine an adjustment to an operation of the electronic device 10 to help reduce visual artifacts of the electronic display 18. Examples of adjustments include an adjustment to the electronic display 18, an adjustment to image data values used to drive presentation of image frames via the display, an adjustment to the refresh rate of the display, or the like. Any suitable processing or determination operation may be performed at block 440 to determine how to adjust the image data based at least in part on display sensing feedback (e.g., filtered data set). At block 442, the display 18 may apply the determined adjustment, and thus use the improved sensed data resulting from leveraging varied positioning techniques, to an operation of the electronic display 18. It is noted that the processor core complex 12 may help to determine and apply the adjustment of blocks 440, 442.

Combinations of Approaches

While many of the techniques discussed above have been discussed generally as independent noise-reduction techniques, it should be appreciated that these may be used separately or in combination with one another. Indeed, the specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

Technical effects of the present disclosure include leveraging varied or relative effective positioning techniques to improve sensed data outputted from filtering operations. Instead of sensing errors having a same polarity that may increase sensing error after spatial filtering operations, sensing operations may include alternating test sensing signals and reference sensing signals (e.g., an input of no test sensing signal, zero data). A frequency of alternation (e.g., how often positive polarities and negative polarities alternate) within a sensing pattern may change an amount to which a frequency spectrum of sensing noise is shifted over time. When the frequency spectrum of the sensing noise is shifted out of the passband of the spatial filter, the sensing noise may be at least partially removed from the sensed data. Filtered sensed data that is generated via techniques that leverage varied positioning to reduce sensing noise in the filtered sensed data may be used to determine an adjustment used to improve presentation of an image on a display. Thus, when a quality of the filtered sensed data improves (e.g., lower noise), perceived image quality of the image presented on the display may improve (e.g., fewer visual artifacts).

What is claimed is:

1. An electronic device comprising:

a processor configured to generate image data and adjust the image data based at least in part on display sensing feedback;

a memory storing a sensing pattern configured to be followed when applying test data during sensing operations to obtain the display sensing feedback; and an electronic display comprising:

an active area configured to display an image frame corresponding to the image data; and sensing circuitry configured to obtain the display sensing feedback at least in part by:

applying first test data to a first sensing region of the active area based at least in part on the sensing pattern;

differentially sensing an electrical value of the first sensing region in comparison to an electrical value of a second sensing region not applied with the first test data to generate a first determined difference comprising a positive polarity sensing error;

applying second test data to a third sensing region of the active area based at least in part on the sensing pattern;

differentially sensing an electrical value of the third sensing region in comparison to an electrical value of a fourth sensing region not applied with the second test data to generate a second determined difference comprising a negative polarity sensing error; and filtering the first determined difference and the second determined difference, wherein the positive polarity sensing error is reduced from the first determined difference after the filtering thereby further enhancing a quality of the sensed electrical value of the first sensing region.

2. The electronic device of claim 1, wherein the second determined difference is determined at a time after the first determined difference.

3. The electronic device of claim 1, wherein the first test data is equal to the second test data.

4. The electronic device of claim 1, wherein the processor is configured to operate the sensing circuitry to apply the first test data to the first sensing region or to the second sensing region of the active area based at least in part on the sensing pattern stored in the memory.

5. The electronic device of claim 1, wherein the sensing pattern indicates the negative polarity sensing error as adjacent to the positive polarity sensing error.

6. The electronic device of claim 5, wherein, in response to the sensing pattern defining the negative polarity sensing error to as adjacent to the positive polarity sensing error, the sensing circuitry is driven by the processor to not apply the first test data to the second sensing region of the active area defined by the sensing pattern to be disposed between the first sensing region and the fourth sensing region.

7. The electronic device of claim 1, wherein the sensing pattern comprises a column alternating sensing pattern, a semi-alternating sensing pattern, an alternating sensing pattern, a randomly alternating sensing pattern, a regionally alternating sensing pattern, a temporally alternating uniform sensing pattern, a temporally and spatially alternating sensing pattern, or any combination thereof.

8. The electronic device of claim 1, wherein the electrical value comprises a voltage.

9. The electronic device of claim 1, wherein the electrical value comprises a current.

10. The electronic device of claim 1, wherein the sensing circuitry is configured to obtain the display sensing feedback at least in part by digitizing the sensed electrical value of the first sensing region and digitally filtering the digitized value of the differentially sensed electrical value of the first sensing region.

11. An electronic display comprising:

an active area with a plurality of sensing regions; and a driver integrated circuit configured to:

receive a varying sensing pattern, wherein the varying sensing pattern defines a first subset of the plurality of sensing regions that are to receive test data of a sensing operation, wherein the varying sensing pattern defines a second subset of the plurality of sensing regions that are to not receive test data of the sensing operation, wherein the varying sensing pattern defines an arrangement of respective sensing regions of the first subset of the plurality of sensing regions and of the second subset of the plurality of sensing regions based at least in part on expected polarities of sensing error outputs;

sense a first property of the plurality of sensing regions at least in part by driving sensing circuitry based at least in part on the varying sensing pattern to generate sensed data; and reduce a noise component of the sensed data at least in part by filtering the sensed data.

12. The electronic display of claim 11, wherein the varying sensing pattern defines an arrangement of respective sensing regions of the first subset of the plurality of sensing regions and of the plurality of second subset of the plurality of sensing regions based at least in part on expected polarities of sensing error outputs such that a first output comprising a negative sensing error is adjacent to a second output comprising a positive sensing error.

13. The electronic display of claim 11, wherein the driver integrated circuit filtering the sensed data comprises the driver integrated circuit applying a low pass filter to the sensed data in a spatial domain.

14. The electronic display of claim 11, wherein the driver integrated circuit comprises an additional capacitor structure between at least one pair of sense lines, wherein the additional capacitor structure is programmable, and wherein the driver integrated circuit is configured to program the additional capacitor structure such that a ratio of a capacitance between the at least one pair of sense lines is configured to offset an effect of capacitance mismatch.

15. A method comprising:

differentially sensing a plurality of sensing regions at least partially driven with test data according to an alternating sensing pattern to obtain sensed data with reduced common mode noise;

filtering the sensed data with reduced common mode noise to obtain sensed data with reduced content-dependent error;

determining an adjustment to apply to an operation of an electronic device based at least in part on the sensed data with reduced content-dependent error; and applying the determined adjustment to the operation of the electronic device.

16. The method of claim 15, wherein differentially sensing the plurality of sensing regions comprises:

receiving the alternating sensing pattern, wherein the alternating sensing pattern defines a first subset of the plurality of sensing regions that are to receive test data via expected polarities of sensing error outputs, wherein the first subset of the plurality of sensing regions comprises a first sensing region and does not comprise a second sensing region;

driving the first sensing region with the test data based at least in part on the alternating sensing pattern;

determining to not drive the second sensing region with the test data based at least in part on the alternating sensing pattern; and differentially sensing an output sensed from the first sensing region to an output sensed from the second sensing region.

17. The method of claim 16, wherein the alternating sensing pattern comprises a temporally alternating uniform sensing pattern such that the first sensing region and the second sensing region are driven with a same placement across multiple sensing operations of a same first image frame but with an opposite placement with a second image frame.

18. The method of claim 15, wherein the differential sensing is performed as part of a difference-differential sensing (DDS) operation, a correlated double sampling (CDS) operation, a correlated-correlated double sampling (CDS-CDS) operation, or any combination thereof.

19. The method of claim 15, wherein the filtering of the sensed data with reduced common mode noise comprises using a spatial filter to obtain the sensed data with reduced content-dependent error.

20. The method of claim 19, wherein the filtering the sensed data comprises transmitting sensed data from sensing circuitry located within a driver integrated circuit to processing circuitry that digitally filters the sensed data.

* * * * *